US007773035B2

(12) United States Patent
Murata et al.

(10) Patent No.: US 7,773,035 B2
(45) Date of Patent: Aug. 10, 2010

(54) MICROSTRIP ANTENNA AND HIGH FREQUENCY SENSOR USING MICROSTRIP ANTENNA

(75) Inventors: Kensuke Murata, Fukuoka (JP); Hiroshi Tsuboi, Fukuoka (JP); Kengo Iwata, Fukuoka (JP); Tomoyuki Abe, Fukuoka (JP)

(73) Assignee: Toto Ltd., Fukuoka (JP)

( * ) Notice: Subject to any disclaimer, the term of this patent is extended or adjusted under 35 U.S.C. 154(b) by 442 days.

(21) Appl. No.: 11/664,292

(22) PCT Filed: Sep. 29, 2005

(86) PCT No.: PCT/JP2005/017970

§ 371 (c)(1),
(2), (4) Date: Mar. 29, 2007

(87) PCT Pub. No.: WO2006/035881

PCT Pub. Date: Apr. 6, 2006

(65) Prior Publication Data

US 2008/0088510 A1 Apr. 17, 2008

(30) Foreign Application Priority Data

| | | |
|---|---|---|
| Sep. 30, 2004 | (JP) | 2004-285767 |
| Dec. 2, 2004 | (JP) | 2004-349402 |
| Mar. 25, 2005 | (JP) | 2005-087665 |
| Jun. 21, 2005 | (JP) | 2005-180355 |

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 4,367,474 A 1/1983 Schaubert et al.

(Continued)

FOREIGN PATENT DOCUMENTS

EP 1 460 713 A1 9/2004

(Continued)

OTHER PUBLICATIONS

Office Action dated Mar. 13, 2008 in corresponding Korean Patent Application No. 10-2007-7007243 (and English translation).

(Continued)

*Primary Examiner*—Douglas W Owens
*Assistant Examiner*—Dieu Hien T Duong
(74) *Attorney, Agent, or Firm*—Posz Law Group, PLC

(57) ABSTRACT

A microstrip antenna has feed element 102 and parasitic elements 104, 106 on the front surface of substrate 1. Microwave electrical power is applied to feed element 102. Parasitic elements 104, 106 are connected via through hole type leads passing through substrate 1, to switches upon the rear surface of substrate 1, respectively. By actuating the switches individually, parasitic elements 104, 106 are individually switched between a grounded state and a float state. The direction of the radio beam emitted from the microstrip antenna is varied by selecting which of parasitic elements 104, 106 is grounded and floated. A microwave signal source connects to feed element 102 via an feed line 108 very much shorter than the wavelength, accordingly the transmission losses being low and the efficiency being excellent.

33 Claims, 53 Drawing Sheets

U.S. PATENT DOCUMENTS 7,486,975 B2 * 2/2009 Mori ..... 455/575.7

FOREIGN PATENT DOCUMENTS

| | | | |
|---|---|---|---|
| GB | 2373637 | A * | 9/2002 |
| JP | 61-25304 | | 4/1986 |
| JP | 4-38110 | | 3/1992 |
| JP | 04-129403 | | 4/1992 |
| JP | 04-140905 | | 5/1992 |
| JP | 05-088004 | | 4/1993 |
| JP | 05-152827 | | 6/1993 |
| JP | 06-029723 | | 2/1994 |
| JP | 06-085529 | | 3/1994 |
| JP | 07-128435 | | 5/1995 |
| JP | 07-249921 | | 9/1995 |
| JP | 09-214238 | | 8/1997 |
| JP | 10-028013 | | 1/1998 |
| JP | A-10-028013 | | 1/1998 |
| JP | 10-154911 | | 6/1998 |
| JP | 10-200326 | | 7/1998 |
| JP | 10-224142 | | 8/1998 |
| JP | 10-247815 | | 9/1998 |
| JP | 11-088044 | | 3/1999 |
| JP | 11-136025 | | 5/1999 |
| JP | 11-220317 | | 8/1999 |
| JP | 2002-217638 | | 8/2002 |
| JP | 2003-124730 | | 4/2003 |
| JP | 2003-142919 | | 5/2003 |
| JP | A-2003-142919 | | 5/2003 |
| JP | 2003-198239 | | 7/2003 |
| JP | 2003-258533 | | 9/2003 |
| JP | 2003-529259 | | 9/2003 |
| JP | 2004-023546 | | 1/2004 |
| JP | 2004-039868 | | 2/2004 |
| JP | 2004-128600 | | 4/2004 |
| JP | A-2004-128600 | | 4/2004 |
| JP | 2004-194350 | | 7/2004 |
| JP | 2004-201274 | | 7/2004 |
| WO | WO 01/73891 | A1 | 10/2001 |
| WO | WO 01/91231 | | 11/2001 |
| WO | WO 02/39544 | | 5/2002 |
| WO | WO 03/063295 | | 7/2003 |
| WO | WO 03/094292 | | 11/2003 |

OTHER PUBLICATIONS

Urata, Yashuhiko, *Beam-Adjustable Planar Arrays Consisting of Microstrip Antennas*, IEICE Transactions C, vol. J87-C, No. 1, pp. 100-111, Jan. 2004 with English translation.

Urata, Yashuhiko, *Electronically streerable microstrip array antennas*, Conference of the IEICE Communications Society, 2004, 1-B-1-241 Mar. 2004 with English translation.

Search Report issued on Dec. 6, 2005 for the PCT patent application No. PCT/JP2005/017970.

Extended European Search Report issued on Mar. 26, 2010 by the European Patent Office in corresponding European Application No. 05787934.8-2220/1804335.

Preston et al., "Electronic beam steering using switched patch elements", Electronic Letters, vol. 33, No. 1, 1997:7-8.

Li et al., "Switched planar hexagonal array of equilateral triangle patches for Hiperlan terminals", 4th International Conference on Microwave and Millimeter Wave Technology Proceedings, 2004:204-206.

Waterhouse, "Improving the scan performance of probe-fed misrostrip patch arrays on high dielectric constant substrates", IEEE Transactions on Antennas and Propagation, vol. 43, No. 7, 1995:705-712.

Dinger, "A planar version of 4.0 GHz reactively steered adaptive array", IEEE Transactions on Antennas and Propagation, vol. 34, No. 3, 1986:427-431.

Lee et al., "Novel scheme for design of adaptive printed antenna elements", Antennas and Propagation Society International Symposium, vol. 3, 2000:1252-1255.

Zhang et al., "A pattern reconfigurable microstrip parasitic array", IEEE Transactions on Antennas and Propagation, vol. 52, No. 10, 2004:2773-2776.

* cited by examiner

MICROSTRIP ANTENNA AND HIGH FREQUENCY SENSOR USING MICROSTRIP ANTENNA

TECHNICAL FIELD

The present invention relates to a microstrip antenna which transmits microwaves or radio waves of a higher frequency than microwaves, and in particular relates to a technique for controlling the radiating direction of the synthesized radio beam generated from the microstrip antenna. The present invention also relates to a high-frequency sensor which employs a microstrip antenna.

BACKGROUND ART

From the past, a microstrip antenna is known in which an antenna electrode and a ground electrode are respectively disposed upon the front surface and the rear surface of a substrate, and which generates radio waves from an antenna electrode in a perpendicular direction by applying a high-frequency microwave signal between the antenna electrode and the ground electrode. The following types of techniques are known for controlling the radiating direction of the synthesized radio beam which is generated from a microstrip antenna. For example, with the technique described in Japanese Laid-Open Patent Publication Heisei 7-128435, a plurality of antenna electrodes are disposed upon the surface of a substrate, and the radiating direction of the synthesized radio beam is changed by switching a high-frequency switch, thus changing the lengths of the electrical supply lines for the high-frequency signal to the antenna electrodes. In other words, by the lengths of the electrical supply lines to the plurality of antenna electrodes being different, a phase difference is created between the radio waves which are respectively generated from each of the plurality of antenna electrodes, and the radiating direction of the combined and synthesized radio beam is inclined towards that antenna whose phase has been delayed. Furthermore, for example, with the technique described in Japanese Laid-Open Patent Publication Heisei 9-214238, a plurality of antenna electrodes are provided whose radiating directions for synthesized radio beams are different, and the radiating direction of the synthesized radio beam is changed by switching the antenna electrodes to which a high-frequency signal is applied with a high-frequency switch. Furthermore, in Japanese Laid-Open Patent Publication 2003-142919, there is described a multibeam antenna of a feed point changeover type which includes a plurality of feed elements and a plurality of parasitic elements upon the surface of a substrate. With this multibeam antenna, it is arranged to be possible to connect or disconnect all or a portion of the plurality of feed elements to a feed terminal via switches. And it is arranged to be possible to select the radio beams whose radiating directions are different by switching the feed elements feeding by the switches.

A body detection device is known which uses radio waves generated from a microstrip antenna. With this body detection device, by varying the radiating direction of the synthesized radio beam which is emitted from the microstrip antenna as described above, it becomes possible to detect the position and the situation of a body more accurately, as compared to the case in which the radiating direction of the synthesized radio beam is fixed. For example, by scanning the radiating direction of the synthesized radio beam which is transmitted from the microstrip antenna over a two dimensional range by varying its X and Y directions, it is possible to ascertain the presence or absence of a body, and the situation thereof, over a two dimensional range. There are many applications for such a body detection device, such as, for example, target detection for an automatic tracking missile, or user detection for a toilet device, or the like. In whichever application, it is extremely useful to be able to vary the radiating direction of the synthesized radio beam which is transmitted from the microstrip antenna. For example, to focus the discussion upon the case of a user detection device for a toilet device, if the position or the state of a user is detected more accurately, then it is possible to control a washing device or a deodorization device or the like of a toilet in a more appropriate manner. Now, simply from the objective of ascertaining the state of the user accurately, perhaps it would be preferable to utilize a camera, but it is naturally impossible to use a camera for a toilet device. Accordingly, with a body detection device which employs radio waves, it is extremely important to make it possible to ascertain the state of the user more accurately by controlling the radiating direction of the synthesized radio beam. In this connection, in Japan, it is possible to utilize the frequencies of 10.525 GHz or 24.15 GHz with the objective of detecting a human body, and to utilize the frequency of 76 GHz with the objective of onboard collision prevention.

SUMMARY OF THE INVENTION

Problem at the Solution of which the Invention is Directed

According to the prior art techniques disclosed in the three patent publications described above, in order to change the radiating direction of the radio beam, it is necessary to perform switching by connecting, within an electrical supply line which transmits the microwave signal, a high-frequency switch which can selectively either pass or intercept the microwave signal, and moreover whose impedance for a microwave signal of the specified frequency is precisely adjusted to a predetermined appropriate value. However, when the frequency becomes high, variations in the characteristics and the connection states of the electrical supply lines and the high-frequency switches (for example, variations in the relative permittivity of the substrate, in the performance of the high-frequency switches, in the etching accuracy of the electrical supply line pattern, in the mounting positions of the switches, and so on) greatly influence antenna performance. If the connection state is bad, the amount of reflection of the microwave signal at the connection portion with the high-frequency switch increases, the electric energy which is supplied to the antenna via the high-frequency switch decreases, and it becomes impossible to emit a radio beam in the desired direction by varying the phase amount.

Furthermore, in the cases of the antennas described in Japanese Laid-Open Patent Publication Heisei 7-128435 and Japanese Laid-Open Patent Publication Heisei 9-214238, in order to vary the phase, a portion of the electrical supply line is branched off, and high-frequency switches are connected to both the ends thereof, so that it is necessary to perform switching. Due to this, at least two or more high-frequency switches are required for changing the radiating direction of the radio beam. Furthermore, it is impossible to avoid decrease of the efficiency, since the length and the shape of the electrical supply line which is branched off contributes to increase of the transmission losses. Moreover, this concept is not suitable for making the size of the substrate more compact and for reduction of the cost of manufacture, due to the number of components which are used and the configuration of the electrical supply lines.

In the case of an antenna, as described in Japanese Laid-Open Patent Publication 2003-142919, in which a plurality of feed elements opposed to each other are provided, it is only possible to change the radiating direction of the radio beam at intervals of 90 degree, since the excitating directions of the feed elements which are provided in the horizontal and the vertical direction are different. Furthermore, although the radiating direction of the radio beam is determined by selecting the element which is fed, its radiation angle is constant.

Accordingly, the object of the present invention is, in a microstrip antenna, with a simple structure, to make it possible to vary the radiating direction of the radio beam.

Means for Solution of the Problem

The microstrip antenna according to the present invention includes: a substrate; a feed element disposed upon a front surface of the substrate; a parasitic element disposed upon the front surface of the substrate and separated by a predetermined interelement spacing from the feed element; and a grounding means switching the parasitic element between grounding and float.

With the microstrip antenna according to one embodiment, the grounding means includes a ground electrode, and a switch for switching the parasitic element between coupled and uncoupled to the ground electrode. As this switch, there may be used a switch which includes two electrical contact points which are respectively coupled to the parasitic element and the ground electrode, and in which the two electrical contact points are separated by a first gap when it is switched ON, and are separated by a second gap which is larger than the first gap when it is switched OFF. Or, as the switch described above, there may also be used a switch which includes an insulation layer between the two electrical contact points which are respectively coupled to the parasitic element and the ground electrode. In either case, a MEMS switch may be used as a switch of this type of structure.

With the microstrip antenna according to one embodiment, the parasitic element is disposed so as to be separated from the feed element by the predetermined interelement spacing in a direction of excitation; and, the interelement spacing is $\lambda/4$-$\lambda/30$, $\lambda$ being the wavelength of radio waves in the air at the resonant frequency of the feed element.

With the microstrip antenna according to one embodiment, the parasitic element is disposed so as to be separated from the feed element by the predetermined interelement spacing in a direction perpendicular to a direction of excitation; and, the interelement spacing is $\lambda/4$-$\lambda/9$, $\lambda$ being the wavelength of radio waves in the air at the resonant frequency of the feed element.

With the microstrip antenna according to one embodiment, there are further included a plurality of the parasitic elements which are arranged on one side of the feed element in alignment linearly with the feed element; and a plurality of the grounding means respectively corresponding to the plurality of parasitic elements; and each of the interelement spacings of the plurality of parasitic elements is different.

With the microstrip antenna according to one embodiment, there are further included a plurality of the parasitic elements which are respectively arranged on different sides of the feed element; and a plurality of the grounding means respectively corresponding to the plurality of parasitic elements.

With the microstrip antenna according to one embodiment, there are further included a plurality of the parasitic elements which are arranged on both sides of the feed element in alignment linearly with the feed element; and a plurality of the grounding means respectively corresponding to the plurality of parasitic elements; and the size, or the interelement spacing, of each of the parasitic elements is different, so as to balance the influence of the parasitic elements which are disposed upon one side of the feed element and of the parasitic elements which are disposed upon the other side thereof upon an electronic beam.

With the microstrip antenna according to one embodiment, there is further included a dielectric layer which covers the front surface of the substrate, including the surfaces of the feed element and of the parasitic element.

With the microstrip antenna according to one embodiment, there is further included a dielectric mask which covers opposing end surfaces of the feed element and another the feed element which are adjacent each other, or opposing end surfaces of the feed element and a the parasitic element which are adjacent each other, or opposing end surfaces of a the parasitic element and another the parasitic element which are adjacent each other.

With the microstrip antenna according to one embodiment, there are further included a plurality of sub-antennas upon the front surface of the substrate, including a set of a the feed element and a the parasitic element; and slits disposed on a portion of the substrate corresponding to a boundary of the plurality of sub-antennas.

With the microstrip antenna according to one embodiment, there are further included a plurality of sub-antennas upon the front surface of the substrate, including a set of a the feed element and a the parasitic element; and a shield member disposed upon a portion of the substrate corresponding to a boundary of the plurality of sub-antennas, which is always maintained at a constant electrical potential.

With the microstrip antenna according to one embodiment, the parasitic element is adapted to be able to be grounded at a plurality of spots.

With the microstrip antenna according to one embodiment, the parasitic element is disposed to be directed diagonally to the direction of excitation of the feed element with respect to said feed element.

With the microstrip antenna according to one embodiment, there are further included, a plurality of first type of sub-antennas and a plurality of second type of sub-antennas, each of which includes a set of the feed element and the parasitic element disposed on the front surface of said substrate, and the first type of sub-antennas differ from said second type of sub-antennas with regard to the position relationship between the parasitic element and the feed element. For example, the parasitic element may be disposed to be directed diagonally to the direction of excitation of the feed element in the first type of sub-antenna with respect to said feed element; while, the parasitic element may be disposed parallel or perpendicular to the direction of excitation of the feed element in the second type of sub-antenna with respect to said feed element. And, the first and the second type of sub-antenna are disposed in complementary positions.

With the microstrip antenna according to one embodiment, the parasitic element comprises a constant grounding point which is always grounded at a position in the vicinity of the center portion of one or more exterior edge of the parasitic element orthogonal to its direction of excitation when the parasitic element is float.

With the microstrip antenna according to one embodiment, the feed element comprises a plurality of feed points for exciting the feed element in different directions, and a plurality of grounding points which are selectively grounded so as to enable any one of the excitations by the plurality of the feed points selectively and substantially disable others.

With the microstrip antenna according to one embodiment, a plurality of feed elements are disposed on the substrate adjacent to each other with no parasitic elements being placed between them, and a plurality of parasitic elements are disposed so as to surround the plurality of feed elements two-dimensionally.

With the microstrip antenna according to one embodiment, a plurality of feed elements are disposed on the substrate adjacent to each other with no parasitic elements being placed between them. And at least one predetermined point of the plurality of feed elements is switched between grounding and float.

With the microstrip antenna according to one embodiment, dielectric lenses are disposed upon the front of the feed element and the parasitic element.

With the microstrip antenna according to one embodiment, the grounding means comprises a line which can be opened and closed for releasing high frequency from the parasitic element to ground level, wherein the length of the line is m times the half wavelength of the high frequency, m being a whole number equal to or greater than 1. And, in another embodiment, the length of the line part which couples to the parasitic element is m times the above described half wavelength, m being a whole number equal to of greater than 1 when this line is in the open state.

With the microstrip antenna according to one embodiment, the length of the line described above can be selected between m times the half wavelength of the high frequency, m being a whole number equal to or greater than 1 and which is not.

With the microstrip antenna according to one embodiment, the line includes a means for adjusting its impedance (for example, a stub which is connected to the line, or a dielectric layer which covers the surface of the line, or the like).

With the microstrip antenna according to one embodiment, it is arranged for a predetermined point upon the feed element at a place upon said feed element so as to minimize a current amplitude value of n-th harmonic, n being a whole number equal to or greater than 2 or in the vicinity thereof, and at a place so as to maximize the current amplitude value of the fundamental wave or in the vicinity thereof, to be grounded.

With the microstrip antenna according to one embodiment, there are further included a substantially flat first circuit unit including a control circuit which controls the grounding means; and a substantially flat second circuit unit including a high-frequency oscillator which generates high-frequency power for applying to the feed element; and the first and the second circuit unit are integrally coupled together with laminated upon the rear surface of the substrate.

With the microstrip antenna according to one embodiment, a substantially flat spacer is interposed between the substrate and the first circuit unit, and/or between the first circuit unit and the second circuit unit. And the substrate, the first and second circuit units, and the spacer are integrally coupled together with laminated.

With the microstrip antenna according to one embodiment, a feed line is extended from the high-frequency oscillator upon the second circuit unit to the feed element upon the substrate. And the feed line passes through the interior of the spacer and is surrounded by the spacer.

With the microstrip antenna according to one embodiment, the first and second circuit units share the same ground electrode which is interposed between the first and second circuit units.

The microstrip antenna according to another aspect of the present invention includes: a substrate; a feed element disposed upon a front surface of the substrate, and resonates at a first resonant frequency bandwidth; a looped element disposed so as to surround the feed element, and resonates at a second resonant frequency bandwidth; a first parasitic element which is disposed upon the front surface of the substrate and is separated by a predetermined interelement spacing from the looped element or the feed element, and resonates at the first resonant frequency bandwidth; a second parasitic element which is disposed upon the front surface of the substrate and is separated by a predetermined interelement spacing from the looped element or the feed element, and resonates at the second resonant frequency bandwidth; and a grounding means switching the first parasitic element and the second parasitic element between grounding and float.

According to another aspect of the present invention, a high-frequency sensor which uses a microstrip antenna includes: a substrate; a feed element disposed upon a front surface of the substrate; a parasitic element disposed upon the front surface of the substrate and separated by a predetermined interelement spacing from the feed element; and a grounding means switching the parasitic element between grounding and float.

BENEFITS OF THE INVENTION

According to the present invention, with a microstrip antenna, with a simple structure, it is possible to make the radiation direction of the radio beam variable.

BRIEF DESCRIPTION OF THE DRAWINGS

FIG. 40 is a figure showing, for this fourteenth embodiment, the waveforms of the currents which flow in the feed element and in the parasitic elements, when a switch 322 is OFF and when it is ON;

FIG. 46A is a sectional view showing the OFF state of electrical contact points of a variant embodiment of a switch which is suitable for application to controlling the inclination of a radio beam, while

PREFERRED EMBODIMENTS OF THE INVENTION

Figure 1:
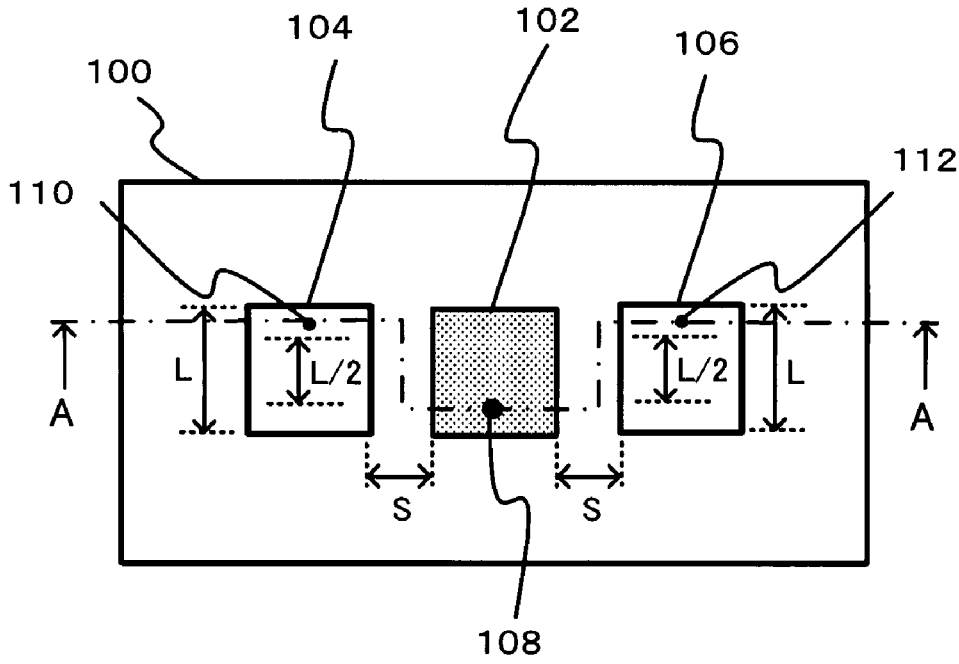
FIG. 1 is a plan view of a microstrip antenna according to an embodiment of the present invention.

FIG. 1 is a plan view of a microstrip antenna according to an embodiment of the present invention. And FIG. 2 is a sectional view of FIG. 1 along line A-A.

As shown in FIG. 1, three antenna elements 104, 102, and 106, each of which is a thin layer of electric conductive material, are arranged linearly upon the front surface of flat substrate 100 which is made from an electric insulating material (for example, an insulating synthetic resin). Antenna element 102 in the center is a feed element which receives a power feeding of microwave electrical power directly from a microwave signal source (in other words, via an electrical lead). Two antenna elements 104 and 106 on both sides of feed element 102 are parasitic elements which do not receive any direct power feeding of electrical power. The excitating direction of feed element 102 is the vertical direction in the figure, and the direction in which three antenna electrodes 104, 102, and 106 are arranged is orthogonal to this excitating direction. In this embodiment, by way of example, right and left parasitic elements 104 and 106 are arranged in linearly symmetric positions with respect to feed element 102, in other words in positions which are the same distance from feed element 102, and also have the same dimensions as it. The dimensions of parasitic elements 104 and 106 can be made to be almost the same as the dimensions of feed element 102, but they may also be different (although their length in the excitating direction is restricted within the possible arrangement range, since it is the optimum value corresponding to the wavelength of the microwaves which are used, their width in the direction orthogonal to the excitating direction can be arranged in a broader range).

One end of feed line 108 is connected to a predetermined spot (hereinafter termed the feed point) on the rear surface of feed element 102. As shown in FIG. 2, feed line 108 is an electric conductive line (hereinafter this type of electric conductive line will be termed a "through hole") which pierces through substrate 100, and the other end of feed line 108 is connected to a microwave output terminal of microwave signal source 114, which is a one-chip IC provided on the rear surface of substrate 100. Feed element 102 receives, at the above described feed point, microwave electrical power of a specified frequency (for example, 10.525 GHz, 24.15 GHz, 76 GHz, or the like) outputted from microwave signal source 114, and is excited thereby.

Figure 2:
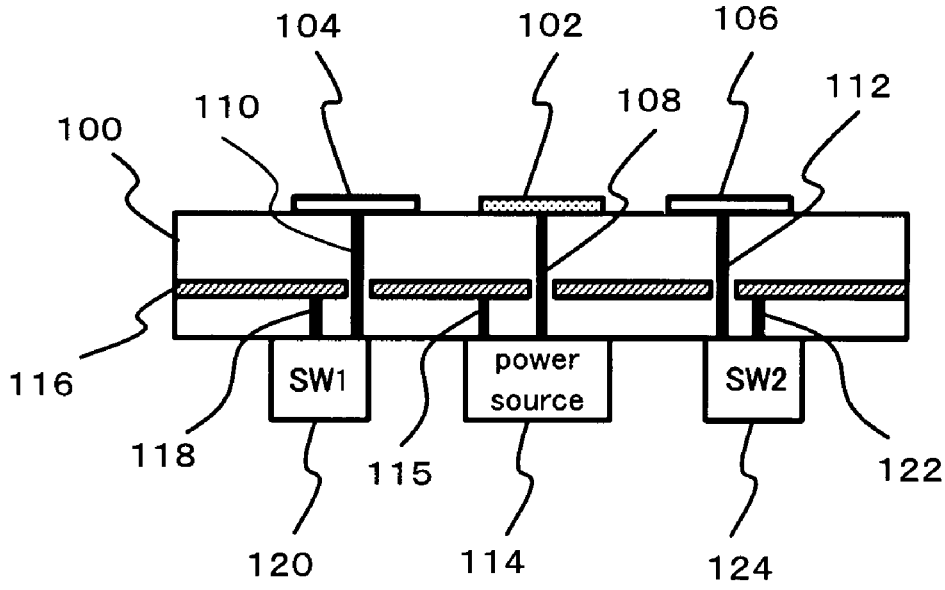
FIG. 2 is a sectional view of FIG. 1 along line A-A.

As shown in FIG. 2, substrate 100 is a multi layered substrate, and ground electrode 116 is made in the form of a thin layer in its interior, as one layer over the entire planar range of substrate 100. Ground electrode 116 is connected to a ground terminal of high-frequency signal source 114 via ground lead 115, which is a through hole.

As shown in FIGS. 1 and 2, the one ends of control leads 110 and 112, which are through holes, are also respectively connected to predetermined spots (hereinafter termed "ground points") upon the rear surfaces of parasitic elements 104 and 106. The other ends of control leads 110 and 112 are respectively connected to the one side terminals of switches 120 and 124, which are one chip ICs and which are provided upon the rear surface of substrate 100. The other side terminals of switches 120 and 124 are both connected to ground electrode 116 via ground leads 118 and 122, which are through holes. Switches 120 and 124 can be individually ON/OFF actuated. By switch 120 on the left side being ON/OFF actuated, parasitic element 104 upon the left side is switched between being connected to ground electrode 116, or float. And, by switch 124 on right side being ON/OFF actuated, parasitic element 106 upon the right side is switched between being connected to ground electrode 116, or float.

Although high-frequency switches are desirably utilized for switches 120 and 124, it is not particularly necessary to adjust their impedance with respect to the microwave frequency which is used precisely to an appropriate value, and it will be acceptable that the OFF performance (isolation) of these switches for intercepting the high-frequency signals is satisfactory.

As shown in FIG. 1, as one example, in the excitating direction of feed element 102 (the vertical direction), the position of the feed point of feed element 102 is chosen to be at a position removed above (or below) from the lower edge (or the upper edge) of feed element 102 by just the optimum antenna length (almost λg/2) corresponding to the wavelength λg upon substrate 100 of the microwaves which are used; and, in the direction (the horizontal direction in the figure) orthogonal to that excitating direction (the vertical direction in the figure), this position is chosen to be at the center position of feed element 102. On the other hand, as one example, in the above described excitating direction (the vertical direction in the figure), the position of the ground points of both of parasitic elements 104 and 106 are chosen to be at positions outside a range of width L/2 centered about the centers of parasitic elements 104 and 106; and, in the above described orthogonal direction (the horizontal direction in the figure), these positions are chosen to be at the center positions of parasitic elements 104 and 106. Here, L is the length of parasitic elements 104 and 106 in the excitating direction.

With the microstrip antenna having a structure as described above, the radiating direction of the radio beam outputted from this microstrip antenna is changed over between a plurality of directions by actuating switches 120 and 124 and thereby switched which of parasitic elements 104 and 106 is connected to ground electrode 116 (i.e. is grounded). Since the radiating direction is determined by the positional relationship between feed element 102 and parasitic elements 104 and 106, it is possible to connect microwave signal source 114 to feed element 102 via feed line 108 which is very much shorter than the wavelength, and accordingly the transmission losses are small and the efficiency is good. Furthermore, since it is possible to change the radiating direction of the radio beam with one switch connected to a control lead, accordingly this microstrip antenna is well adapted for reduction of the size of the substrate and reduction of the cost of manufacture.

Figure 3:
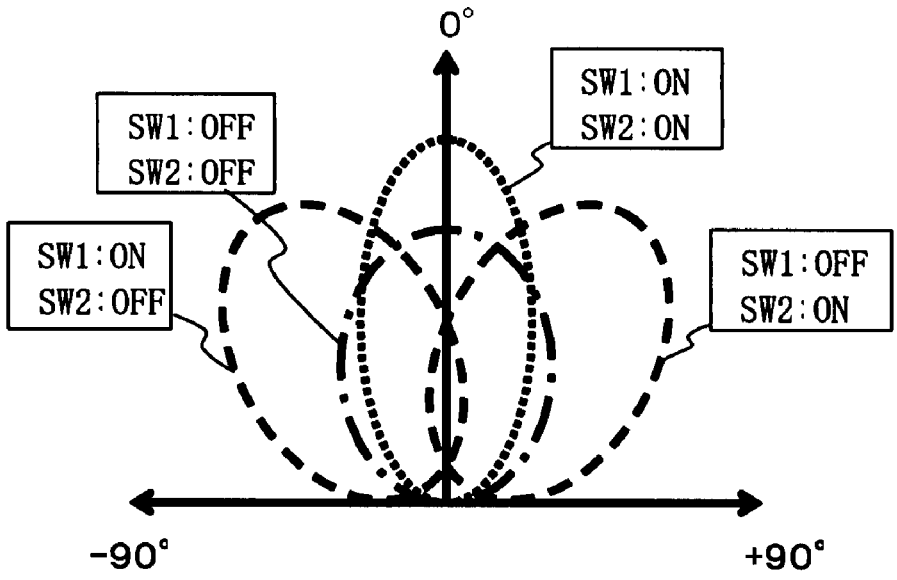
FIG. 3 is a figure showing a situation in which the radiating direction of a radio beam is changed by actuation of switches 120 and 124.

FIG. 3 shows the situation in which the radiating direction of the radio beam is changed by actuation of switches 120 and 124.

In FIG. 3, the ellipses schematically show the radio beams which are emitted, and the angle shown on the horizontal axis indicates the angle of the radiating direction of the radio beam with respect to the direction perpendicular to substrate 100 (the radiation angle): a positive angle means that the radiating direction is inclined to the right side in FIG. 1, while negative angle means that it is inclined to the left side.

As shown in FIG. 3, when both of switches 120 and 124 are ON (in other words, when both of parasitic elements 104 and 106 are grounded), then, as shown by the dot-line, the radio beam is emitted in the direction perpendicular to substrate 100. And, as well, when both of switches 120 and 124 are OFF (in other words, when both of parasitic elements 104 and 106 are not grounded), then, as shown by the single dashed line, the radio beam is similarly emitted in the direction perpendicular to substrate 100.

However, when left side switch 120 is ON and right side switch 124 is OFF (in other words, when only parasitic element 104 on the left side is grounded), then, as shown by the broken line, the radio beam is emitted in a direction which is inclined to the left side (or, depending upon the conditions, to the right side). On the other hand, when left side switch 120 is OFF and right side switch 124 is ON (in other words, when only parasitic element 106 on the right side is grounded), then, as shown by the other broken line, the radio beam is emitted in a direction which is inclined in the opposite direction to the one described above, i.e. to the right side (or, depending upon the conditions, to the left side).

Thus, by selecting parasitic elements 104 and 106 which are grounded in this manner, the radiating direction of the radio beam may be varied.

Figure 4:
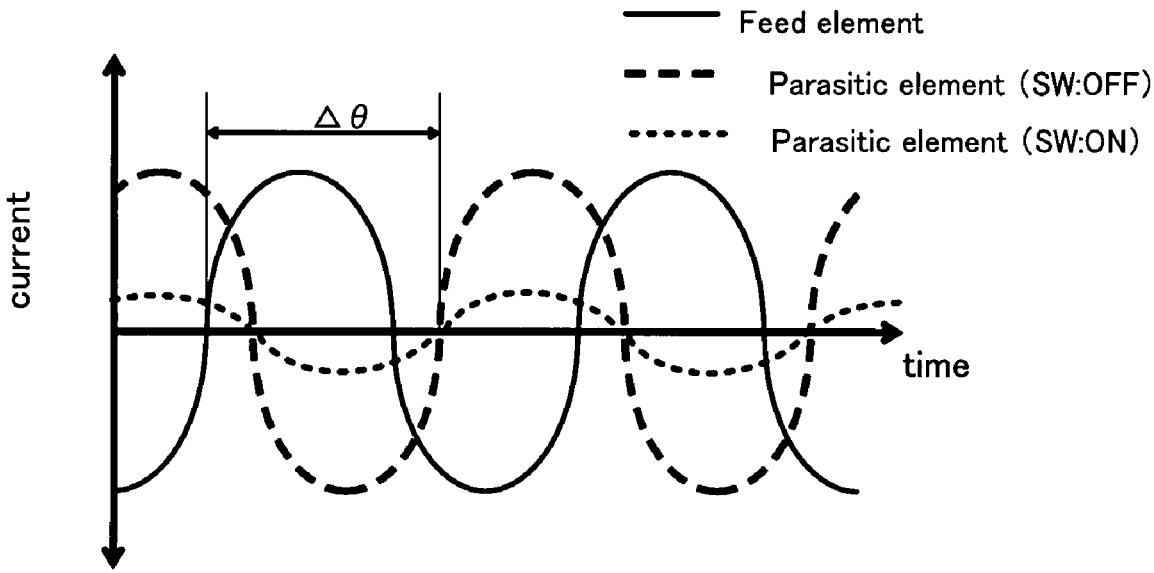
FIG. 4 is a figure showing the waveforms of microwave electrical currents flowing in a feed element and in parasitic elements, for explanation of the theory that the radiating direction of the radio beam is changed.

FIG. 4 is a figure showing waveforms of microwave electrical currents flowing in a feed element and in a parasitic element, for explanation of the theory of change of the radiating direction of the radio beam. This theory is not only applicable to the embodiment shown in FIG. 1, but is also common to the other embodiments of the present invention as well.

In FIG. 4, the solid line curve shows the waveform of the microwave electrical current flowing in a feed element. And the broken line curve shows the waveform of the microwave electrical current flowing in a parasitic element when this parasitic element is float. A certain phase difference Δθ is present between these two electrical current waveforms. Due to this phase difference, the radiating direction of the radio beam which is created by the operation of the microwave electrical currents in the feed element and the parasitic element comes to be inclined from the direction perpendicular to the substrate towards that element whose phase is delayed. And this inclination angle (the radiation angle) varies according to the phase difference Δθ.

In the example shown in FIG. 4, the microwave electrical current in the parasitic element (the broken line) is delayed by just the phase difference Δθ behind the microwave electrical current in the feed element (the solid line). However, since this delay phase difference Δθ is greater than 180 degree, substantially, this corresponds to an advance by just the phase difference obtained by subtracting Δθ from 360 degree. To put it in another manner, the phase of the feed element is delayed by just the phase difference obtained by subtracting Δθ from 360 degree. Accordingly, the radiating direction of the overall radio beam comes to be inclined from the direction perpendicular to the substrate towards the feed element, whose phase is delayed. Furthermore, depending upon the conditions, sometimes the delay phase difference Δθ described above further becomes greater, so as to exceed 360 degree. In this case, since substantially the parasitic element becomes the one whose phase is delayed by just the phase difference obtained by subtracting Δθ from 360 degree, accordingly the radiating direction of the radio beam comes to be inclined towards the parasitic element.

In FIG. 4, the dot-line curve shows the waveform of the microwave electrical current which flows in a parasitic element when that parasitic element is grounded. As shown in the figure, the value of the microwave electrical current which flows in a parasitic element which is grounded is extremely small. In other words, to put it crudely, this parasitic element is put into a state substantially the same as though it were not present (hereinafter, this is expressed as "is made ineffective") by grounding a parasitic element. As a result, the radio beam only comes to experience a slight influence from the parasitic element, and the inclination originating in the phase difference Δθ described above is almost not present. Accordingly, by switching the parasitic element between float and being grounded, the inclination of the radiating direction originating in the phase difference Δθ described above is changed over between occurring, and almost not being present.

According to the above theory, change of the radiating direction of the radio beam as explained in FIG. 3 is generated.

The above described phase difference Δθ of the microwave electrical current between the feed element and the parasitic element is determined by various causes, but, as one cause thereof, there is spacing length S between the feed element and the parasitic element (the interelement spacing), as shown in FIG. 1.

Figure 5:
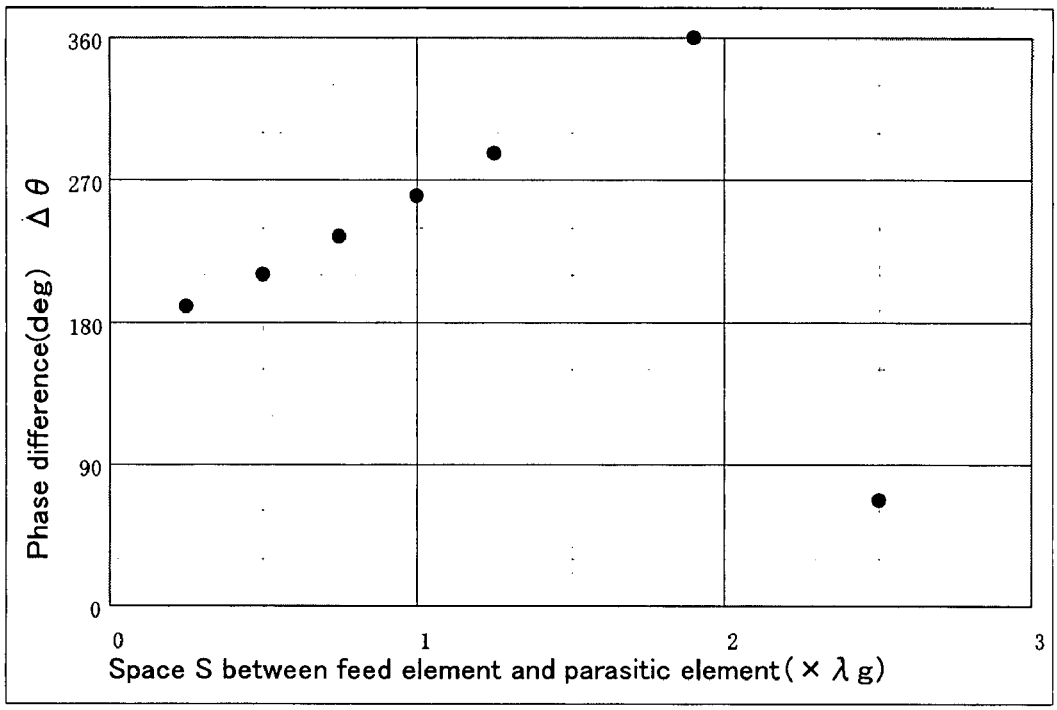
FIG. 5 is a figure showing an example of a relationship between an interelement spacing S and a phase difference $\Delta\theta$.

FIG. 5 is based upon the results of computer simulations performed by the present inventors, and shows an example of the relationship between interelement spacing S and the phase difference Δθ. The example shown in FIG. 5 is one which shows an example of the relationship between interelement spacing S and the phase difference Δθ (the delay phase difference of the parasitic element with respect to the feed element) with one concrete design example according to the embodiment shown in FIG. 1.

As shown in FIG. 5, if the interelement spacing S is increased from 0, until interelement spacing S reaches 2λg (where λg is the wavelength of the microwaves upon the substrate), the phase difference Δθ (the delay phase difference of the parasitic element with respect to the feed element) increases from 180 degree to 360 degree almost proportionally to interelement spacing S. This substantially means that the phase for the parasitic element is phase advanced over the phase for the feed element by the value obtained by subtracting Δθ from 360 degree. This advanced phase difference (360 degree minus Δθ) reduces from 180 degree to 0 degree along with increase of interelement spacing S.

On the other hand, when interelement spacing S exceeds 2λg, then the delay phase difference Δθ of the parasitic element with respect to the feed element exceeds 360 degree. However, in FIG. 5, the phase difference (Δθ minus 360 degree) obtained by subtracting 360 degree from Δθ is shown. The phase for the parasitic element is phase delayed over the phase for the feed element by just this phase difference (Δθ minus 360 degree) shown in FIG. 5.

Figure 6:
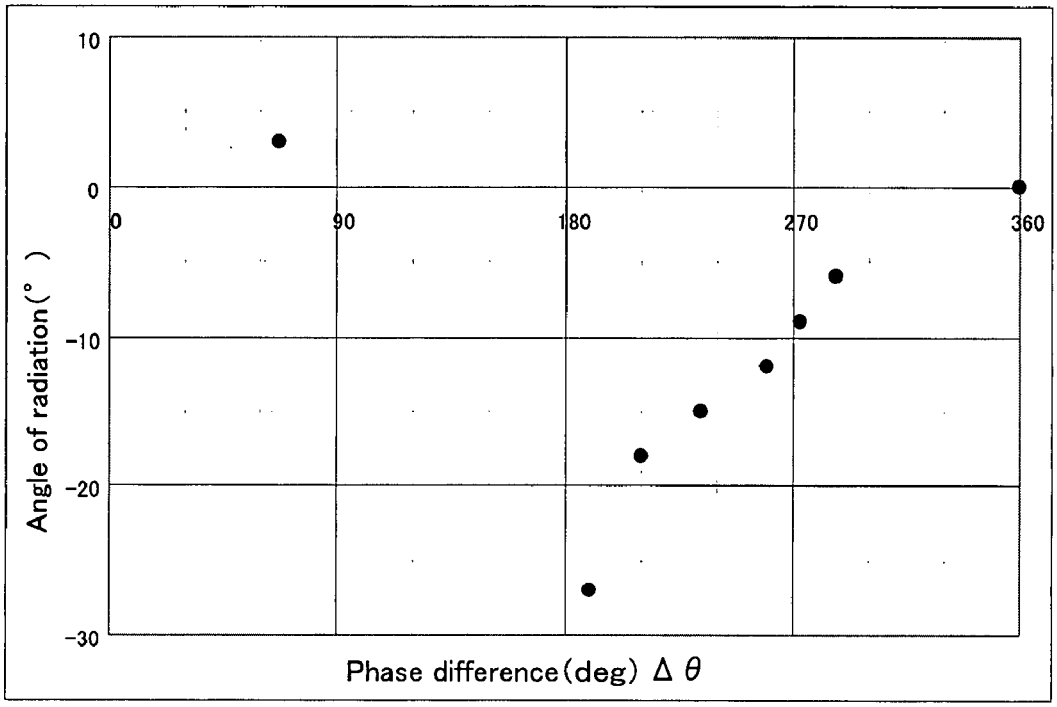
FIG. 6 is a figure showing an example of a relationship between the phase difference $\Delta\theta$ and the radiation angle of the radio beam.

FIG. 6 relates to the same concrete example of design as in the case of FIG. 5, being based upon the results of computer simulation performed by the present inventors, and is a figure showing an example of the relationship between the phase difference Δθ (the delay phase difference between the parasitic element and the feed element) and the radiation angle of the radio beam (the inclination angle from the direction perpendicular to the substrate) when the parasitic element is float (i.e. is effective). In FIG. 6, when the radiation angle is negative, that means that the radio beam is inclined towards the opposite side from that of the parasitic element, taking the feed element as a center.

As shown in FIG. 6, it will be understood that, when the phase difference Δθ (the delay phase difference of the parasitic element with respect to the feed element) increases from 180 degree to 360 degree (i.e., substantially, when the advance phase difference of the parasitic element with respect to the feed element decreases from 360 degree to 180 degree), then, almost proportionally thereto, the radiation angle changes from about 30 degree to 0 degree, within the range in which the radiation angle is negative (i.e. the radio beam is inclined towards the side opposite to the parasitic element). Furthermore, when the phase difference Δθ exceeds 360 degree (in FIG. 6, its range less than 180 degree is shown), then the radiation angle becomes positive; in other words, the radio beam becomes inclined towards the side of the parasitic element.

According to FIGS. 5 and 6, it will be understood that whether the radio beam inclines to the side of the parasitic element or inclines to the opposite side, and the size of this radiation angle, change according to interelement spacing S. For example, within the range from 0 to 2λg of interelement spacing S, the radio beam is inclined towards the side opposite to the parasitic element, while, when interelement spacing S exceeds 2λg, it inclines towards the parasitic element.

As will be understood from the above explanation, by choosing interelement spacing S between the feed element and the parasitic elements, it is possible to select the amount of change of the radiation angle of the radio beam due to switching whether the parasitic elements are grounded or float (in other words, whether the parasitic elements are made to be substantially ineffective or are made to be effective).

The amount of change of the radiation angle due to switching of the parasitic elements between effective and ineffective (in other words the radiation angle when a parasitic element is effective) is also different according to the ground point on the parasitic element (i.e. according to the position of the through hole).

Figure 7:
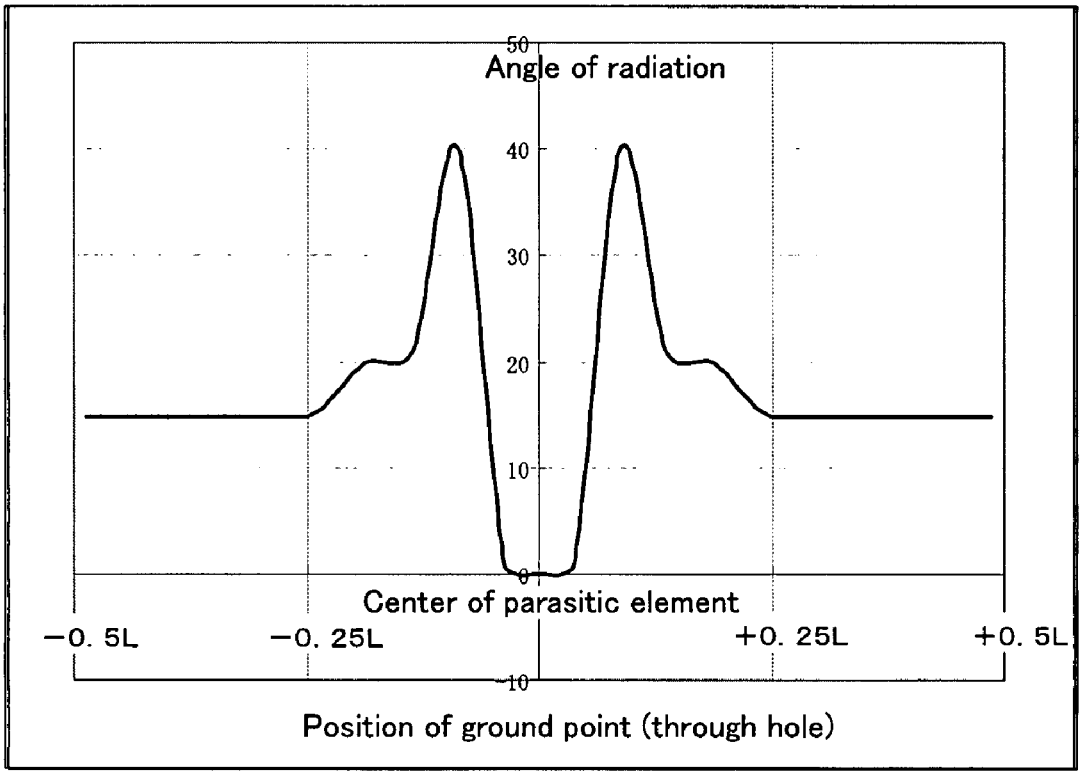
FIG. 7 is a figure showing an example of a relationship between the position in the excitating direction of the ground point of a parasitic element, and the radiation angle of the radio beam.

FIG. 7 relates to the same concrete design example as in the case of FIGS. 5 and 6, and shows an example of the relationship between the position of the ground point upon the parasitic element and the radiation angle (i.e. the inclination angle from the direction perpendicular to the substrate) when the parasitic element is effective. By the position of the ground point shown in FIG. 7 is meant its position in the excitation direction (the direction of length L shown in FIG. 1) (this position is given as a multiple of length L in the excitating direction of the parasitic element shown in FIG. 1). Any one of the positions shown in FIG. 7 is at the center of the parasitic element in the direction orthogonal to the excitating direction.

As shown in FIG. 7, when the position of the ground point is less than 0.25 L from the center of the parasitic element (within the range of L/2 shown in FIG. 1), is the case in which the radiation angle attains its maximum value. However, only by changing the position of the ground point slightly, the radiation angle changes greatly, so that it is not stable. On the other hand, when the position of the ground point is more than 0.25 L from this center (outside the range of L/2 shown in FIG. 1), then the radiation angle stabilizes at a constant value. Accordingly the design of the antenna is made simple by setting the position of the ground point within this stable range. In this connection, the example shown in FIGS. 5 and 6 and described above is one for the case in which the ground point is disposed within the above described stable range.

Figure 8:
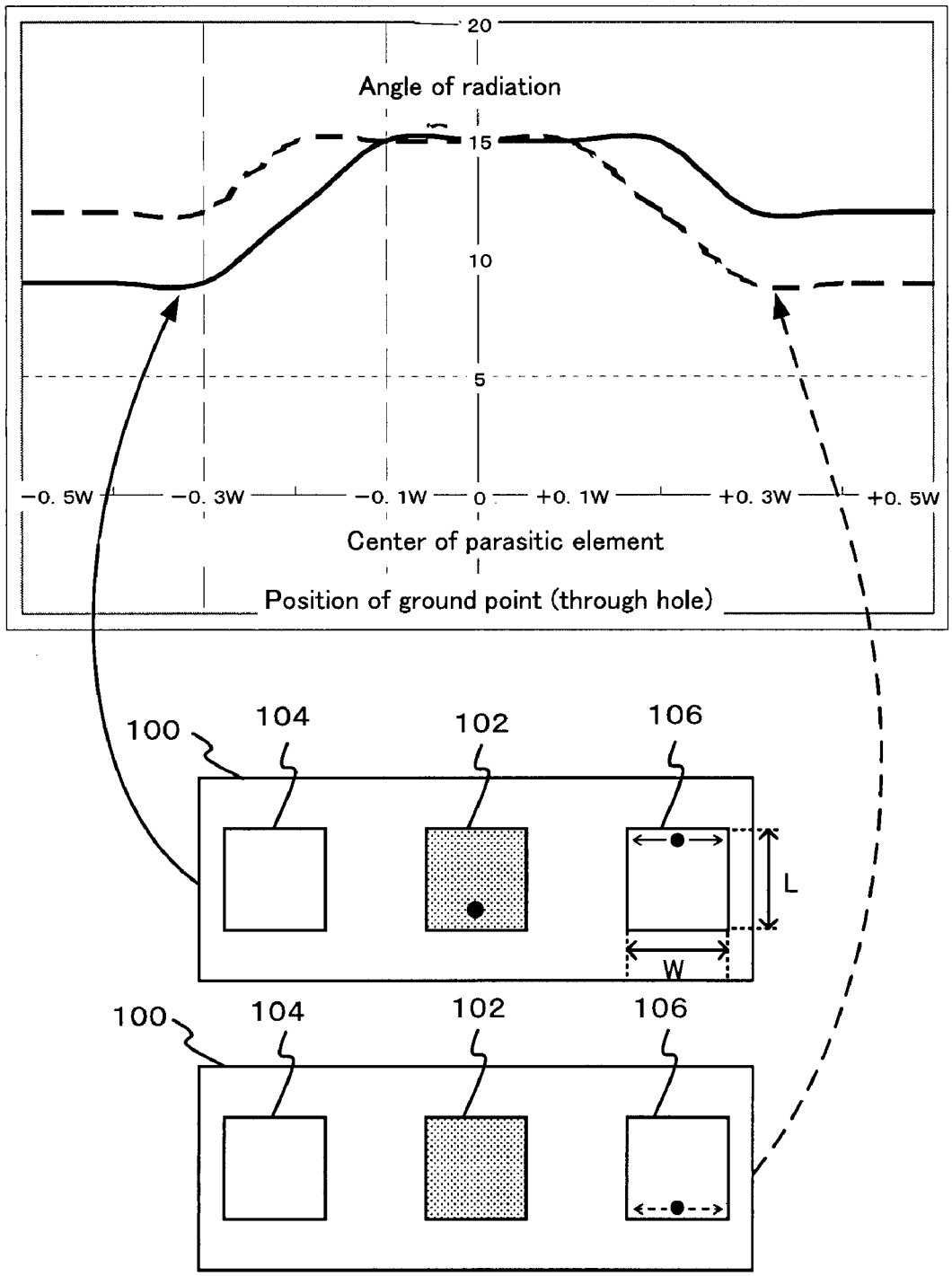
FIG. 8 is a figure, for the case when the position of the ground point is further from the center than 0.25 L, showing an example of the relationship of the radiation angle with respect to the center of the parasitic element, when the ground point is shifted in the direction perpendicular to the excitating direction.

FIG. 8 relates to the case when the position of the ground point is further from the center than 0.25 L, and shows an example of the relationship of the radiation angle with respect to the center of the parasitic element, when the ground point is shifted in the direction perpendicular to the excitating direction. As shown in FIG. 8, if the length of the parasitic element in the direction perpendicular to the excitating direction is taken as being W, then, by providing the ground point in the range of plus or minus 0.1 W, it is possible to obtain the same radiative state as when the ground point is disposed either at the upper edge (the solid line graph in the figure) or at the lower edge (the broken line graph). It should be understood that the example shown in FIG. 8 is an example in the case in which length L of the parasitic element in the excitating direction and its length W in the direction perpendicular to the excitating direction are equal (L=W).

Figure 9:
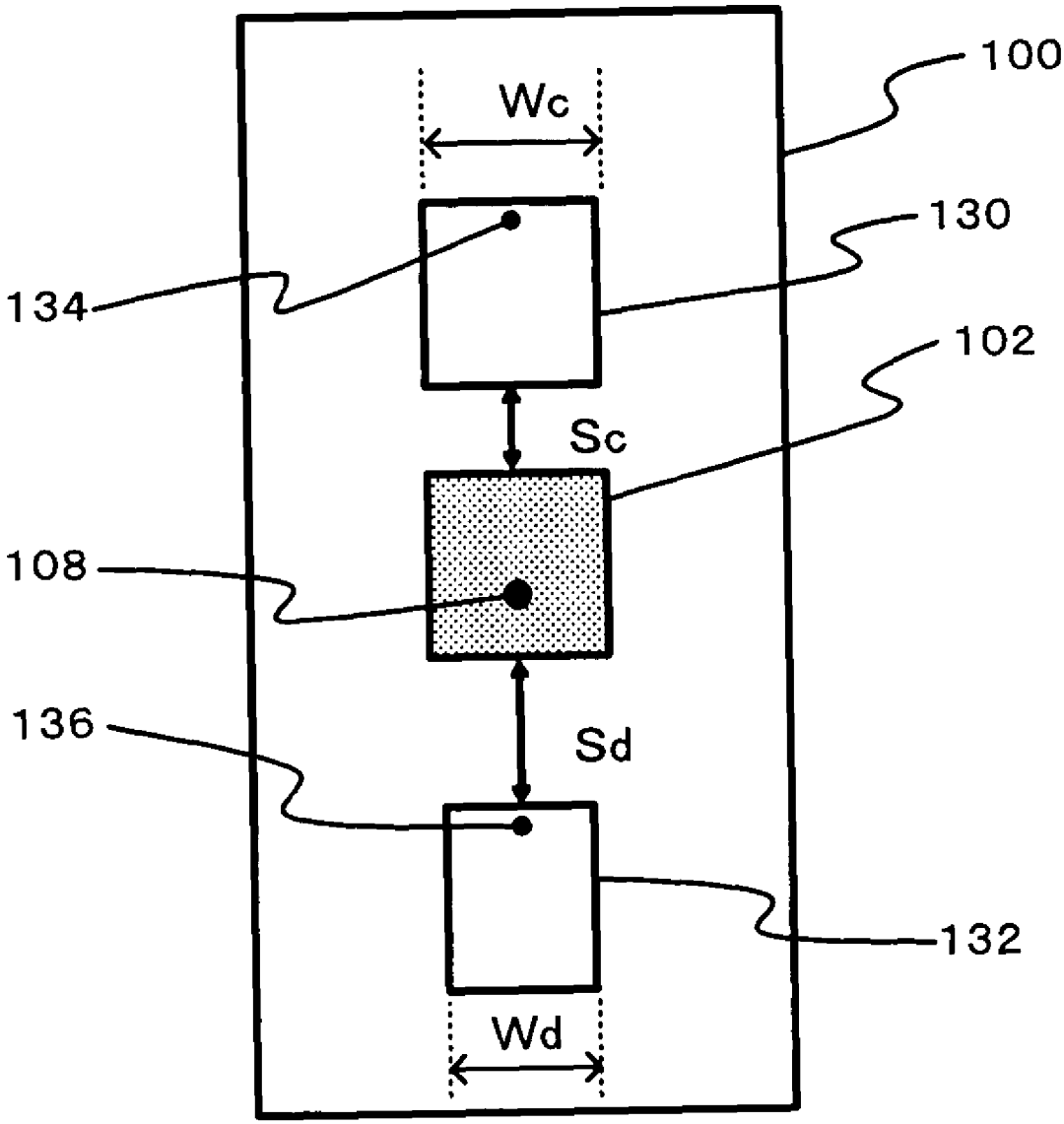
FIG. 9 is a plan view of a microstrip antenna according to a second embodiment of the present invention.

FIG. 9 is a plan view of a microstrip antenna according to a second embodiment of the present invention. In FIG. 9 and the subsequent figures, to elements which have substantially the same functions as elements of the embodiment described above, the same reference numerals are affixed; and, in the following, duplicated explanation will be omitted.

As shown in FIG. 9, parasitic elements 130 and 132 are provided respectively above and below feed element 102 in the figure. In other words, these three antenna elements 130, 102, and 132 are arranged linearly in the excitating direction of feed element 102 (the vertical direction in the figure). The ground points of these parasitic elements 130 and 132 are at positions further than 0.25 L from the centers of the parasitic elements 130 and 132 in the excitating direction, and control leads 134 and 136, which are through holes, are connected thereto. Although these matters are not shown in the figures, on the rear surface of substrate 100, there are provided a microwave signal source which feeds electric power to feed element 102, and switches which switch whether each of these parasitic elements 130 and 132 is grounded or float.

The feed point of feed element 102 (feed line 108) is at a position which is biased towards the lower edge of feed element 102. Among two parasitic elements 130 and 132, the dimensions of parasitic element 130 which is more remote from this feed point (in other words the upper one) (in particular, width Wc in the direction orthogonal to the excitating direction) are larger than the dimensions of parasitic element 132 which is closer to the feed point (in other words the lower one) (in particular, width Wd in the direction orthogonal to the excitating direction). Furthermore, the interelement spacing Sc with respect to feed element 102 of the former is shorter than interelement spacing Sd of the latter. Element widths Wc and Wd are adjusted so that the electrical current amplitudes of parasitic elements 130 and 132 become the same. And interelement spacings Sc and Sd are adjusted so that the electrical current phases of parasitic elements 130 and 132 become the same. By adjusting like this, the actions exerted on the radio beam by parasitic elements 130 and 132 are balanced. It should be understood that, if interelement spacings Sc and Sd are set to be greater than about 1.5 times the lengths of the elements, then, even if interelement spacings Sc and Sd are the same with the sizes of parasitic elements 130 and 132 being the same, it is possible to obtain a balance between parasitic elements 130 and 132 (however, the width of change of the radiating direction of the radio beam becomes less than, for example, about 10 degree).

By selecting which of upper and lower parasitic elements 130 and 132 is float (i.e. is made effective) and which is grounded (i.e. is made ineffective) by switch actuation, according to the same theory as in the case of the embodiment shown in FIG. 1, it is possible to change over the radiating direction of the radio beam from this microstrip antenna in the direction perpendicular to substrate 100 to a direction inclined by a predetermined angle upwards, and to a direction inclined by a predetermined angle downwards.

Figure 10:
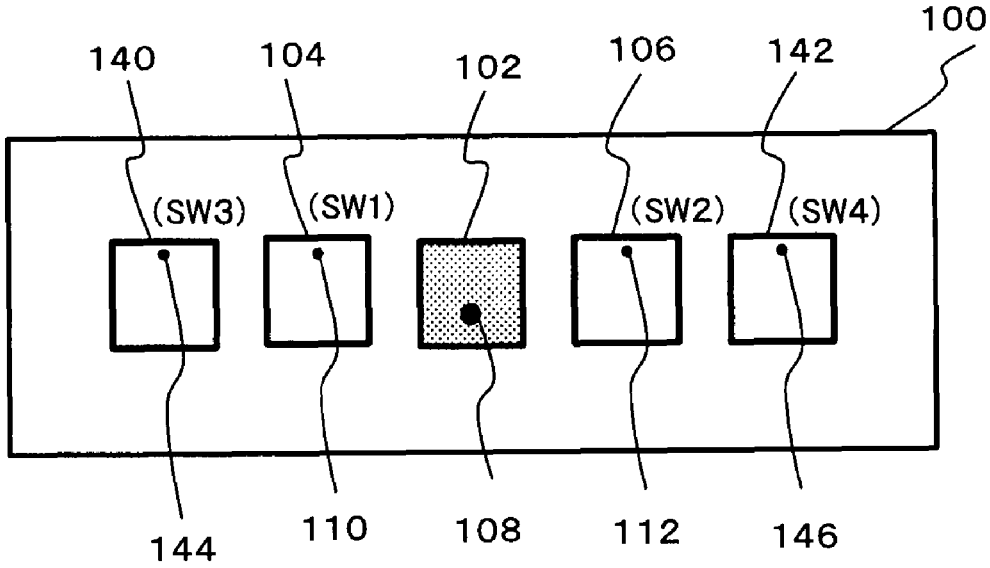
FIG. 10 is a plan view of a microstrip antenna according to a third embodiment of the present invention.

FIG. 10 is a plan view of a microstrip antenna according to a third embodiment of the present invention.

With the microstrip antenna shown in FIG. 10, in addition to the same structure shown in FIG. 1, outside thereof, there are also appended parasitic elements 140 and 142 on its right and left ends. Respective control leads 144 and 146, which are through holes, are connected to outside parasitic elements 140 and 142 as well. And, by actuation of switches not shown in the figures upon the rear surface of the substrate, it is arranged to switch whether each of these outside parasitic elements 140 and 142 is float, or is grounded. In the figure, reference symbols SW1, SW2, SW3, and SW4 which indicate in the vicinity of the parasitic elements are the name of switches for switching each of the parasitic elements between effective and ineffective (refer to the next FIG. 11).

Figure 11:
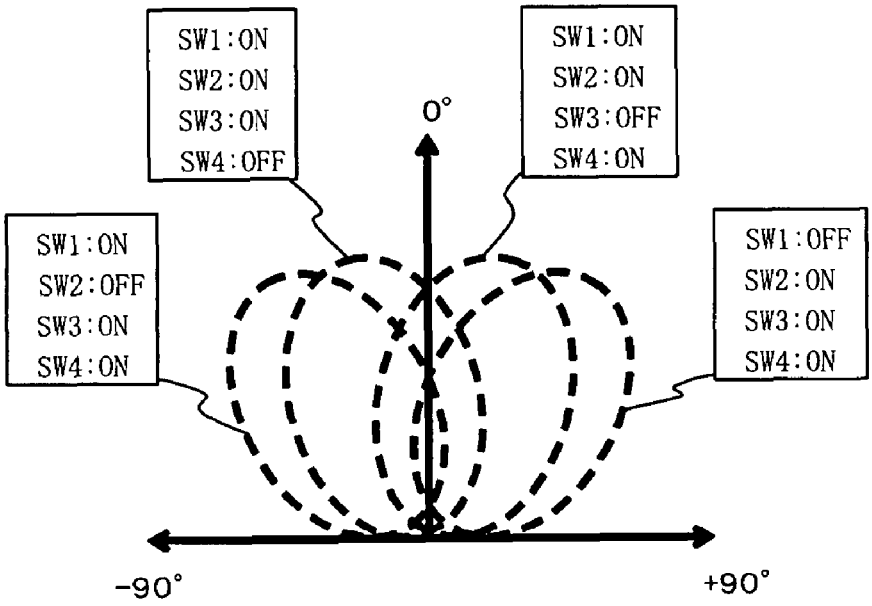
FIG. 11 is a figure for the microstrip antenna shown in FIG. 10, showing a situation when the radiation angle of the radio beam changes according to the actuation of a switch.

FIG. 11 is for the microstrip antenna shown in FIG. 10, and shows the situation in which the radiation angle of the radio beam is changed according to the actuation of the switches.

As shown in FIG. 11, by switching each of parasitic elements 104 and 106 on the inside (in other words, the ones which are closer to feed element 102) between being effective and being ineffective, it is possible to change over the radiation angle of the radio beam between the right side and the left side over a large change width. Furthermore, by switching each of parasitic elements 140 and 142 on the outside (in other words, the ones which are further from feed element 102) between being effective and being ineffective, it is possible to change over the radiation angle of the radio beam between the right side and the left side over a small change width.

Since, in this manner, with the microstrip antenna shown in FIG. 10, the plurality of parasitic elements are arrayed linearly on both the right side and the left side of the feed element, accordingly it is possible to change the radiating direction of the radio beam, on both the right side and the left side of the direction perpendicular to the substrate, finely in a plurality of stages.

Figure 12:
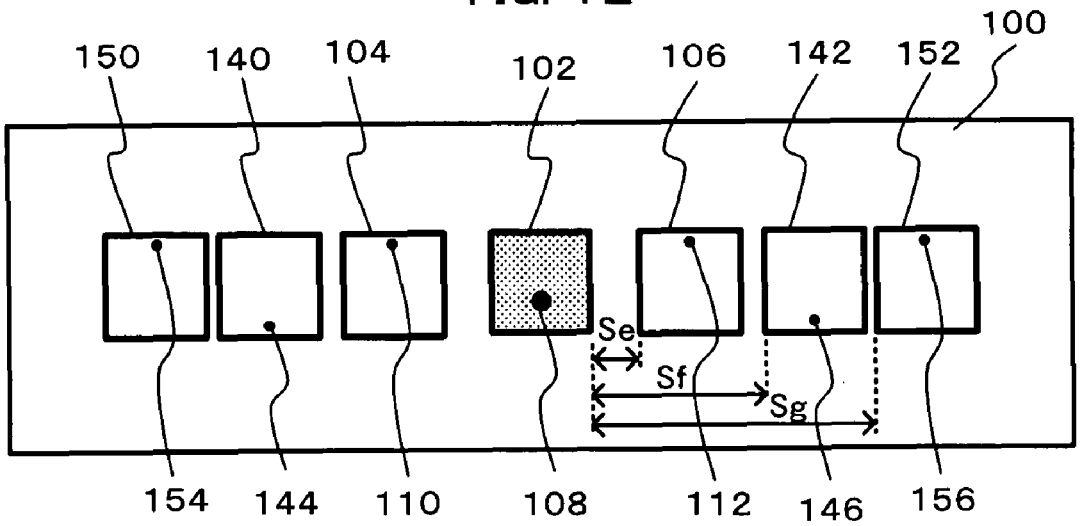
FIG. 12 is a plan view of a variant embodiment of the third embodiment.

FIG. 12 is a plan view showing a variant embodiment of the third embodiment described above.

With the microstrip antenna shown in FIG. 12, in addition to the structure shown in FIG. 10, there are also added parasitic elements 150 and 152 on the outside thereof. In other words, on both the right side and the left side of feed element 102, three parasitic elements are arranged linearly. With regard to switches for switching each of these six parasitic elements 104, 106, 140, 142, 150, and 152 between being effective and being ineffective, these are the same as for the parasitic elements of the embodiments already explained. The positions of through holes 108, 110, 112, 144, 146, 154, and 156 are arranged in zigzag, in order to make it simple to arranged the microwave signal source and the switches on the rear surface of the substrate.

The interelement spacings Se, Sf and Sg between right side parasitic elements 106, 142 and 153 and feed element 102 are adjusted so that the changing widths of the radiation direction of the radio beam which changes by switching each of these parasitic elements 106, 142 and 153 between being effective and being ineffective become desired values (for example 30 degree, 20 degree, and 10 degree) respectively. The same is the case for parasitic elements 104, 140 and 150 on the left side. According to this variant embodiment, the resolution for the radiation direction of the radio beam becomes still finer than in the case of FIG. 10.

Figure 13:
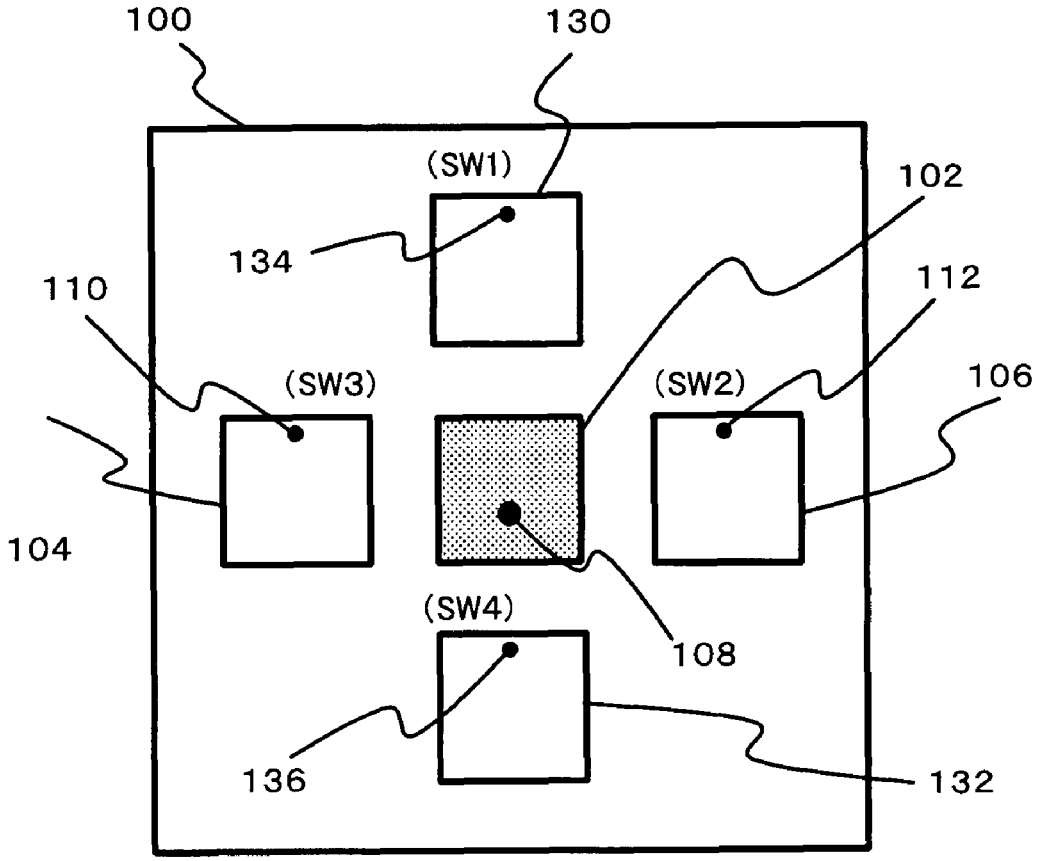
FIG. 13 is a plan view of a microstrip antenna according to a fourth embodiment of the present invention.

FIG. 13 is a plan view of a microstrip antenna according to a fourth embodiment of the present invention.

With this microstrip antenna of FIG. 13, in the same manner as in the case of the structure shown in FIG. 1, along with parasitic elements 104 and 106 being disposed to the right and left of feed element 102 (in other words, on both the sides of feed element 102 in the direction orthogonal to the excitating direction of feed element 102), in the same manner as in the case of the structure shown in FIG. 9, parasitic elements 130 and 132 are also disposed above and below feed element 102 (in other words, on both sides of feed element 102 in the direction along the excitating direction of feed element 102). With regard to a switch structure for switching parasitic elements 104, 106, 130, and 132 between being effective and being ineffective, these are the same as in the case of the embodiments previously described. Reference symbols SW1, SW2, SW3, and SW4 which indicate in the vicinity of the parasitic elements in the figure are name of switches for switching each of the parasitic elements between being effective and being ineffective (refer to the next FIG. 14).

Figure 14:
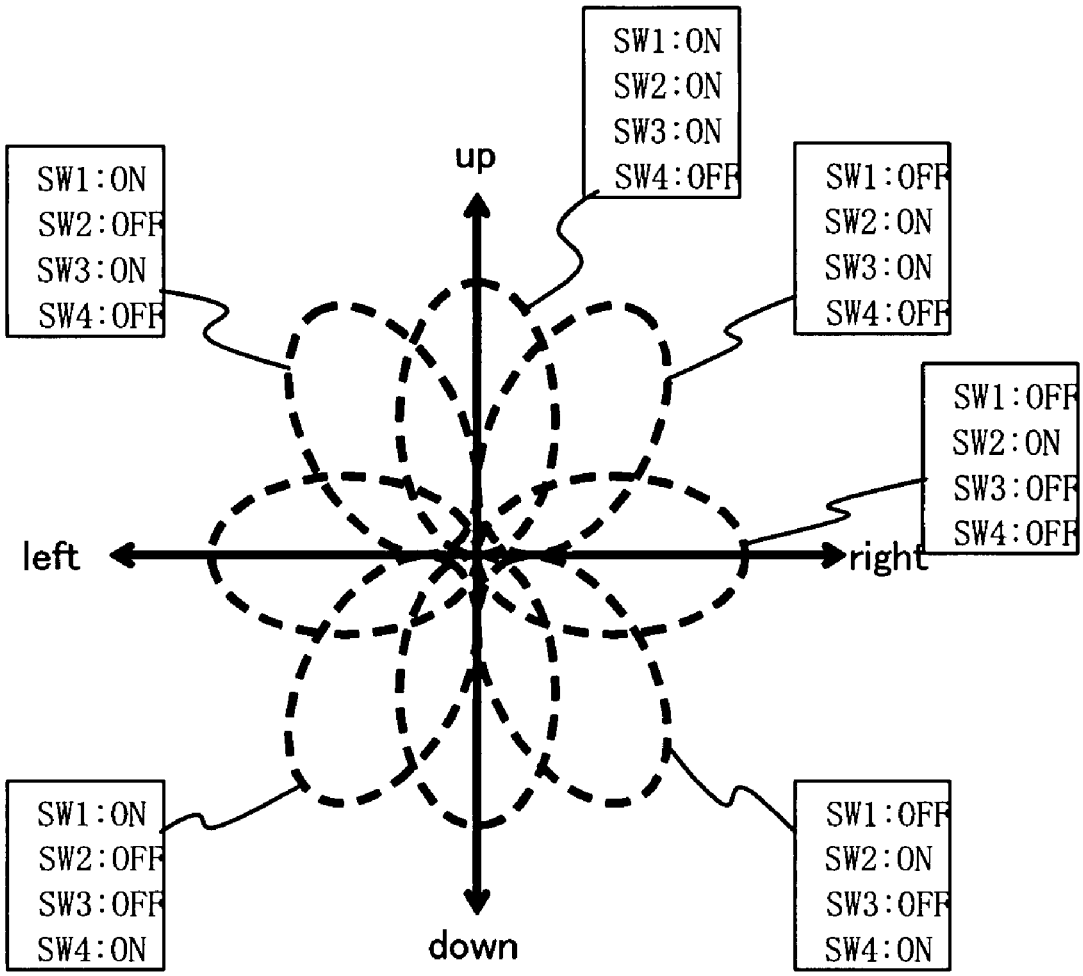
FIG. 14 is a figure for the microstrip antenna shown in FIG. 13, showing a situation when the radiation angle of the radio beam changes according to the actuation of switches.

FIG. 14 shows, for the microstrip antenna shown in FIG. 13, the situation when the radiation angle of the radio beam changes due to the actuation of the switches. In FIG. 14, the vertical axis represents the inclination in the vertical direction, while the horizontal axis represents the inclination in the horizontal direction.

As shown in FIG. 14, by selectively making only one of the upper, lower, left, and right parasitic elements 104, 106, 130, and 132 be effective, it is possible to incline the radiating direction of the radio beam upwards, downwards, to the left, and to the right. Furthermore, since the parasitic elements 104, 106, 130, and 132 are excited in the same excitating direction by feed element 102, accordingly, by selecting and making effective one among right and left parasitic elements 104 and 106 and one of the upper and lower parasitic elements 130 and 132, it is possible to incline the radiating direction of the radio beam in a direction of around 45 degree as seen in plan view. By selecting parasitic elements 104, 106, 130, and 132 which are made effective in this manner, it is possible to vary the radiating direction of the radio beam in intervals of around 45 degree. Furthermore, by adjusting the shapes and the positions of parasitic elements 104 and 106 and of parasitic elements 130 and 132, it is possible to incline the radiating direction of the radio beam to directions of 1 degree to 89 degree as seen in plan view.

Figure 15:
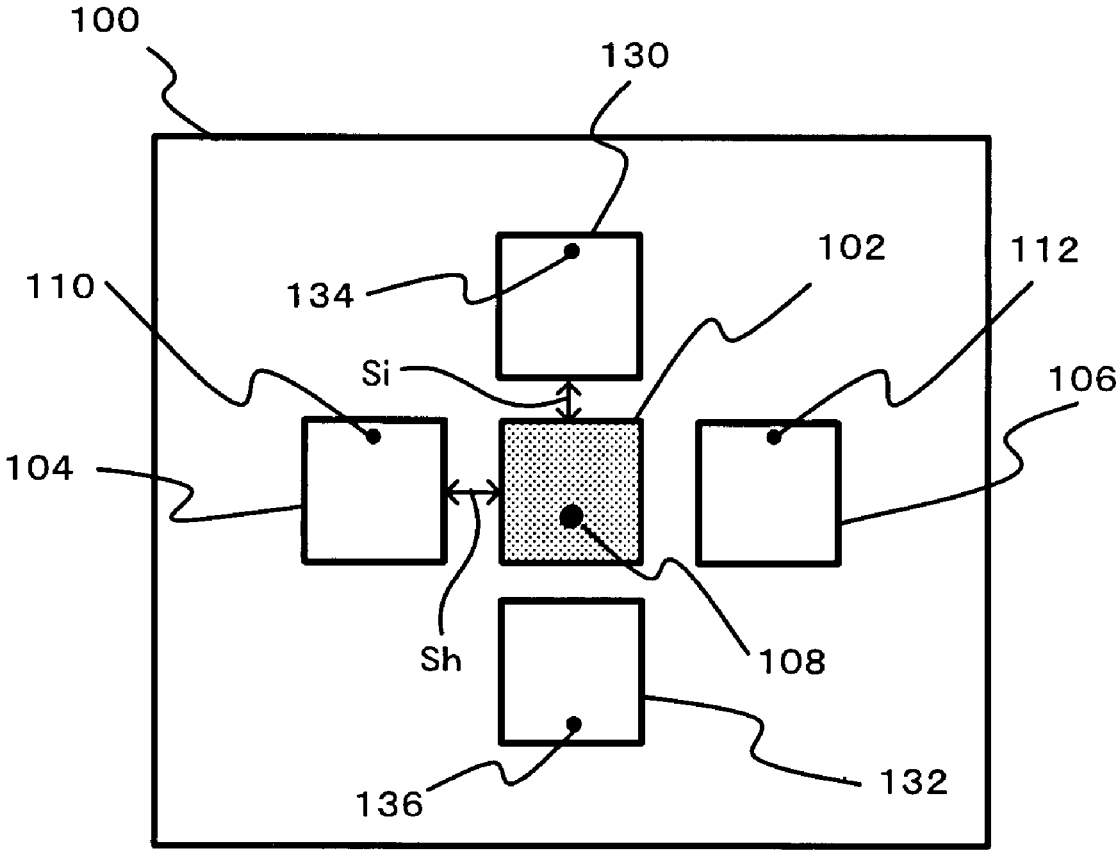
FIG. 15 is a plan view of a variant embodiment of the fourth embodiment.

FIG. 15 shows a variant embodiment of the fourth embodiment shown in FIG. 13.

With the microstrip antenna shown in FIG. 15, interelement spacing Sh between right and left parasitic elements 104 and 106 and feed element 102, and interelement spacing Si between upper and lower parasitic elements 130 and 132 and feed element 102, are different. By adjusting the right and left interelement spacing Sh and the up and down interelement spacing Si in this manner, it is possible to adjust the phase difference of right and left parasitic elements 104 and 106 with respect to feed element 102, and that of the upper and lower parasitic elements 130 and 132; and, thereby, it is possible to incline the radiating direction of the radio beam in any desired inclination direction as seen in plan view. It should be understood that, with the microstrip antenna of FIG. 13, ground point 136 of lower side parasitic element 132 is disposed in the vicinity of the extreme edge of the upper side of parasitic element 132 (the side which is close to feed element 102), while, with the microstrip antenna of FIG. 15, ground point 136 of lower side parasitic element 132 is disposed in the vicinity of the extreme edge of the lower side of parasitic element 132 (the side which is remote from feed element 102). This is because to enable to establish a sufficient distance between the high-frequency oscillator (the power supply circuit) which is disposed upon the rear side of feed line 108 of feed element 102, and the switch which is disposed upon the rear side of ground point 136 of the lower side parasitic element 132, thereby arranging the oscillator and the switch without any mutual interference. However, if the oscillator and the switch are correctly arranged, it would also be acceptable to dispose ground point 136 of the lower side parasitic element 132 in the vicinity of the upper side extreme edge, with the microstrip antenna of FIG. 15 as well, in the same way as with the microstrip antenna of FIG. 13.

The inventors have investigated the characteristics of the microstrip antenna shown in FIG. 15 by experiment. As a result, it has been understood that, in order to incline the radiating direction of the radio beam at the resonant frequency, interelement spacings Si and Sh must both be less than or equal to $\lambda/2$. Here, $\lambda$ is the wavelength of the radio waves at the resonant frequency in the air. Due to the results of the computer simulation which has already been explained with reference to FIG. 5, it is predicted that the radiating direction of the radio beam will be inclined, even if interelement spacings Si and Sh are made to be greater than $\lambda/2$. However, according to these experiments, it has been understood that, when interelement spacings Si and Sh are greater than $\lambda/2$, the radio beam almost does not incline at the resonant frequency, while it does incline at frequencies higher than the resonant frequency.

Furthermore, according to these experiments, it has been understood that, in order to be able to increase the inclination angle of the radiation direction of the radio beam at the resonant frequency, the up and down interelement spacing Si (in the direction along the excitating direction) is desirably within a range of about $\lambda/4$ to about $\lambda/30$, and particularly, within this range, more desirable within a range of about $\lambda/9$ to about $\lambda/30$; and, furthermore, the right and left interelement spacing Sh (in the direction orthogonal to the excitating direction) is desirably within a range of about $\lambda/4$ to about $\lambda/9$, and particularly, within this range, desirable within a range of about $\lambda/5$ to about $\lambda/9$. For example, in the case of a microstrip antenna having the structure shown in FIG. 15, with the dimension of each of feed element 102 and parasitic elements 104, 106, 130, and 132 being 7.5 mm×7.5 mm, and with the resonant frequency being 10.52 GHz, it is desirable for the up and down interelement spacing Si to be 7.1 mm ($=\lambda/4$) to 0.95 mm ($=\lambda/30$), and it is more desirable for it to be 3.17 mm ($=\lambda/9$) to 0.95 mm ($=\lambda/30$); and, furthermore, it is desirable for the right and left interelement spacing Sh to be 7.1 mm ($=\lambda/4$) to 3.17 mm ($=\lambda/9$), and it is more desirable for it to be 5.71 mm ($=\lambda/5$) to 3.17 mm ($=\lambda/9$). These desirable ranges do not much depend on the permittivity of substrate 100.

Figure 16:
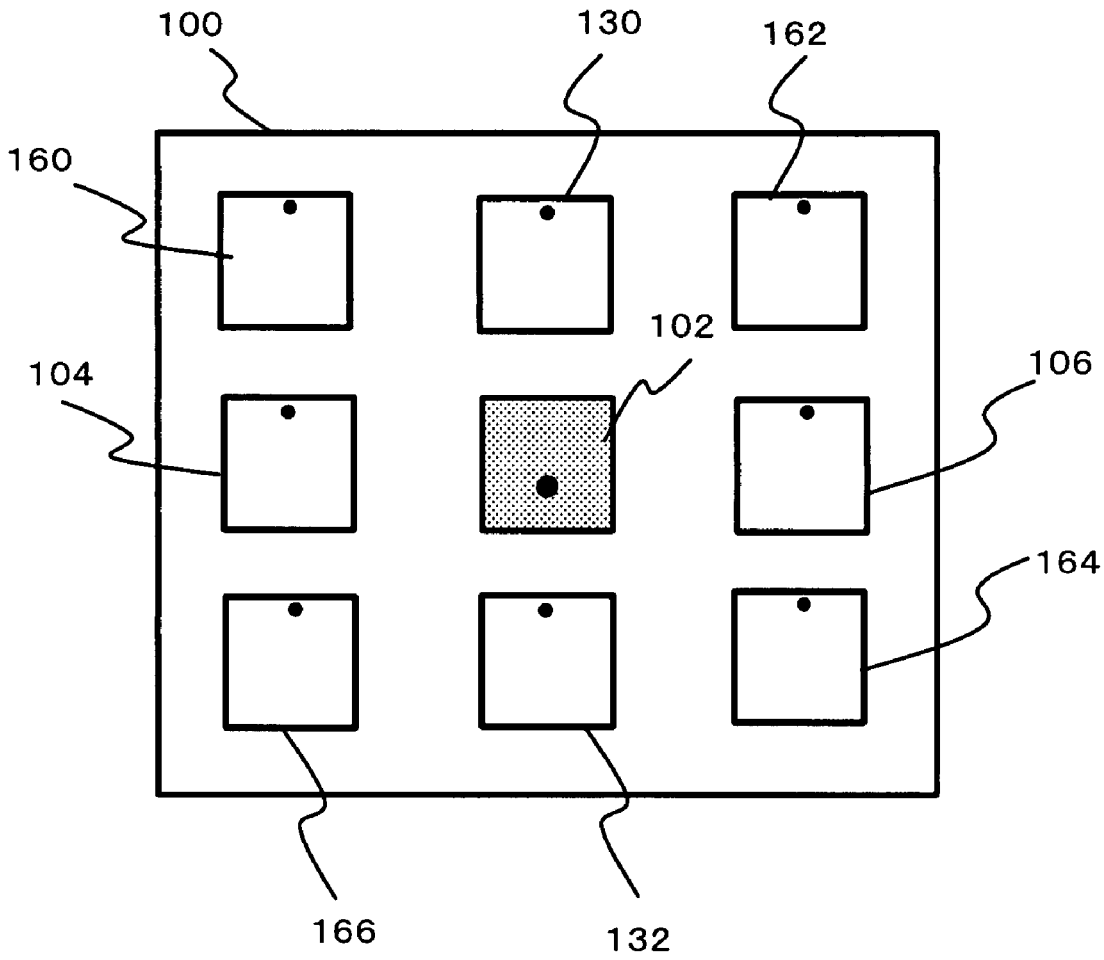
FIG. 16 is a plan view showing another variant embodiment of the fourth embodiment.

FIG. 16 shows another variant embodiment of the fourth embodiment shown in FIG. 13.

With this microstrip antenna shown in FIG. 16, in addition to the structure of FIG. 13, furthermore, parasitic elements 160, 162, 164, and 166 are also disposed to be directed diagonally at 45 degree from feed element 102. Due to this, the resolution of the radiating direction of the radio beam as seen in plan view becomes still finer than in the case of the fourth embodiment shown in FIG. 13. Moreover, it is also possible to enhance the gain.

Figure 17:
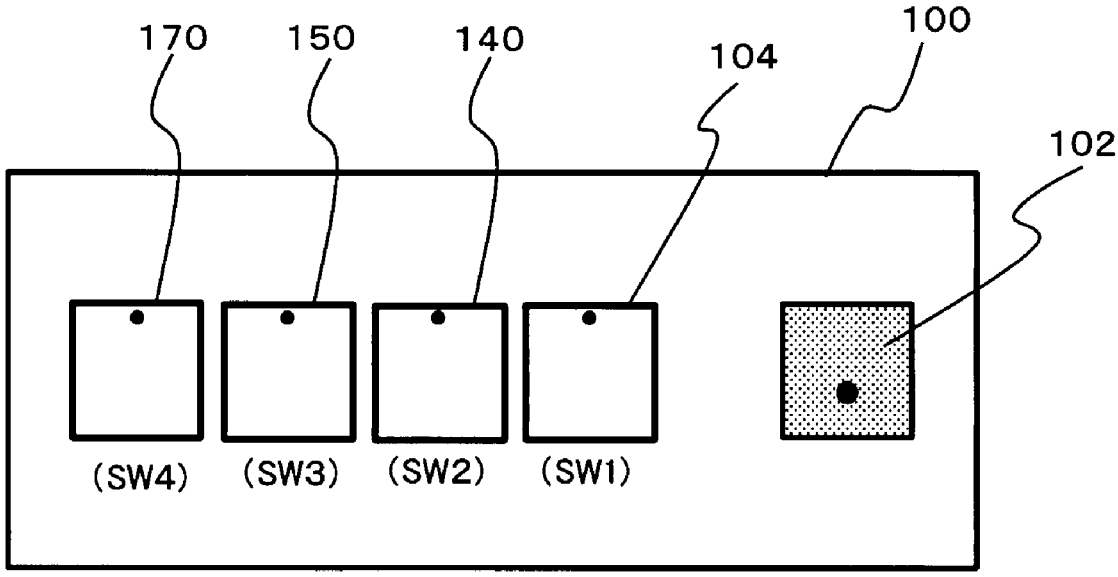
FIG. 17 is a plan view of a microstrip antenna according to a fifth embodiment of the present invention.

FIG. 17 is a plan view of a microstrip antenna according to a fifth embodiment of the present invention.

With the microstrip antenna shown in FIG. 17, a plurality of parasitic elements 104, 140, 150, and 170 are arranged linearly on one side of feed element 102 (for example, in the figure, on its left side). The structures for switching these parasitic elements 104, 140, 150, and 170 between being effective and being ineffective are the same as in the other embodiments. Reference symbols SW1, SW2, SW3, and SW4 in the figure which denote in the vicinity of the parasitic elements are names of switches for switching these parasitic elements between being effective and being ineffective (refer to the next FIG. 18). At least one of parasitic elements 104, 140, 150, and 170, for example parasitic element 170 which is disposed at the end thereof, is arranged so that the delay phase difference $\Delta\theta$ with respect to feed element 102 (refer to FIGS. 5 and 6) becomes equal to or greater than 360 degree (substantially, within the range from 0 degree to 180 degree) (in other words, based upon FIGS. 5 and 6, the interelement spacing is arranged at a position equal to or greater than $2\lambda g$). The other inside parasitic elements 104, 140, and 150 are arranged so that the delay phase difference $\Delta\theta$ with respect to feed element 102 (refer to FIGS. 5 and 6) becomes within the range of 180 degree to 360 degree (substantially, the advance phase difference is within the range from 0 degree to 180 degree) (in other words, based upon FIGS. 5 and 6, the interelement spacing is arranged at a position less than $2\lambda g$).

Figure 18:
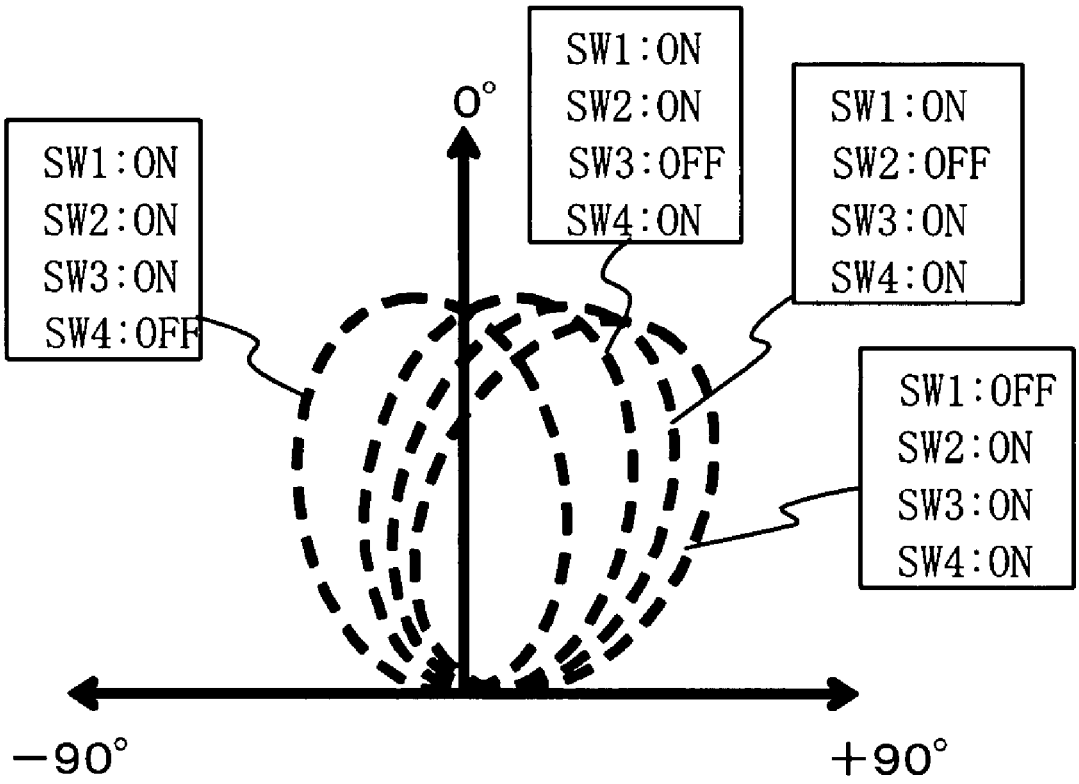
FIG. 18 is a figure showing, for the microstrip antenna shown in FIG. 17, a state of change of the radiation angle of the radio beam according to the switching of the parasitic elements between being effective and being ineffective.

FIG. 18 shows, for the microstrip antenna shown in FIG. 17, the state of change of the radiation angle of the radio beam according to the switching of the parasitic elements between being effective and being ineffective.

As shown in FIG. 18, when only parasitic element 170 at the extreme end of parasitic elements 104, 140, 150, and 170 is made to be effective, then the radio beam is inclined towards parasitic element 170. On the other hand, when parasitic element 170 at the extreme end is made to be ineffective, and any one of other parasitic elements 104, 140, and 150 is made to be effective, then the radio beam is inclined towards the opposite side. In this case, the magnitude of the radiation angle of may be varied by selecting one of parasitic elements 104, 140, and 1510 is made to be effective.

In this manner, even if the plurality of parasitic elements are arrayed on only one side of the feed element, it is possible to incline the radio beam to both sides of the direction perpendicular to the substrate by choosing the arrangement of the parasitic elements so that the phase difference for some parasitic element is delayed with respect to the feed element, and so that the phase difference for some other parasitic element is advanced with respect to the feed element.

Figure 19A:
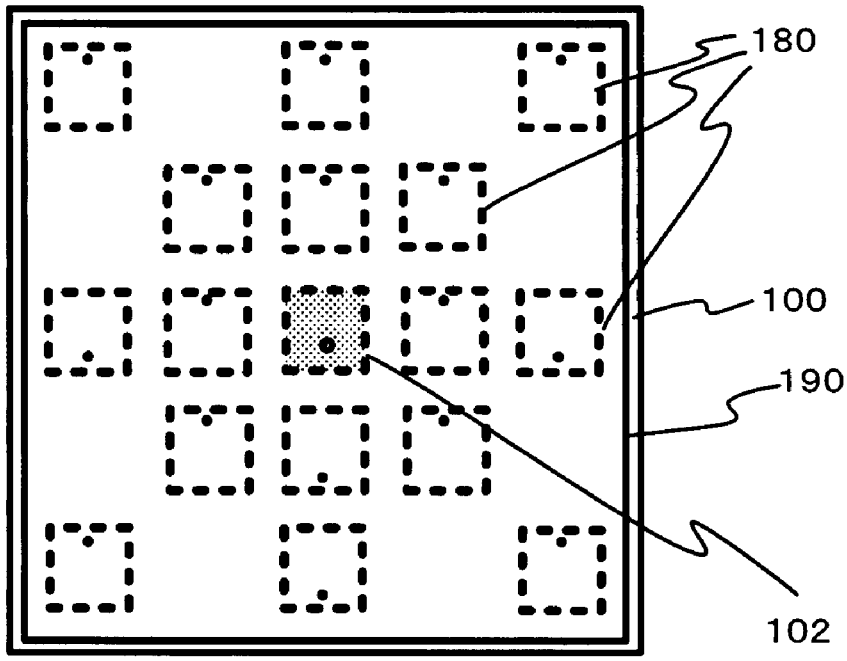
FIG. 19 is a plan view and a sectional view of a microstrip antenna according to a sixth embodiment of the present invention.
Figure 19B:
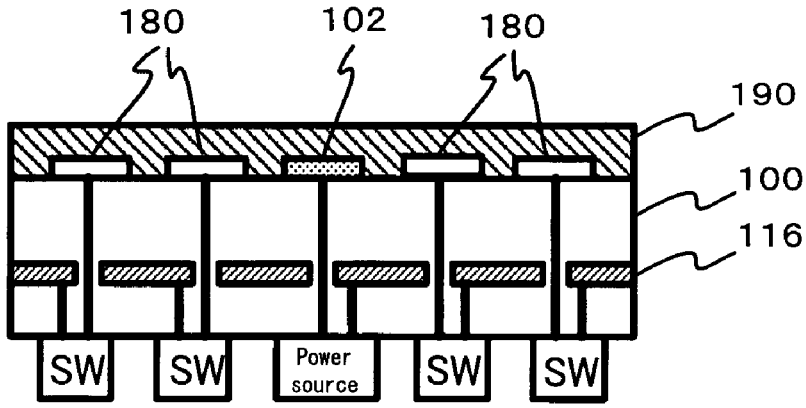

FIG. 19A is a plan view of a microstrip antenna according to a sixth embodiment of the present invention, and FIG. 19B is a sectional view of the same microstrip antenna.

With the microstrip antenna shown in FIGS. 19A and 19B, a feed element and a plurality of parasitic elements 180, 180, . . . are arranged upon substrate 100, and almost the entire surface region of substrate 100 including feed element 102 and parasitic elements 180, 180, . . . is covered with dielectric layer 190. With regard to the structures such as microwave switches or the like for switching parasitic elements 180, 180, . . . between being effective and being ineffective, these are the same as in the other embodiments described above.

By the operation of dielectric layer 190 which covers over the front surface of this microstrip antenna, the wavelength λg of the microwaves upon substrate 100 becomes shorter than in the case that no such dielectric layer 190 is provided (i.e. when the front surface of the antenna is in contact with the air). As a result, it may be anticipated that the antenna element may be made more compact and the interelement spacings may be shrunk down, and so that the antenna itself may be made more compact. This is particularly advantageous when it is desired to increase the number of the parasitic elements, in order to enhance the resolution of changing the radiating direction of the radio beam.

In order to realize the beneficial aspect described above, it is desirable for the permittivity of dielectric layer 190 to be as high as possible, for example around 100 to 200, and it is desirable for it to be made from a type of dielectric material which can actually be used in practice. Furthermore, it is desirable for the thickness of dielectric layer 190 to be, for example, around 0.1 to 0.2 mm, in order to ensure the beneficial aspect described above and not to decrease in the power of the radio beam excessively.

Figure 20:
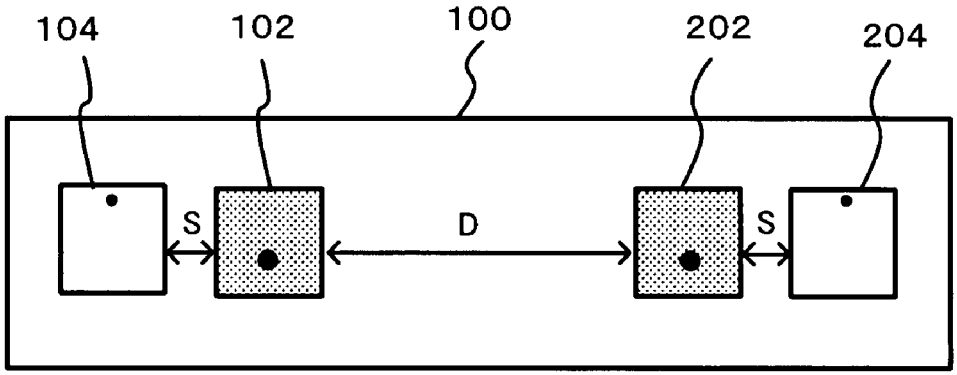
FIG. 20 is a plan view of a microstrip antenna according to a seventh embodiment of the present invention.

FIG. 20 is a plan view of a microstrip antenna according to a seventh embodiment of the present invention.

With this microstrip antenna shown in FIG. 20, a plurality of feed elements 102, 202 are provided upon the same substrate 100. And parasitic elements 104, 202 are disposed in positions which are separated from feed elements 102, 202 by just predetermined interelement spacing S. Feed elements 102 and 202 are separated by distance D such that they do not mutually interfere. Non-interference distance D may be, for example, equal to or greater than 3 times the dimensions of the feed elements.

By combining the radio beam which is emitted from the set of first feed element 102 and parasitic element 104 with the radio beam which is emitted from the set of second feed element 202 and parasitic element 204, the total radio beam is more sharply throttled than in the case where only one set of a feed element and a parasitic element is provided. In other words, the directivity (the maximum radiation intensity (W/Sr) in the specified direction with respect to the total power (W) outputted from the antenna) and the gain of the radio beam are enhanced. Although, in the example of FIG. 20, the number of sets of a feed element and a parasitic element is two, and by further increasing this number, it would also be possible to enhance the directivity and the gain all the more.

Figure 21A:
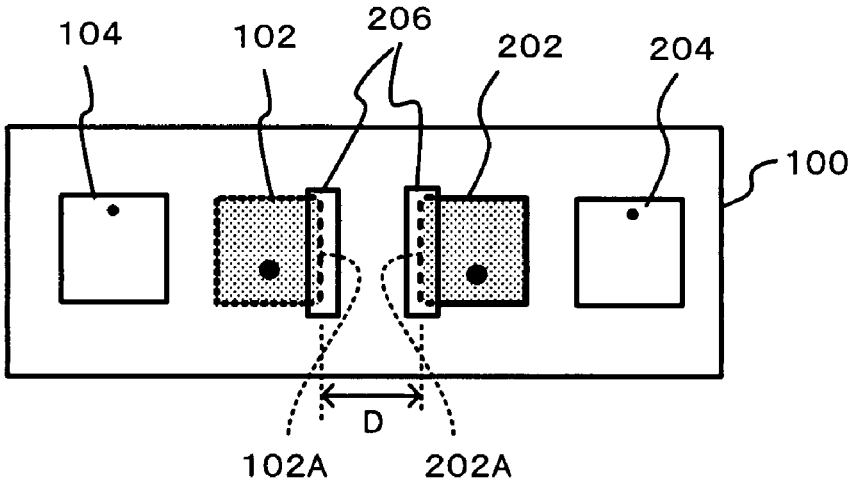
FIG. 21 is a plan view and a sectional view of a variant embodiment of the seventh embodiment.

FIG. 21A shows a plan view of a variant embodiment of the seventh embodiment shown in FIG. 20. And FIG. 21B shows a sectional view of the same variant embodiment.

Figure 21B:
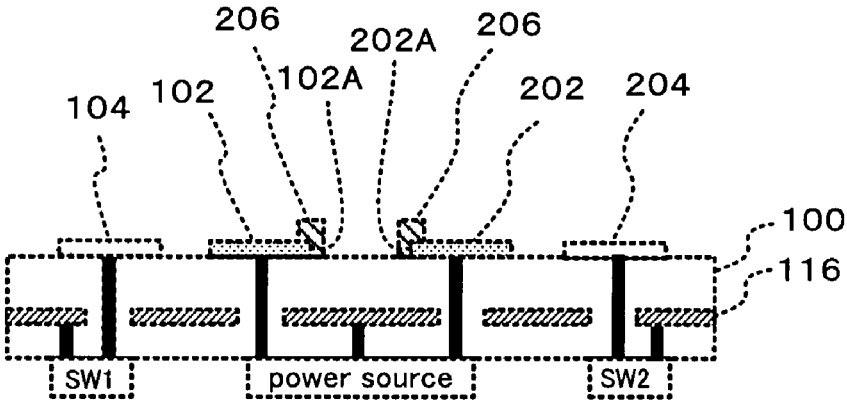

With this microstrip antenna shown in FIGS. 21A and 21B, the mutually opposing end surfaces 102A and 202A of the adjacent feed elements 102 and 202 are covered with dielectric masks 206. Since the wavelength λg of the radio waves emitted from end surfaces 102A and 202A is shortened by the operation of dielectric masks 206, accordingly it is possible that non-interference distance D for ensuring not to interfere feed elements 102 and 202 mutually is shortened to a greater extent than in the case of FIG. 20. As a result, it is possible to anticipate making the antenna more compact as a whole, and along therewith, it is possible to anticipate enhancement of the directivity and the gain, since it is possible to narrow down the total radio beam to a further extent.

Figure 22A:
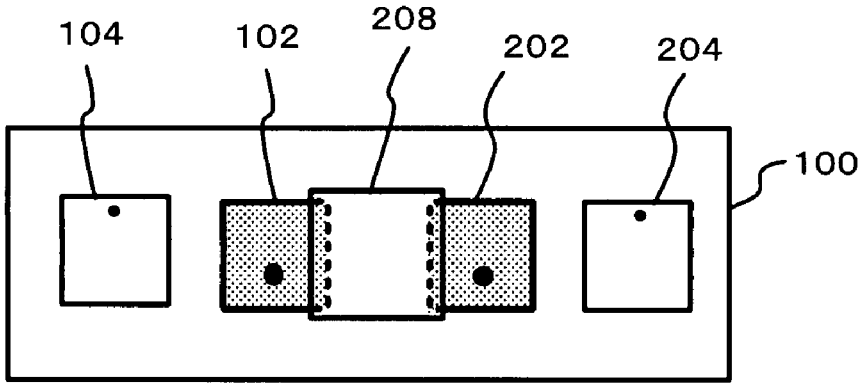
FIG. 22 is a plan view and a sectional view of another variant embodiment of the seventh embodiment.
Figure 22B:
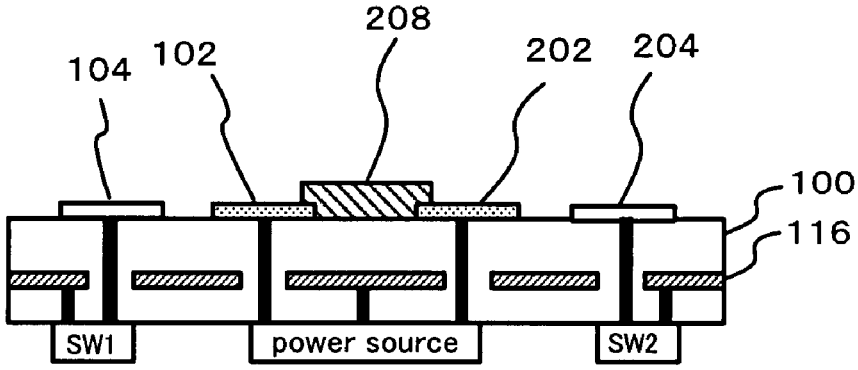

FIGS. 22A and 22B respectively show a plan view and a sectional view of another variant embodiment of the seventh embodiment shown in FIG. 20.

With the microstrip antenna shown in FIGS. 22A and 22B, the mutually opposing end surfaces 102A and 202A of the adjacent feed elements 102 and 202 are covered over with single continuous dielectric mask 208. The same beneficial operational effect is obtained as with the microstrip antenna shown in FIG. 21.

Figure 23A:
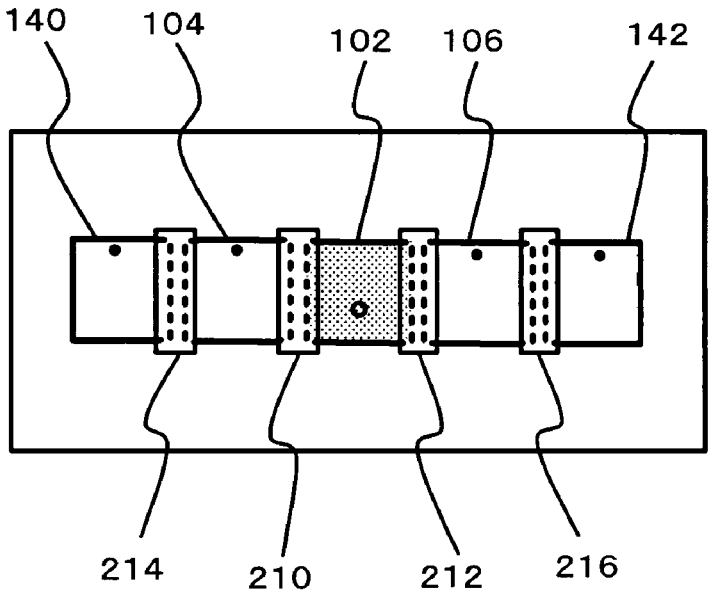
FIG. 23 is a plan view and a sectional view of yet another variant embodiment of the seventh embodiment.
Figure 23B:
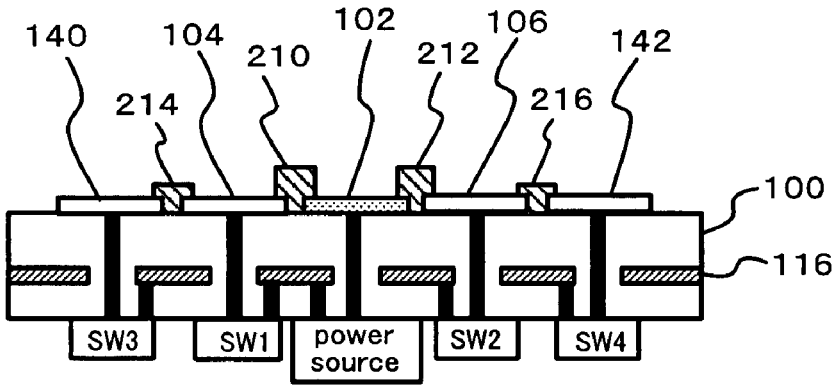

FIGS. 23A and 23B respectively show a plan view and a sectional view of yet another variant embodiment of the seventh embodiment shown in FIG. 20.

With this microstrip antenna shown in FIGS. 23A and 23B, the mutually opposing end surfaces of feed element 102 and feed elements 104 and 106 adjacent thereto on both sides thereof are covered with dielectric masks 210 and 212. Furthermore, the mutually opposing end surfaces of inside parasitic elements 104 and 106 and parasitic elements 130 and 132 outside thereof are also covered with dielectric masks 214 and 216. In this manner, the mutually opposing end surfaces of all of the mutually adjacent antenna elements are covered with dielectric masks. Since, due to this, the wavelength λg of the radio waves which are emitted from those end surfaces are shortened, accordingly it is possible to shorten the interelement spacing for obtaining the desired phase difference. As a result, it may be anticipated that the antenna may be made more compact as a whole.

Furthermore, it would also be acceptable to make the thicknesses of dielectric masks 210, 212, 214, and 216 different according to their locations. By adjusting the thicknesses of dielectric masks 210, 212, 214, and 216, it is possible to adjust the size of the interelement spacing for obtaining the desired phase difference, or it is possible to adjust the phase difference which is obtained from a predetermined interelement spacing.

Figure 24A:
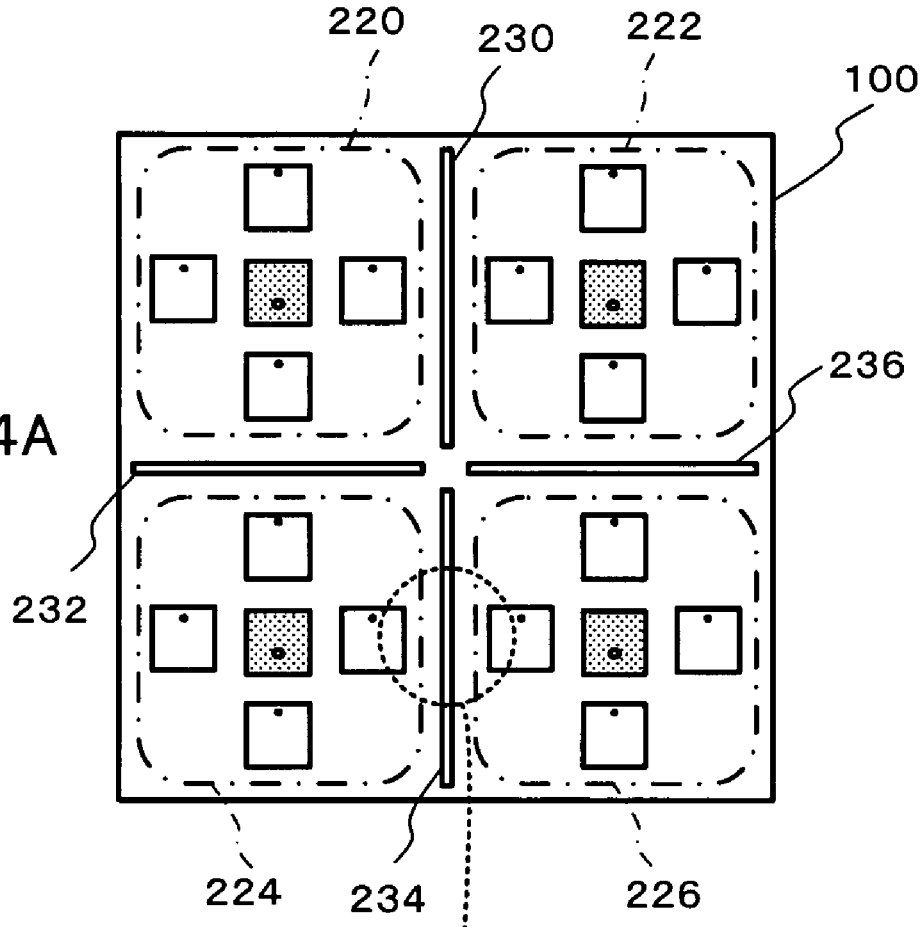
FIG. 24 is a plan view and a sectional view of a microstrip antenna according to an eighth embodiment of the present invention.

FIG. 24A is a plan view of a microstrip antenna according to an eighth embodiment of the present invention. And FIG. 24B is a partial sectional view of the portion of the same microstrip antenna which is surrounded by a dot-line circle in FIG. 24A.

Figure 24B:
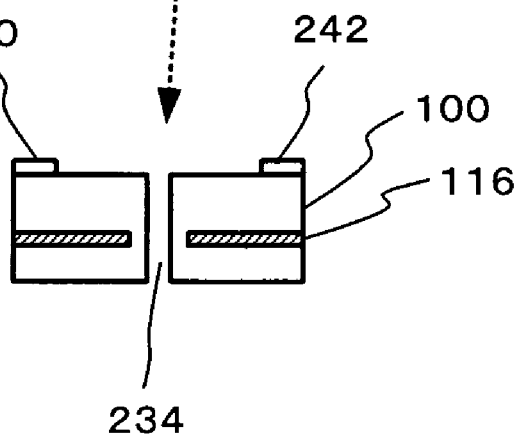

With the microstrip antenna shown in FIGS. 24A and 24B, a plurality of (for example, four) sub-antennas 220, 222, 224, and 226, all having the same structure as the one shown in FIG. 13, are constructed upon the same substrate 100. Slits (in other words, air layers) 230, 232, 234, and 236 are provided at the portions of substrate 100 which correspond to the mutual boundaries between sub-antennas 220, 222, 224, and 226. Accordingly, sub-antennas 220, 222, 224, and 226 come to be substantially separated via these air layers.

The radio beams from the plurality of sub-antennas 220, 222, 224, and 226 are combined together, and thereby a radio beam is obtained which has been strongly throttled, in other words which has high directivity. By switching the parasitic elements whose relative positions within this plurality of sub-antennas 220, 222, 224, and 226 are the same all together at the same time between being effective and not being effective, it is possible to change over the radiating direction of this strongly throttled radio beam between upwards, downwards, leftwards, and rightwards.

The mutual distances between sub-antennas 220, 222, 224, and 226 are chosen to be the distances such that the influence due to mutual interference between parasitic elements of different sub-antennas (for example, between parasitic elements 240 and 242 shown in FIG. 24B) is made to be so small as not to cause a problem. This type of distance is typically a distance equal to or greater than one wavelength in the air of the microwaves which are being used.

Now, in the above described mutual interference between sub-antennas 220, 222, 224, and 226, there is a contribution which is generated from the microwaves which propagate between the antenna elements via substrate 100, and a contribution which is generated from the microwaves which propagate through the air. Since, due to slits (air layers) 230, 232, 234, and 236 in substrate 100, it is difficult for microwaves to be transmitted via the surface and the interior of substrate 100, accordingly mutual interference between sub-antennas 220, 222, 224, and 226 is suppressed. As a result, it becomes possible to arrange sub-antennas 220, 222, 224, and 226 at a higher density, so that it is possible to anticipate making the microstrip antenna more compact as a whole.

Figure 25A:
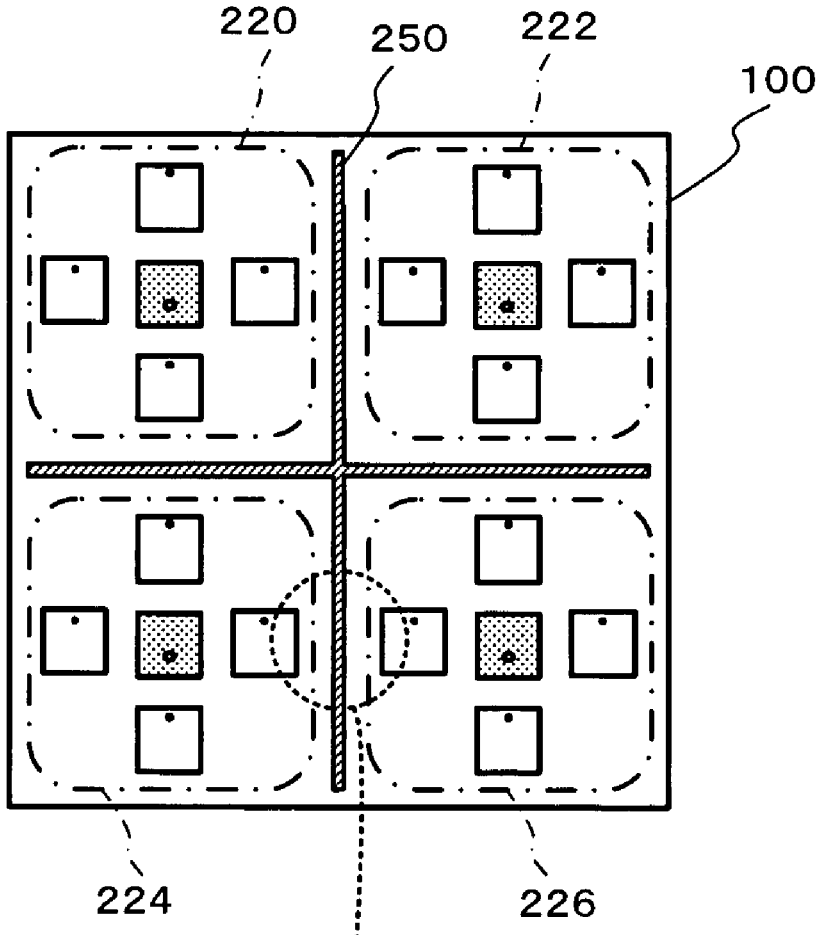
FIG. 25 is a plan view and a sectional view of a microstrip antenna according to a ninth embodiment of the present invention.

FIG. 25A is a plan view of a microstrip antenna according to a ninth embodiment of the present invention. And FIG. 25B is a partial sectional view of the portion of the same microstrip antenna which is surrounded by a dot-line circle in FIG. 25A.

Figure 25B:
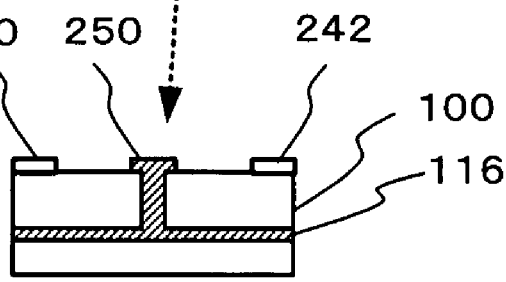

With the microstrip antenna shown in FIGS. 25A and 25B, in a structure which is fundamentally the same as that shown in FIGS. 24A and 24B, at portions of substrate 100 which correspond to the boundaries between sub-antennas 220, 222, 224, and 226, there is provided, not a slit, but shield member 250 which is connected to ground electrode 116 (in other words, which is always kept at a fixed electrical potential, i.e. ground potential). Since the electromagnetic field coupling intensity becomes strong between the end surfaces facing shield member 250 of the parasitic elements which are positioned near to the boundaries of sub-antennas 220, 222, 224, and 226, and shield member 250, accordingly the radiations intensities which are emitted into the air from the parasitic elements become small at the boundary. Due to this, it becomes difficult for the microwaves to be transmitted via the air to the parasitic elements of the adjacent sub-antenna, so that mutual interference between the sub-antennas is suppressed. As a result, it is possible to arrange the plurality of sub-antennas at high density, so that it is possible to anticipate making the substrate more compact.

Figure 26:
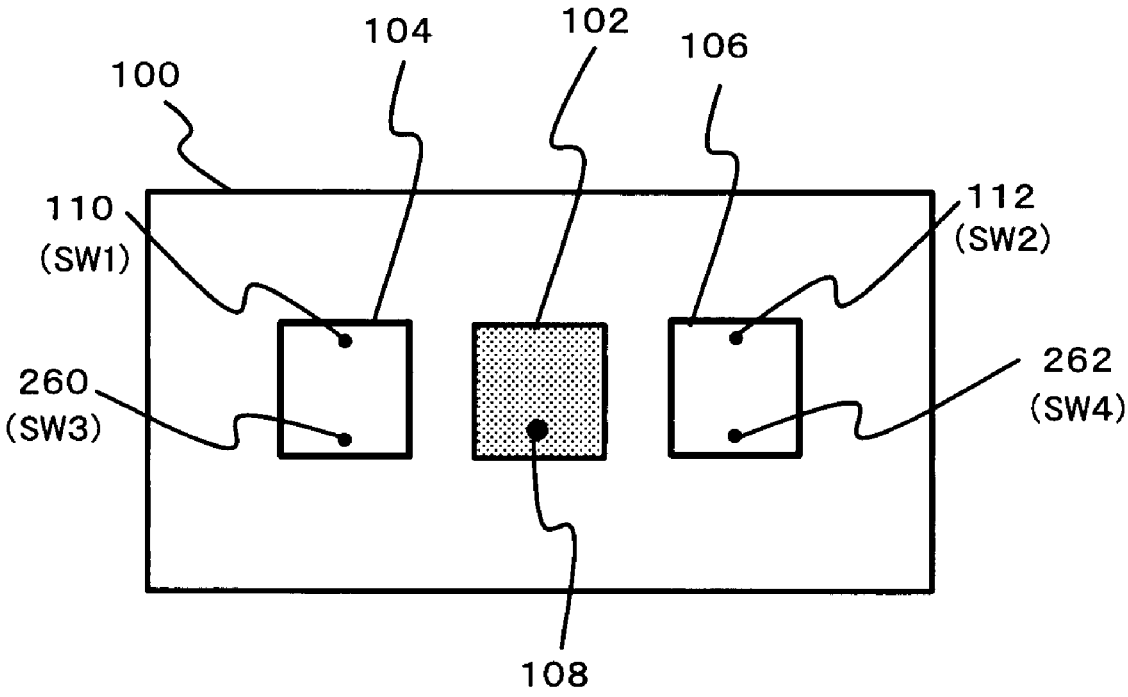
FIG. 26 is a plan view of a microstrip antenna according to a tenth embodiment of the present invention.

FIG. 26 is a plan view of a microstrip antenna according to a tenth embodiment of the present invention.

With this microstrip antenna shown in FIG. 26, in addition to the structure shown in FIG. 1, additional control leads 260 and 262 are connected to parasitic elements 104 and 106, and, although this feature is not shown in the figure, it is arranged to be possible to connect and disconnect these control leads 260 and 262 to the ground electrode individually, via switches upon the rear surface of substrate 100, just as with the other control leads 110 and 112. In other words, each of parasitic elements 104 and 106 has a plurality of (for example, two) ground points. As explained with reference to FIG. 1, each of these ground points is located outside a range of the width L/2 in the excitating direction centered the middles of parasitic elements 104 and 106. It should be understood that reference symbols SW1, SW2, SW3, and SW4 which are appended in the vicinity of the reference numbers for the various ground points are the names of switches for grounding the respective ground points (refer to FIG. 28).

Figure 27:
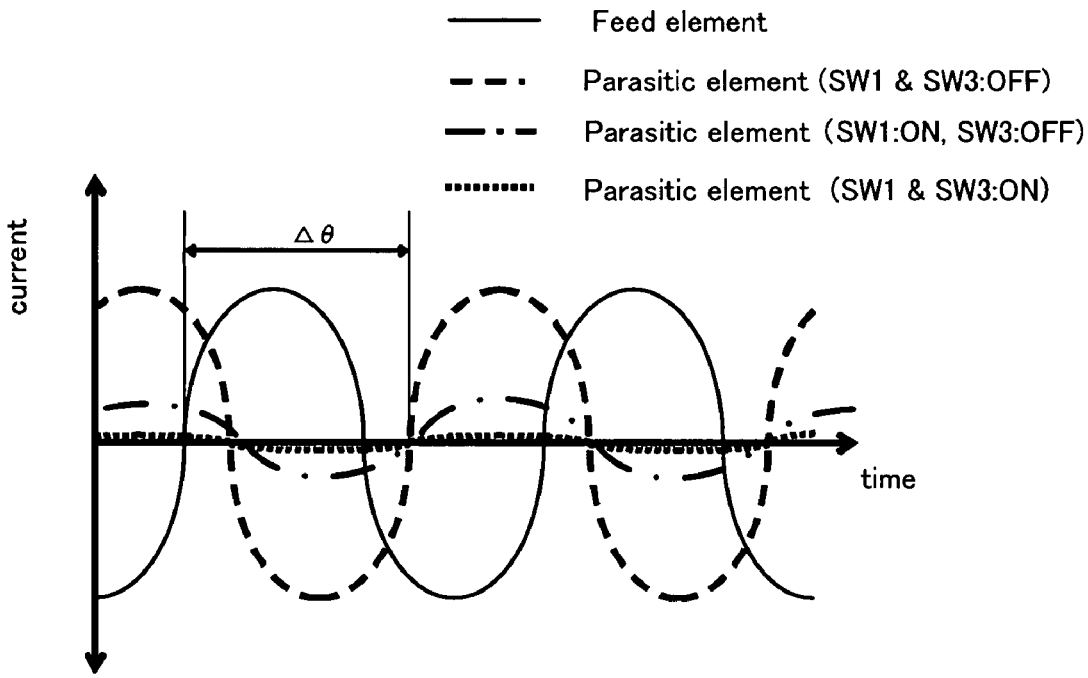
FIG. 27 is a figure showing, for the tenth embodiment, the waveforms of the microwave electrical currents flowing in the feed element and in the parasitic elements.

FIG. 27 shows the waveforms of the microwave electrical currents flowing in the feed element and the parasitic elements, in the tenth embodiment shown in FIG. 26.

In FIG. 27, the waveform shown by the dashed line corresponds to the case when only a single ground point of a parasitic element is grounded, while the waveform shown by the dot-line corresponds to the case when both the ground points of a parasitic element are grounded. When the two ground points are both grounded, the amplitude of the microwave electrical current which flows to the parasitic element becomes smaller than when only a single ground point is grounded, and the parasitic element is made to be ineffective more effectively.

Figure 28:
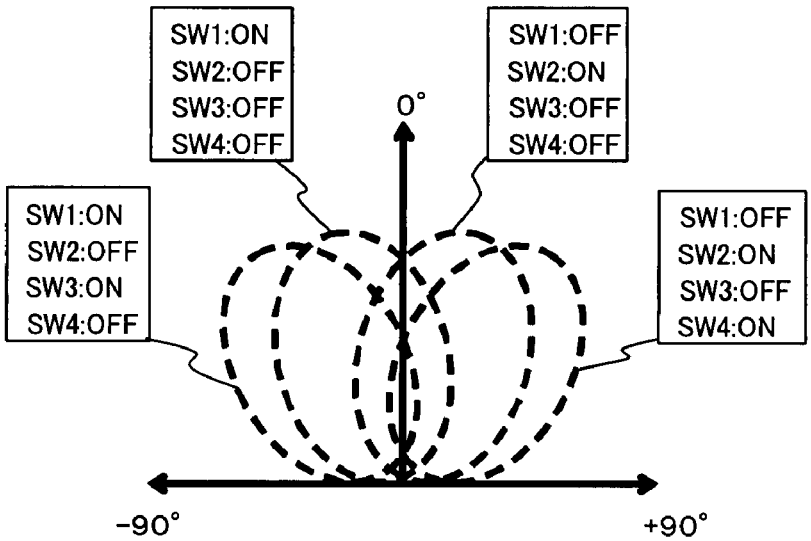
FIG. 28 shows a state, with the microstrip antenna shown in FIG. 26, in which the radiating direction of the radio beam changes.

FIG. 28 shows a situation, with the microstrip antenna shown in FIG. 26, in which the radiating direction of the radio beam changes.

Figure 29A:
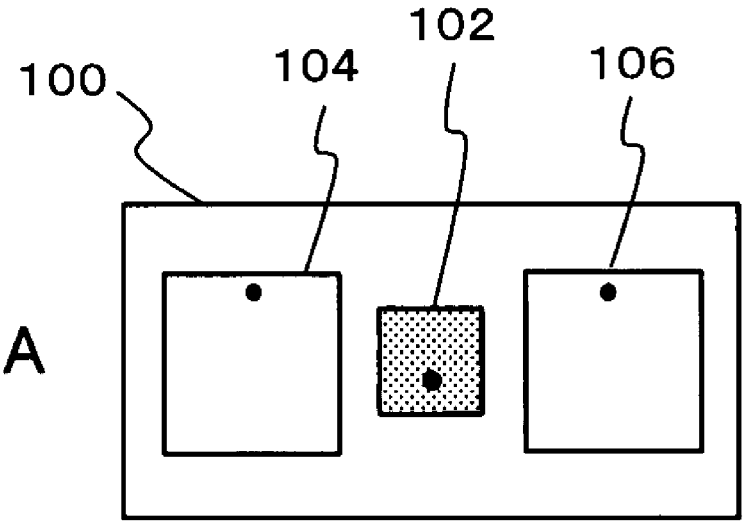
FIG. 29 is a figure showing a variant embodiment of the relationship between the size of a feed element which can be applied in a microstrip antenna according to the present invention, and the size of the parasitic elements.
Figure 29B:
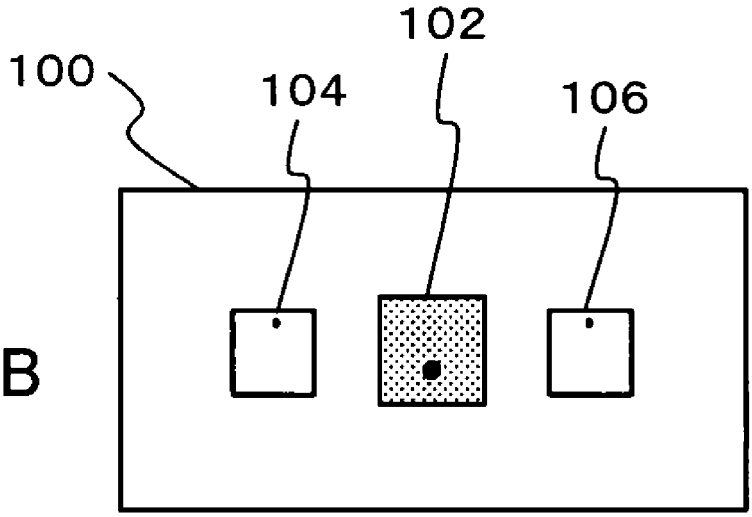
Figure 29C:
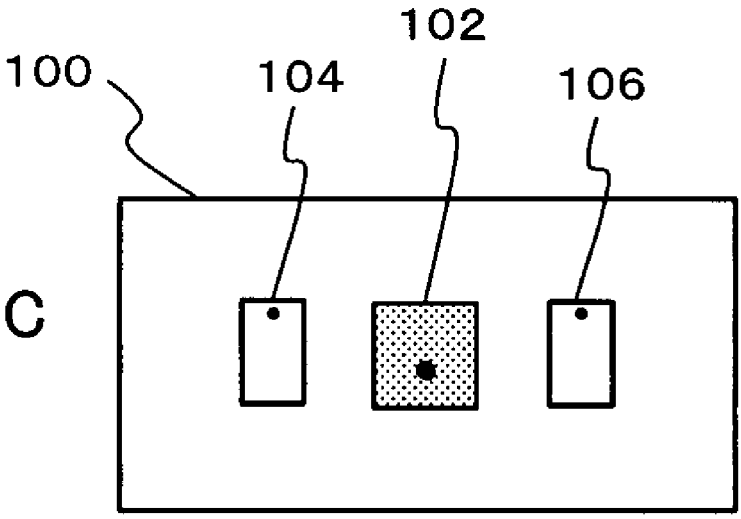

As shown in FIG. 28, by switching the grounding degree (the degree of making ineffective) in a plurality of stages, i.e. by not only switching between the two stages of grounding the parasitic element and float, but also by arranging to ground only a single ground point, or to ground both of the two ground points, it is possible to control the radiating direction of the radio beam to yet a further level of fineness FIGS. 29A through 29C show a variant embodiment of the relationship between the size of a feed element which can be applied in a microstrip antenna according to the present invention, and the size of the parasitic elements;

In all of the embodiments described above, the feed elements and the parasitic elements have been of almost the same size. However, it is also possible to make parasitic elements 104 and 106 larger than feed element 102 as shown in FIG. 29A, or to make parasitic elements 104 and 106 smaller than feed element 102 as shown in FIG. 29B. Moreover as shown in FIG. 29C, it is also possible to make the shapes of parasitic elements 104 and 106 be different from the shape of feed element 102 (for example, to make them thinner).

Figure 30:
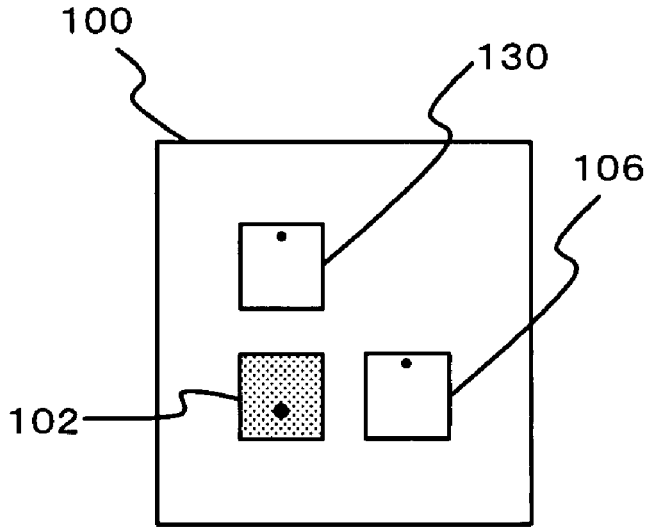
FIG. 30 is a plan view showing a variant embodiment related to the arrangement of the parasitic elements.

FIG. 30 shows a variant embodiment related to the arrangement of the parasitic elements. As shown in FIG. 30, a plurality of parasitic elements 106 and 130 are disposed asymmetrically in different directions with respect to feed element 102 (for example in directions differs by 90 degree, such as upon its upper side and upon its right side).

Figure 31:
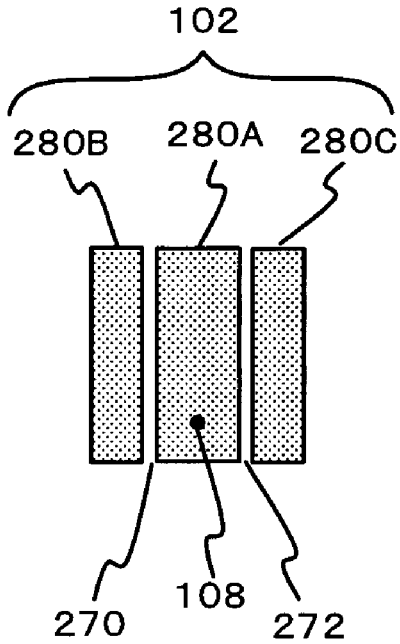
FIG. 31 is a plan view showing a variant embodiment related to the feed element.

FIG. 31 shows a variant embodiment related to the feed element. As shown in FIG. 31, fine slits 270 and 272 which are parallel to the excitating direction are inserted into feed element 102, so that, even though feed element 102 is separated into a plurality of stripe electrodes 280A, 280B, and 280C which are parallel to the excitating direction, it is still possible to change the radiating state of the radio waves in the same manner. Furthermore, it is possible to adjust the resonant frequency by changing the slits width inserted into the feed element, and, if slits are inserted into a feed element which is formed upon the substrate with a laser or the like, it is possible to make the resonant frequency fall within a predetermined range in a simple manner, irrespective of variations in the relative permittivity or the thickness of the substrate, and of manufacturing variations in the shape of the feed element.

Figure 32A:
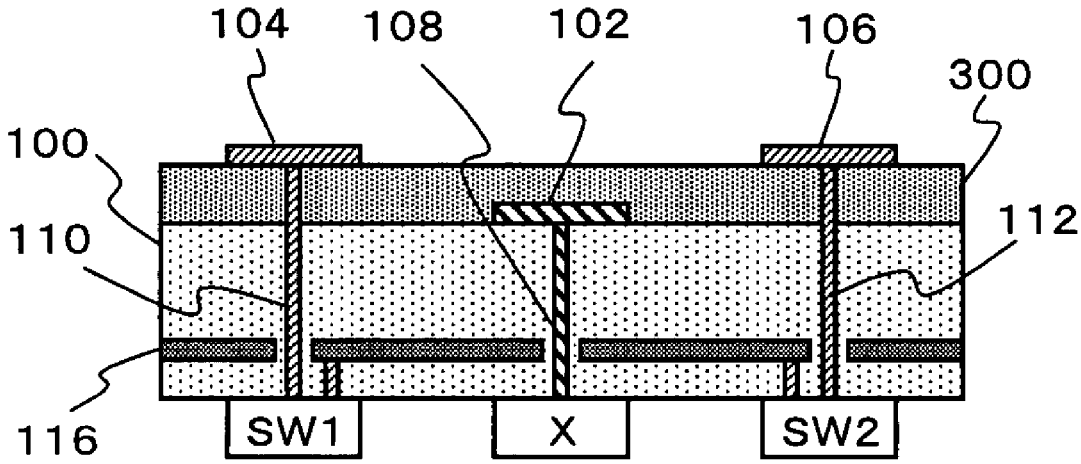
FIG. 32 is a plan view of a microstrip antenna according to an eleventh embodiment of the present invention.
Figure 32B:
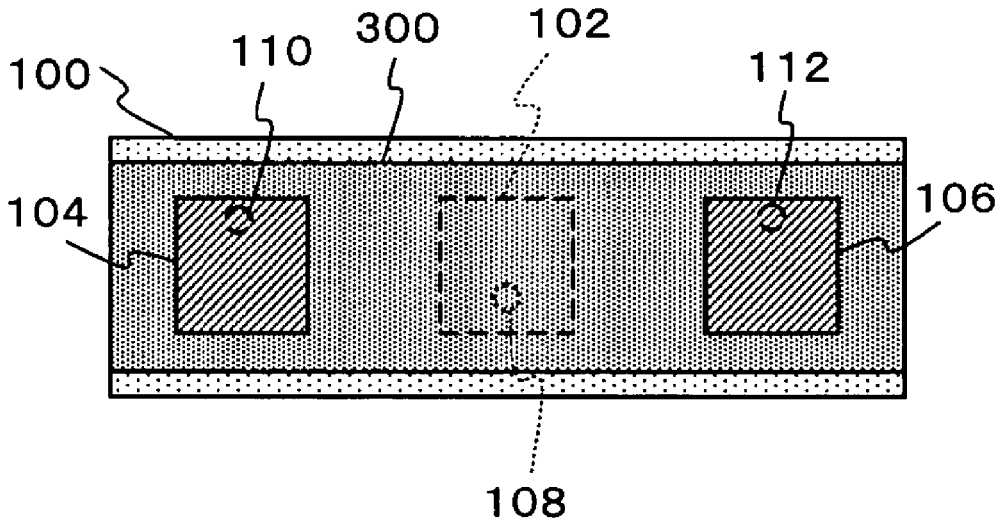
Figure 33A:
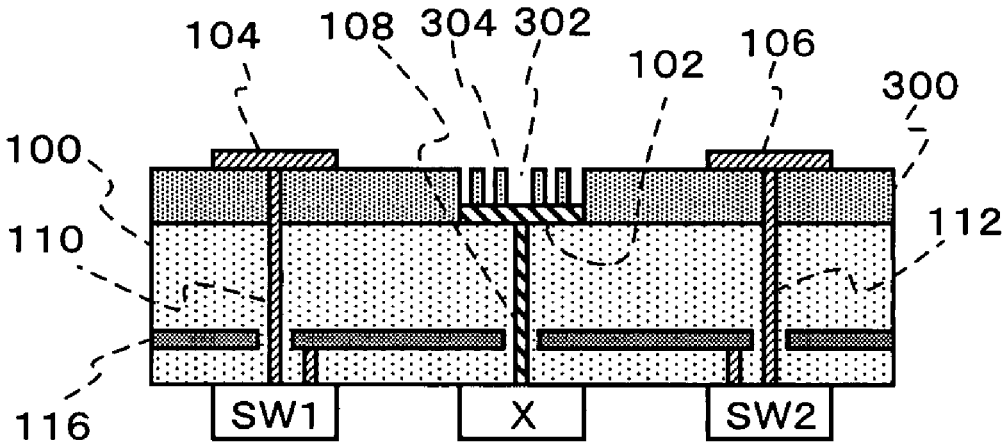
FIG. 33 is a plan view of a microstrip antenna according to a twelfth embodiment of the present invention.
Figure 33B:
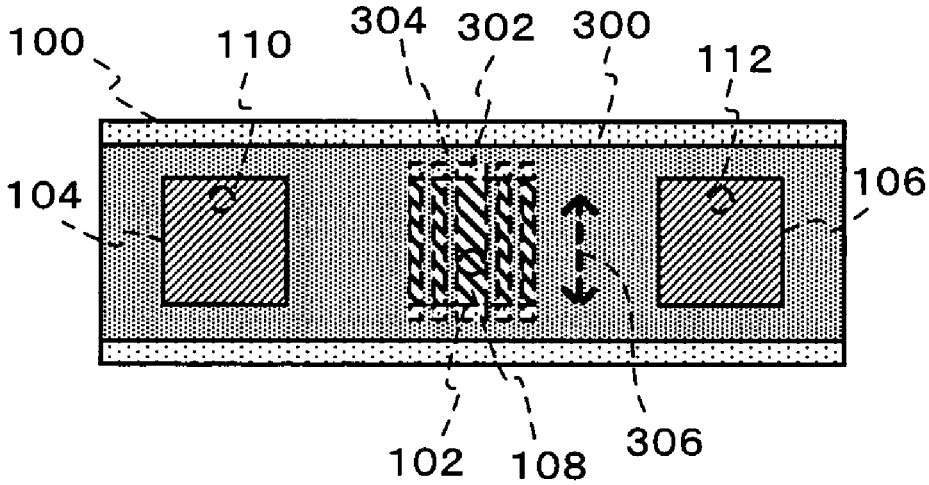
Figure 34A:
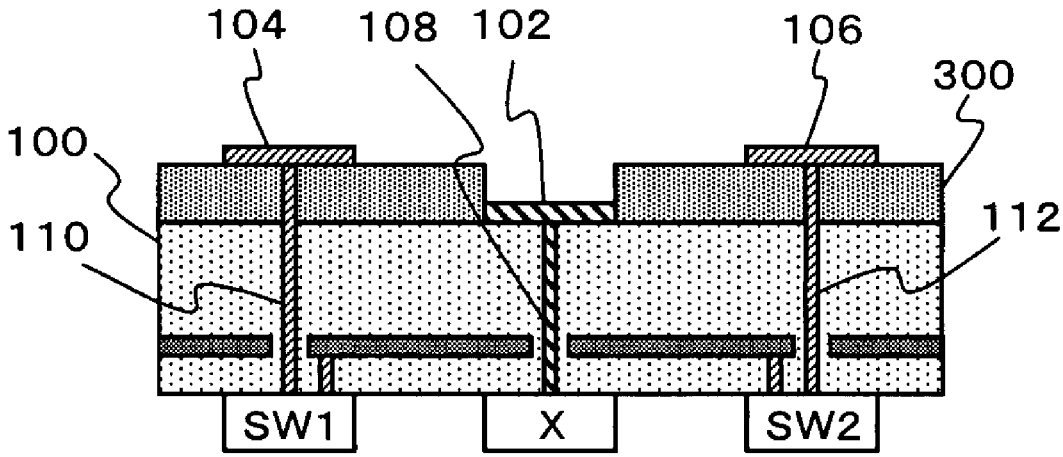
FIG. 34 is a plan view of a microstrip antenna according to a thirteenth embodiment of the present invention.
Figure 34B:
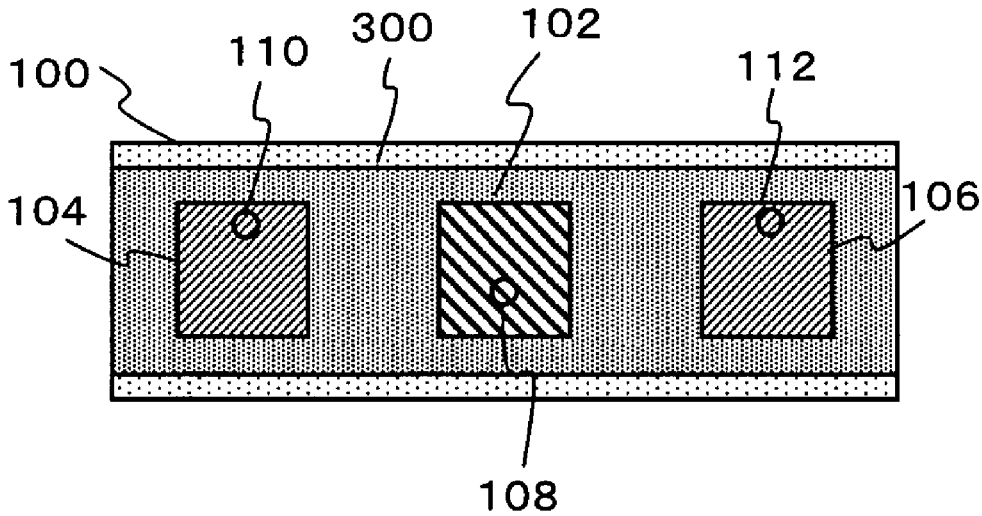

FIGS. 32A and 32B are a sectional view and a plan view of an eleventh embodiment of the present invention; FIGS. 33A and 32B are a sectional view and a plan view of a twelfth embodiment; and FIGS. 33A and 33B are a sectional view and a plan view of a thirteenth embodiment.

In all of the embodiments shown in FIGS. 32A and 32B through 34A and 34B, the surface of substrate 100 upon which feed element 102 is formed is covered by dielectric layer 300. Parasitic elements 104 and 106 are formed upon the surface of dielectric layer 300. As the dielectric material for dielectric layer 300, for example, a ceramic material such as alumina or yttria may be used; or it would also be acceptable to use a metallic oxide containing Ti (titanium) whose permittivity is comparatively high, or a metallic oxide containing $SiO_2$ (silica) whose permittivity is comparatively low. The $\in r$ value (relative permittivity) of dielectric layer 300 is, for example, around 10. And, although the thickness of dielectric layer 300 may be set to an appropriate value according to the dielectric material, if a material whose $\in r$ (relative permittivity) is around 10 is used, this thickness may be, for example, approximately 10 μm.

In the eleventh embodiment shown in FIGS. 32A and 32B, the surface of feed element 102 is perfectly covered by dielectric layer 300. By contrast, in the twelfth embodiment shown in FIGS. 33A and 33B, a plurality of slits 302 are formed in portions of the region of dielectric layer 300 over the surface of feed element 102. In this example shown in FIGS. 33A and 33B, although slits 302 are cut perfectly through the thickness of dielectric layer 300 so that underlying feed element 102 is exposed, it is not necessary for this to be the case; it would also be acceptable to provide recessed grooves cut to partway through the thickness of dielectric layer 300. In other words, in this twelfth embodiment, recessed portions 302 and convex portions 304 are formed upon the partial region of dielectric layer 300 over the surface of feed element 102. To put it in another manner, variations are imposed upon the thickness of dielectric layer 300 over feed element 102. In the example shown in the figure, recessed portions 302 and convex portions 304 are formed in the shape of bands which are parallel to the excitating direction 306. Furthermore, in the thirteenth embodiment shown in FIGS. 34A and 34B, the entire surface of the feed element is not covered by dielectric layer 300, but rather is exposed.

When a comparison is drawn with the first embodiment shown in FIGS. 1 and 2 (the structure in which parasitic elements 104 and 106 are disposed directly upon substrate 100), then, according to the eleventh through thirteenth embodiments shown in FIGS. 32A and 32B through FIGS. 34A and 34B, by disposing parasitic elements 104 and 106 upon the surface of dielectric layer 300, the phase difference between parasitic elements 104 and 106 is brought closer to 180 degree (i.e. $\lambda g/2$) by yet a further level. Due to this, it is possible to switch only one of parasitic elements 104 and 106 to being ineffective, and thereby the radiating direction of the radio waves is inclined by a wider angle.

Figure 35:
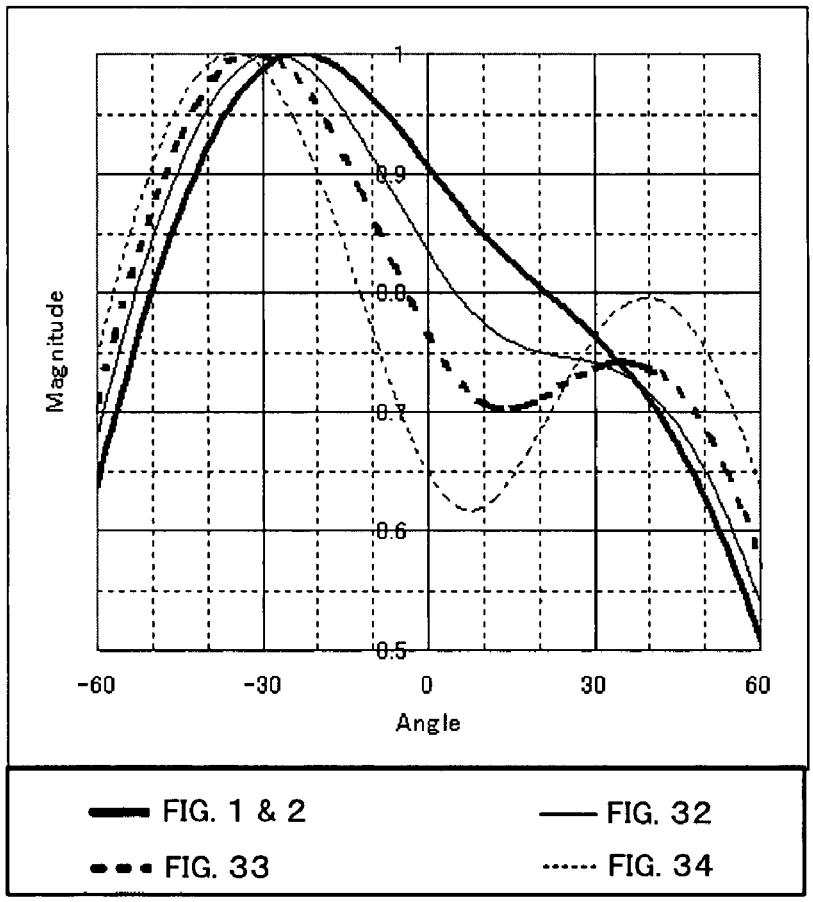
FIG. 35 is a figure showing the inclination states of the radio waves for the first, eleventh, twelfth, and thirteenth embodiments, correlated.

FIG. 35 shows the results of simulation calculations for the distribution of the radio waves intensity, for the first embodiment shown in FIGS. 1 and 2 and the eleventh through thirteenth embodiments shown in FIGS. 32A and 32B through FIGS. 34A and 34B, when only one of parasitic elements 104 and 106 has been made ineffective. In FIG. 35, the horizontal axis shows the inclination angle towards parasitic element 104 or 106 while taking the direction which is perpendicular to the surface of substrate 100 as 0 degree, while the vertical axis shows the intensity of the component of the radio waves in these angular directions. And the thick solid line graph shows the radio wave distribution in the first embodiment shown in FIGS. 1 and 2; the thin solid line graph shows that in the eleventh embodiment shown in FIGS. 32A and 32B; the thick dot-line graph shows that in the twelfth embodiment shown in FIGS. 33A and 33B; and the thin dot-line graph shows that in the thirteenth embodiment shown in FIGS. 34A and 34B.

In FIG. 35, the inclination angles at which the intensity of the directional component of the radio waves shown in the various graphs are maximum correspond to the inclination angles of the radiating directions of the radio waves in each of the embodiments. As will be understood from FIG. 35, the inclination angle of the radiating direction of the radio waves is greater for the eleventh through the thirteenth embodiments than for the first embodiment (the graph shown by the thick solid line). And, among the eleventh through the thirteenth embodiments, particularly, with the thirteenth embodiment in which dielectric layer 300 is laminated over the region of substrate 100 except for over the surface of feed element 102, (the thin dot-line graph), the radio waves are inclined to the maximum. Furthermore, with the twelfth embodiment in which variations are imposed upon the thickness of dielectric layer 300 over feed element 102, it is possible to adjust the inclination angle of the radio waves by adjusting the degree by which these changes of thickness are imposed.

Figure 36A:
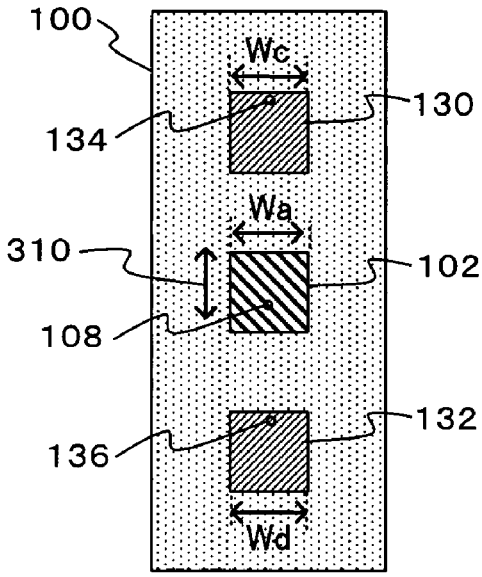
FIG. 36 is a plan view showing two variant embodiments for the relationship widths of the feed element and the parasitic elements.
Figure 36B:
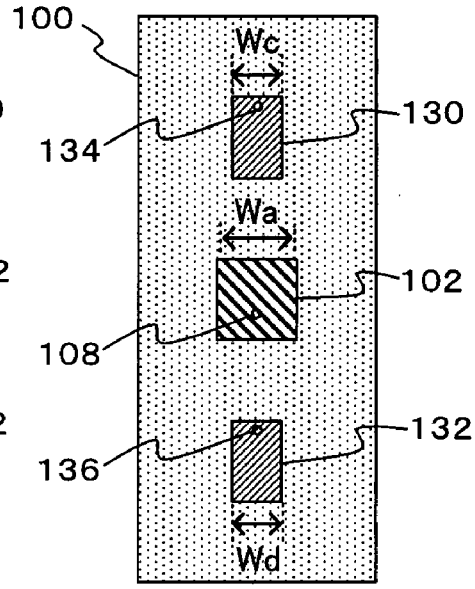

FIGS. 36A and 36B show two variant embodiments of the relationship between the feed element and the parasitic elements.

In the variant embodiment shown in FIG. 36A, widths Wc and Wd of parasitic elements 130 and 132 which are present in excitating direction 310 of feed element 102 (i.e. their dimensions in the direction which is orthogonal to excitating direction 310) are the same as width Wa of feed element 102. By contrast, in the variant embodiment shown in FIG. 36B, widths Wc and Wd of parasitic elements 130 and 132 are slightly narrower than width Wa of feed element 102.

Generally, in the case that the parasitic elements are disposed in the vicinity of the feed element, the radiating direction of the radio wave splits (in other words, the distribution shape of the radio waves becoming divided into a heart shape) and the radiation intensity decreases when the spacings between the feed element and the parasitic elements become too narrow. In order to prevent this, it is necessary to ensure a spacing of a certain distance between the feed element and the parasitic elements (for example a distance equal to or greater than about 0.3 times the wavelength which is being used). In particular, as shown in FIGS. 36A and 36B, when parasitic elements 130 and 132 are arranged along the excitating direction of feed element 102, if width Wa of feed element 102 and widths Wc and Wd of parasitic elements 130 and 132 are approximately the same as shown in FIG. 36A, then the current density at which parasitic elements 130 and 132 are excited becomes lower. As a result, even if one of parasitic elements 130 and 132 is switched so as to be made ineffective, the radiating direction of the radio waves does not incline to any remarkable extent. By contrast, if widths Wc and Wd of parasitic elements 130 and 132 is narrowed down as shown in FIG. 36B, then the current density at which parasitic elements 130 and 132 are excited is increased. As a result, when one of parasitic elements 130 and 132 is switched so as to be made ineffective, the radiating direction of the radio waves is prominently inclined.

Figure 37:
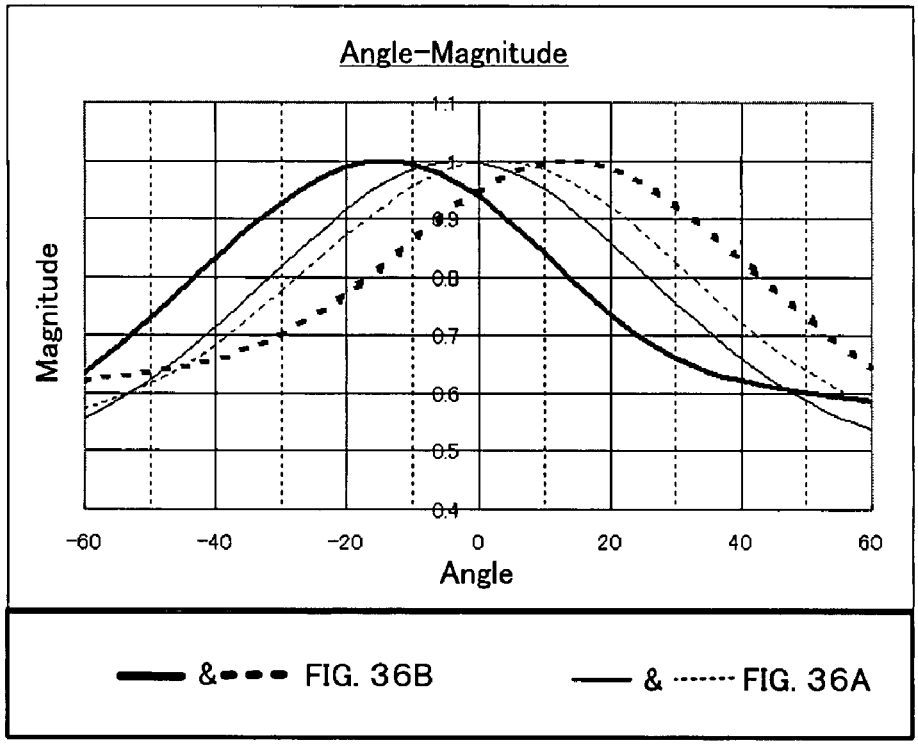
FIG. 37 is a figure showing the inclination states of the radio waves for the two variant embodiments shown in FIGS. 36A and 36B, correlated.

FIG. 37 shows the results of simulation calculations for the distribution of the intensity of the radio waves, for the two variant embodiments shown in FIGS. 36A and 36B, when only one of parasitic elements 130 and 132 has been made ineffective. In FIG. 37, the horizontal axis shows the inclination angle towards parasitic element 130 or 132 while taking the direction which is perpendicular to the surface of substrate 100 as 0 degree, while the vertical axis shows the intensity of the component of the radio waves in these angular directions. And the thick solid line and dot-line graphs show the radio wave distributions in the variant embodiment shown in FIG. 36B, while the thin solid line and dot-line graphs show that in the variant embodiment shown in FIG. 36A (the solid line graphs and the dot-line graphs show cases in which different ones of the parasitic elements have been made ineffective). The design conditions which were used in these simulation calculations were that the relative permittivity of substrate 100 was 3.26, the thickness of substrate 100 was 0.4 mm, the excitation frequency was 11 GHz, the size of feed element 102 was 7.3 mm×7.3 mm (in FIG. 36A, the size of the parasitic elements was also the same), the distance of the spacing between feed element 102 and parasitic elements 130 and 132 was 7.3 mm, and, in FIG. 36B, the size of parasitic elements 130 and 132 was 7.3 mm (the length along the excitating direction)×5.0 mm (the width).

Figure 38:
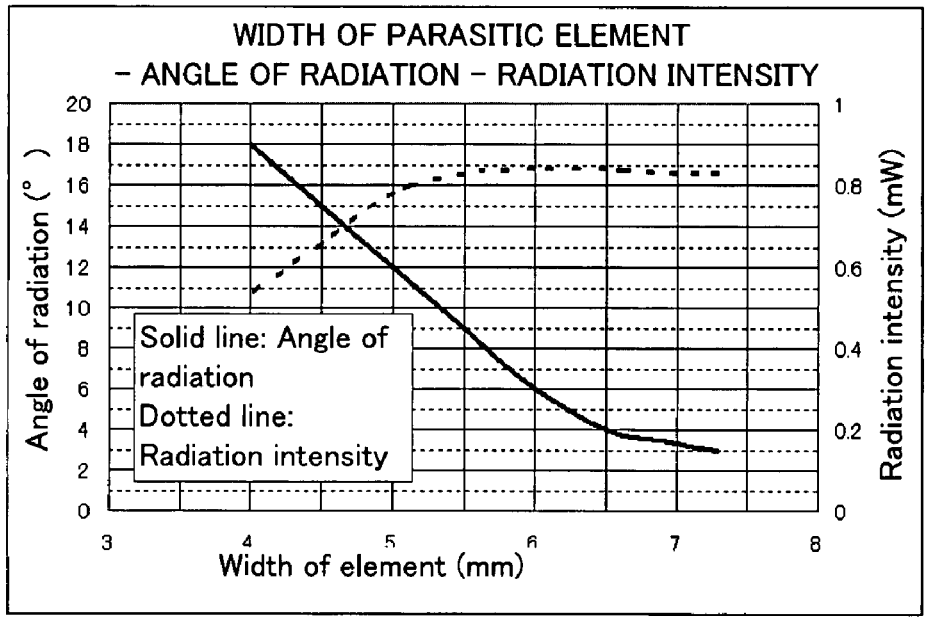
FIG. 38 is a figure showing the relationship between the widths of the parasitic elements of the variant embodiment shown in FIG. 36B, and the states of inclination and intensity of the radio waves.

FIG. 38 shows the results of calculations, for the variant embodiment shown in FIG. 36B, as to how the inclination angle of the radiating direction of the radio waves (the solid line graph) and the radiation intensity of the radio waves (the dot-line graph) change when widths Wc and Wd of parasitic elements 130 and 132 (shown along the horizontal axis) are varied. The conditions used in these simulation calculations were the same as those described above, but widths Wc and Wd of parasitic elements 130 and 132 were changed to various values between 7.3 mm and 4.0 mm.

From FIG. 37 it will be understood that, as described above, in the variant embodiment of FIG. 36A, the inclination of the radiating direction of the radio waves is extremely small, whereas, in the variant embodiment of FIG. 36B, a large inclination is obtained. Now, as will be understood from FIG. 38, the narrower widths Wc and Wd of parasitic elements 130 and 132 are made, the wider does the radiation angle when one of these parasitic elements is made to be ineffective become, but, on the other hand, there is a tendency for the radiation intensity to decrease. Due to this, it is desirable to make widths Wc and Wd of parasitic elements 130 and 132 narrow, within a range in which decrease of the radiation intensity is so small as not to cause any problem. From this aspect, under the design conditions used in the simulation calculations described above, it is desirable for widths Wc and Wd of parasitic elements 130 and 132 to be more or less equal to 5 mm. However, this is only shown as one example; the optimum value is different according to the concrete conditions, since the relationship between the radiation angle and the intensity changes according to various conditions such as the frequency which is used, the permittivity and the thickness of the substrate, the arrangement of the parasitic elements and the feed elements, and the like.

Figure 39A:
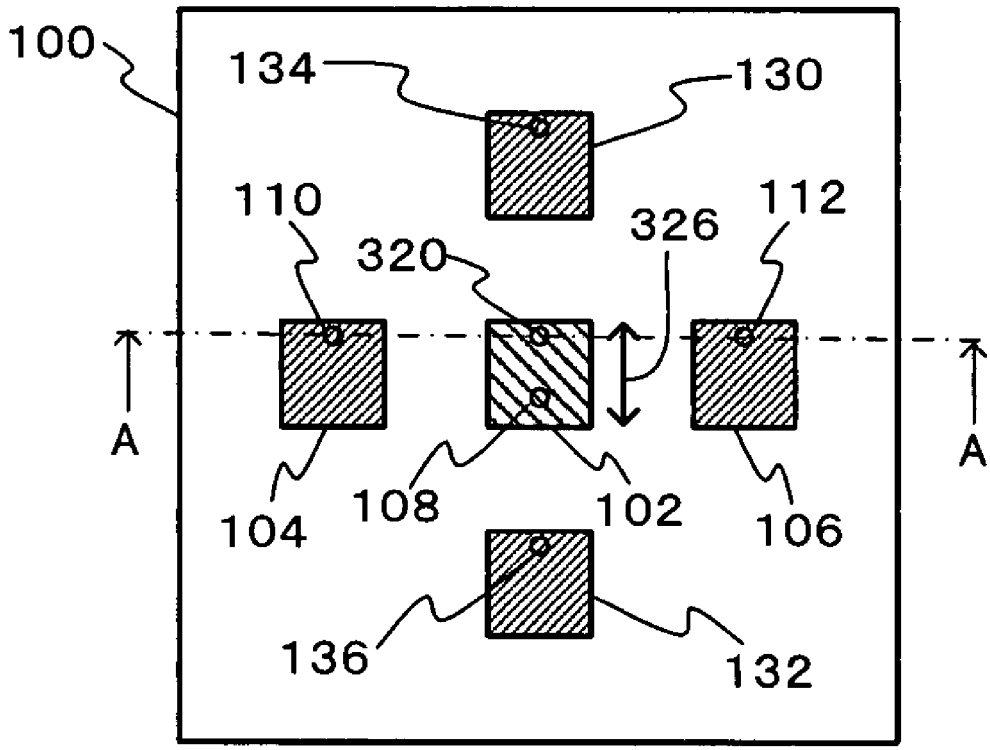
FIG. 39 is a plan view and a sectional view of a microstrip antenna according to a fourteenth embodiment of the present invention.
Figure 39B:
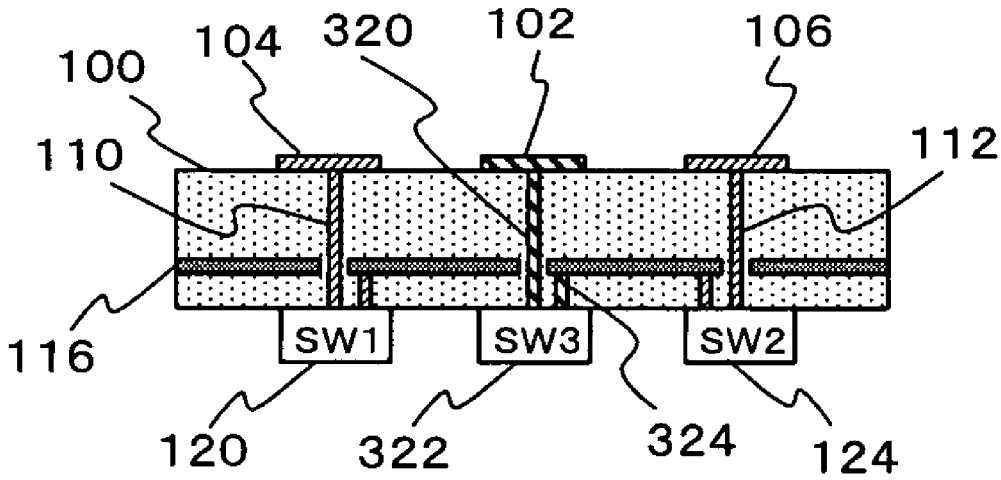

FIG. 39A shows the plan structure of a microstrip antenna according to a fourteenth embodiment of the present invention, and FIG. 39B shows its cross sectional structure taken in line A-A in FIG. 39A.

FIGS. 39A and 39B are a plan view and a sectional view of a microstrip antenna according to a fourteenth embodiment of the present invention.

This fourteenth embodiment shown in FIGS. 39A and 39B has, in addition to the same structure as the fourth embodiment shown in FIG. 13, the following additional structure. That is, another through hole 320 is connected to feed element 102, apart from feed line 108, and through hole 320 is connected at the rear surface of substrate 110 to switch 322. Switch 322 is adapted to connect and disconnect between through hole 320 from feed element 102, and ground electrode 116 on substrate 100. In other words, when switch 322 is ON, feed element 102 is grounded. The position of the ground point upon feed element 102 (i.e. the point where through hole 320 is provided) may be, for example, in the vicinity of the edge on the side most remote from feed line 108 in excitating direction 326 of feed element 102, as shown in the figure.

Figure 40A:
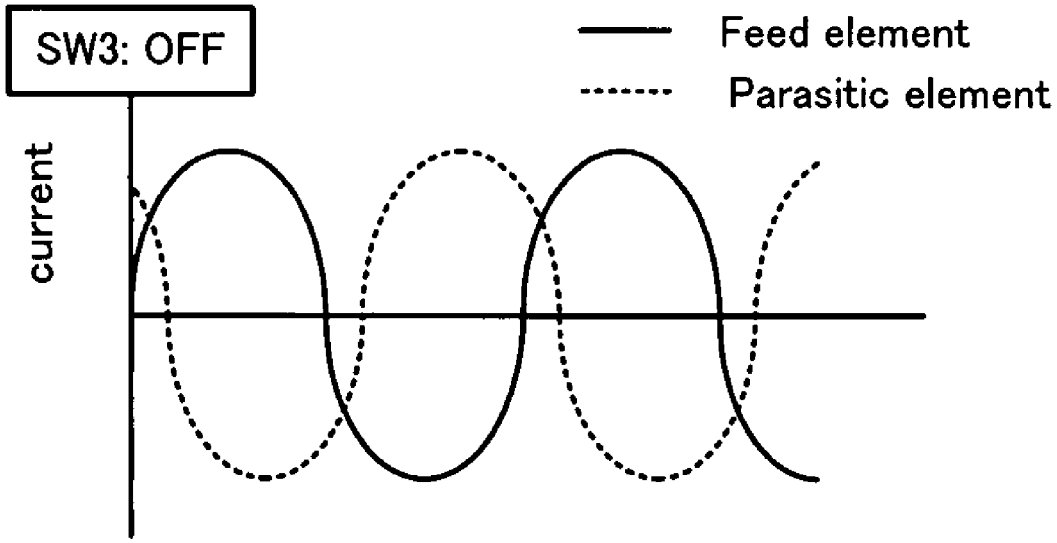
Figure 40B:
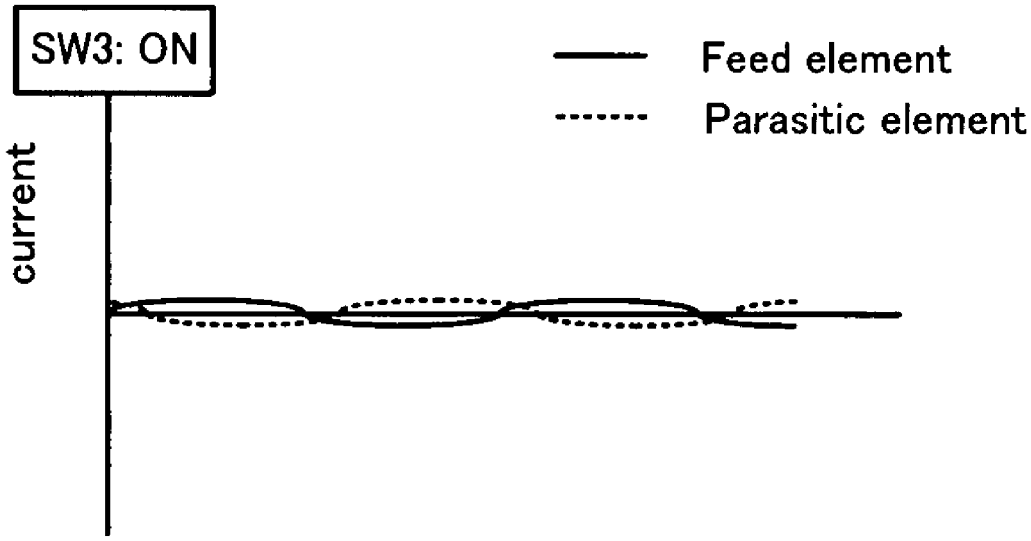

FIG. 40A is a figure, for the above described fourteenth embodiment, showing the waveforms of the currents which respectively flow in feed element 102 (the solid line graph) and in parasitic elements 104, 106, 130, and 132 which are in the effective state (the dot-line graph), when switch 322 is OFF; and FIG. 40B shows these current waveforms when switch 322 is ON.

As will be understood from FIGS. 40A and 40B, when switch 322 is ON and feed element 102 is connected to ground electrode 116, even if parasitic elements 104, 106, 130, and 132 are made to be effective, the amount of electrical power which is emitted from this antenna becomes extremely small. In the state in which a high-frequency signal continues to be applied to feed element 102 from a microwave signal source, it is possible to vary the amount of electrical power which is emitted from the antenna by switching switch 322 between ON and OFF. It is possible to employ the method of switching the microwave signal source ON and OFF for the purpose of changing the amount of radiation power. While if this method is employed, there is the shortcoming that the output of the microwave signal source directly after it has been switched is not stable. By contrast, if the method of switching switch 322 connected to feed element 102 is employed, the stability of the radio wave output is excellent, since the output of the microwave signal source is maintained in a stable state. Accordingly, the method of switching switch 322 is suitable for a type of application such as measuring distance according to the time period difference between a pulsed radio wave which is outputted from a transmission antenna and a pulsed radio wave which is received by a reception antenna by colliding with an object to be measured and reflecting, for example.

Figure 41:
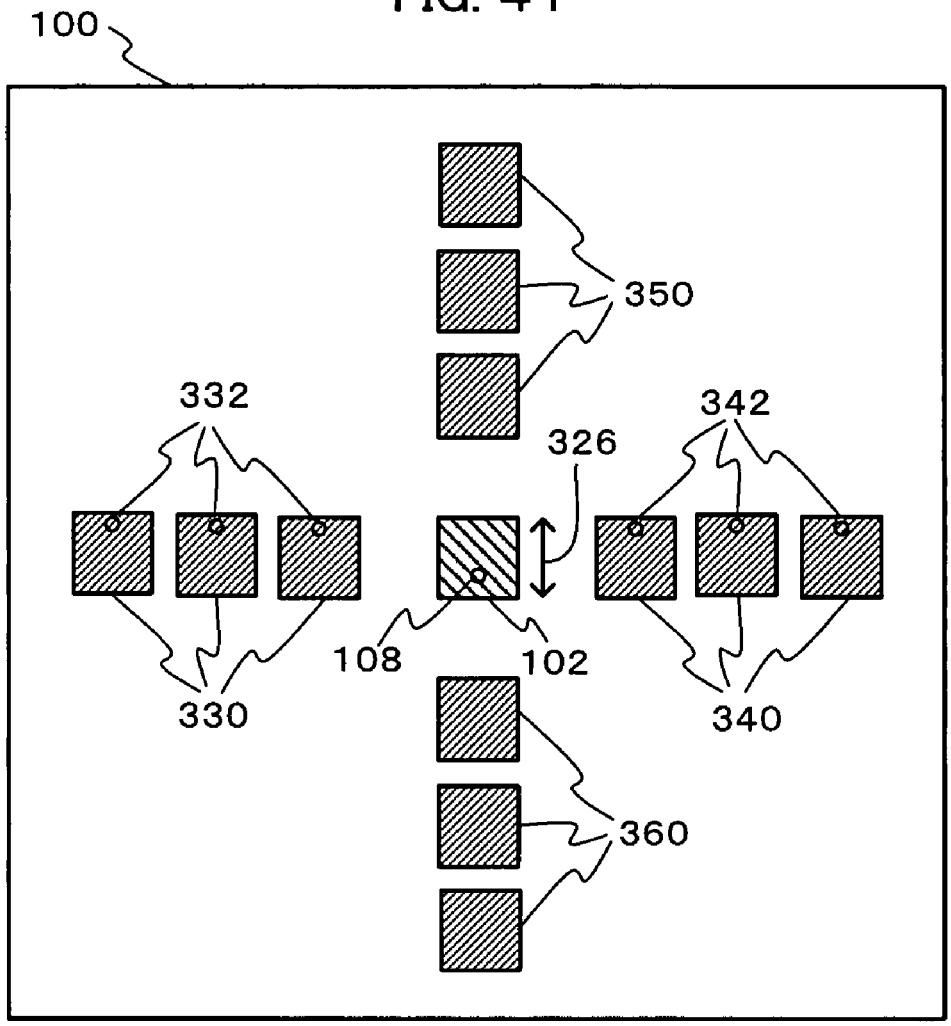
FIG. 41 is a plan view of a microstrip antenna according to a fifteenth embodiment of the present invention.

FIG. 41 is a plan view of a microstrip antenna according to a fifteenth embodiment of the present invention.

As shown in FIG. 41, one, or two or more, parasitic elements 330 are disposed on one side of feed element 102 in the direction which is orthogonal to excitating direction 326, and also one, or two or more, parasitic elements 340 are disposed on the other side. Each of parasitic elements 330 and 340 which are arrayed orthogonally to the excitating direction 326 has through hole 332 or 342 for making it ineffective, and accordingly, by changing them over between being made effective and being made ineffective, a contribution is made to changing the radiating direction of the radio waves. Furthermore, one, or two or more, parasitic elements 350 are disposed on one side of feed element 102 in excitating direction 326, and also one, or two or more, parasitic elements 360 are disposed on its other side. Parasitic elements 350 and 360 which are arrayed along the excitating direction 326 do not have any through holes and are always float, and accordingly they make almost no contribution to changing the radiating direction of the radio waves.

Figure 42A:
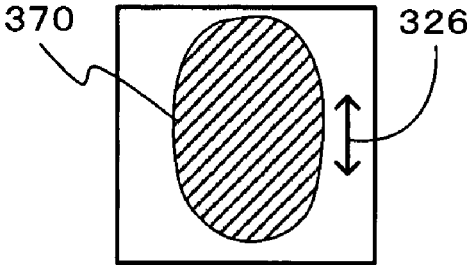
FIG. 42 is a plan view showing, in this fifteenth embodiment, a situation in which the radio beam is more tightly restricted when the number of the parasitic elements is increased.
Figure 42B:
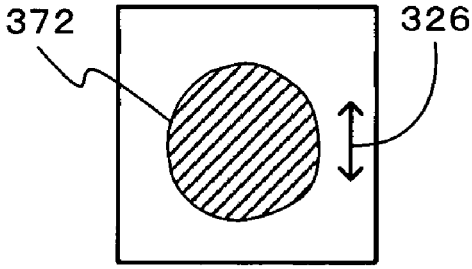

FIG. 42A shows, for the fifteenth embodiment described above, the planar shape of the radio beams which are emitted from this antenna when the number of parasitic elements 350 on one side which do not contribute to the change of the radiating direction of the radio waves and the number of parasitic elements 360 on the other side is made to be one on both sides, and FIG. 42B shows the planar shape of the emitted radio waves when the number of parasitic elements 350 on the one side and the number of parasitic elements 360 on the other side are made to be three on both sides.

In comparison with radio wave shape 370 shown in FIG. 42A, it will be understood that radio wave shape 372 shown in FIG. 42B is more finely constricted in the excitating direction 326 (in other words in the direction in which parasitic elements 350 and 360 are arrayed). That is to say, parasitic elements 350 and 360 make almost no contribution to changing the radiating direction of the radio waves. While they make a contribution to form the radio beams which are more finely constricted and have good directivity by preventing from spreading out or diffusing of the radio waves.

Figure 43A:
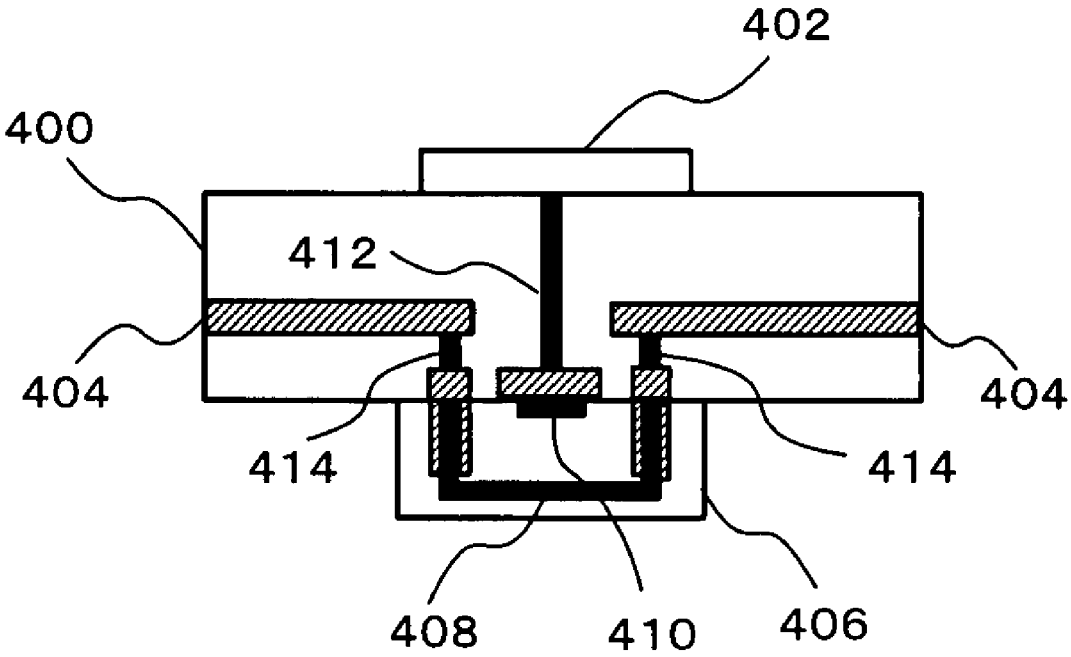
FIG. 43 is a sectional view showing the OFF state of a MEMS switch which is suitable for application for controlling the inclination of a radio beam.
FIG. 43B is a sectional view showing the same MEMS switch in its ON state.
Figure 43B:
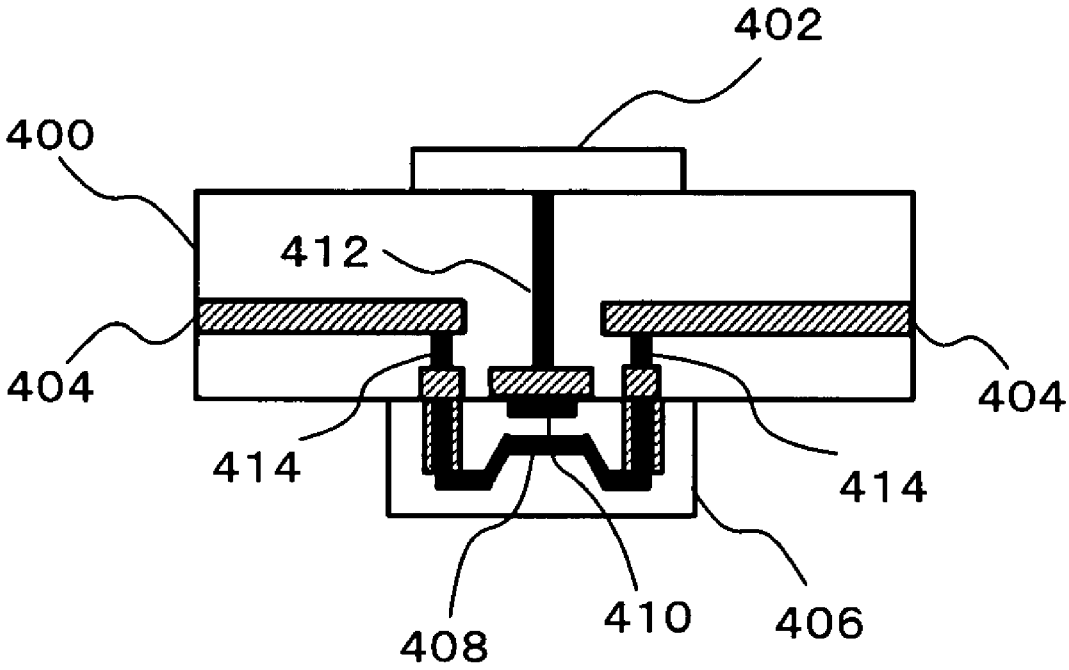

FIGS. 43A and 43B show an example of a construction for a switch which can be employed for turning ON and OFF the through holes of the microstrip antennas of the various structures described above.

Switch 406 shown in FIGS. 43A and 43B is a switch according to the MEMS (Micro Electro Mechanical System) technique (hereinafter termed an MEMS switch) for opening and closing a connection line between antenna element (for example a parasitic element) 402 and ground electrode 404. FIG. 43A shows the OFF state of MEMS switch 406, and FIG. 43B shows its ON state. MEMS switch 406 has movable electrical contact point 408 and fixed electrical contact point 410. One of these, for example fixed electrical contact point 410, is connected to antenna element 402 via through hole 412, while the other, for example movable electrical contact point 408, is connected to ground electrode 404 via through hole 414. It should be noted that fixed electrical contact point 410 and movable electrical contact point 408 within MEMS switch 406 are mechanically separated and do not contact one another, not only in the OFF state shown in FIG. 43A as is a matter of course, but even in the ON state shown in FIG. 43B as well. That is to say, in the ON state shown in FIG. 43B, a small gap is still present between two electrical contact points 408 and 410, while, in the OFF state shown in FIG. 43A, this gap becomes much greater. By employing a MEMS switch of this type of structure, it is possible to furnish a satisfactory ON state and OFF state in a high-frequency band such as from 1 GHz to several hundreds of GHz.

This theory will now be explained with reference to FIGS. 44 through 46.

Figure 44A:
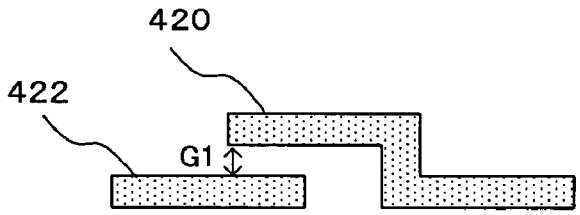
FIG. 44A is a sectional view showing the OFF state of electrical contact points of a prior art type MEMS switch.
Figure 44B:
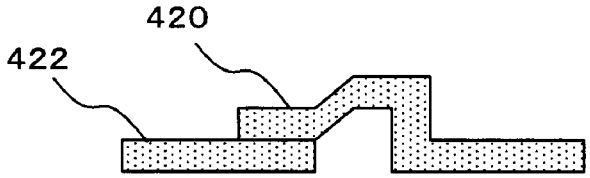
FIG. 44B is a sectional view showing the ON state of these electrical contact points.

FIG. 44A and FIG. 44B respectively show the nominal OFF state and ON state of electrical contact points 420 and 432 of a conventional type MEMS switch. Furthermore, FIG. 45A and FIG. 45B respectively show the nominal OFF state and ON state of electrical contact points 408 and 410 of MEMS switch 406 shown in FIGS. 43A and 43B.

Figure 45A:
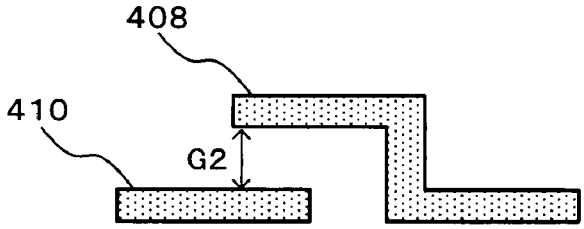
FIG. 45A is a sectional view showing the OFF state of electrical contact points of the MEMS switch shown in FIG. 43.
Figure 45B:
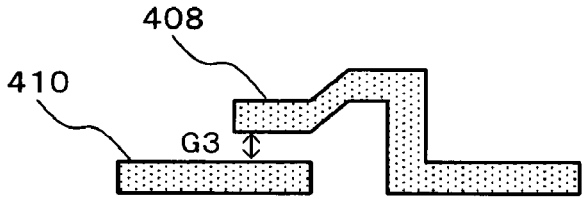
FIG. 45B is a sectional view showing the ON state of these electrical contact points.

As shown in FIG. 44A and FIG. 44B, with a conventional type MEMS switch, in the nominal OFF state electrical contact points 420 and 422 are separated and slight gap G1 is opened up between them, while, in the nominal ON state, they are mechanically contacted together. However although, with slight gap G1 shown in FIG. 44A, a substantially OFF state is established in the low-frequency band, a substantially ON state is established in the high-frequency band. By contrast, with MEMS switch 406 shown in FIG. 45A and FIG. 45B, in the nominal OFF state, electrical contact points 408 and 410 are separated by sufficiently large gap G2, while, in the nominal ON state, they are still separated by slight gap G3. Sufficiently large gap G2 which is present between electrical contact points 408 and 410 as shown in FIG. 45A engenders a substantial OFF state even in the high-frequency band. Furthermore, even though slight gap G3 is present between electrical contact points 408 and 410 as shown in FIG. 45B, a substantial ON state is still engendered in the high-frequency band.

With the objective of controlling the inclination of the radio beam, it is much more important for the switch to furnish a state which is close to a true OFF state, than for the switch to furnish a state which is close to a true ON state. The reason is that the smaller is the amount of transmission of the high-frequency through the through hole, the larger is the sensitivity of change of the inclination angle of the radio beam with respect to change of the transmission amount of the high-frequency via the through hole. Accordingly, the above described switch 406, in which a substantial OFF state is furnished for high-frequency, is suitable for application to control of the inclination of a radio beam.

Figure 46A:
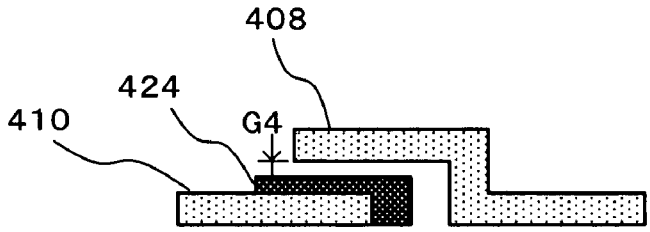
Figure 46B:
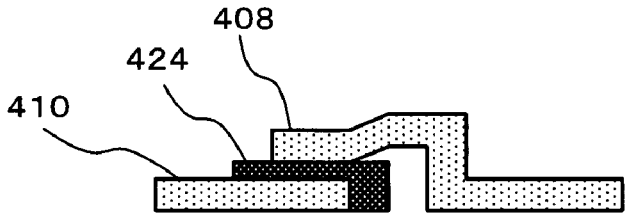
FIG. 46B is a sectional view showing the ON state of the same electrical contact points.

FIG. 46A and FIG. 46B show a variant embodiment for the electrical contact points of a switch which is suitable for application to controlling the inclination of the radio beam. FIG. 46A shows the OFF state, while FIG. 46B shows the ON state.

As shown in FIG. 46A and FIG. 46B, thin layer 424 which is made from a dielectric material or an insulating material, such as a layer of silicon oxide, is provided between electrical contact points 408 and 410. As shown in FIG. 46A, due to thin insulation layer 424, even though only small gap G4 is present between electrical contact points 408 and 410, a substantial OFF state is furnished with respect to high-frequency. In the state shown in FIG. 46B, by disappearing gap G4 between electrical contact points 408 and 410, a substantially ON state is furnished with respect to high-frequency, even though thin insulation layer 424 is still present.

Figure 47:
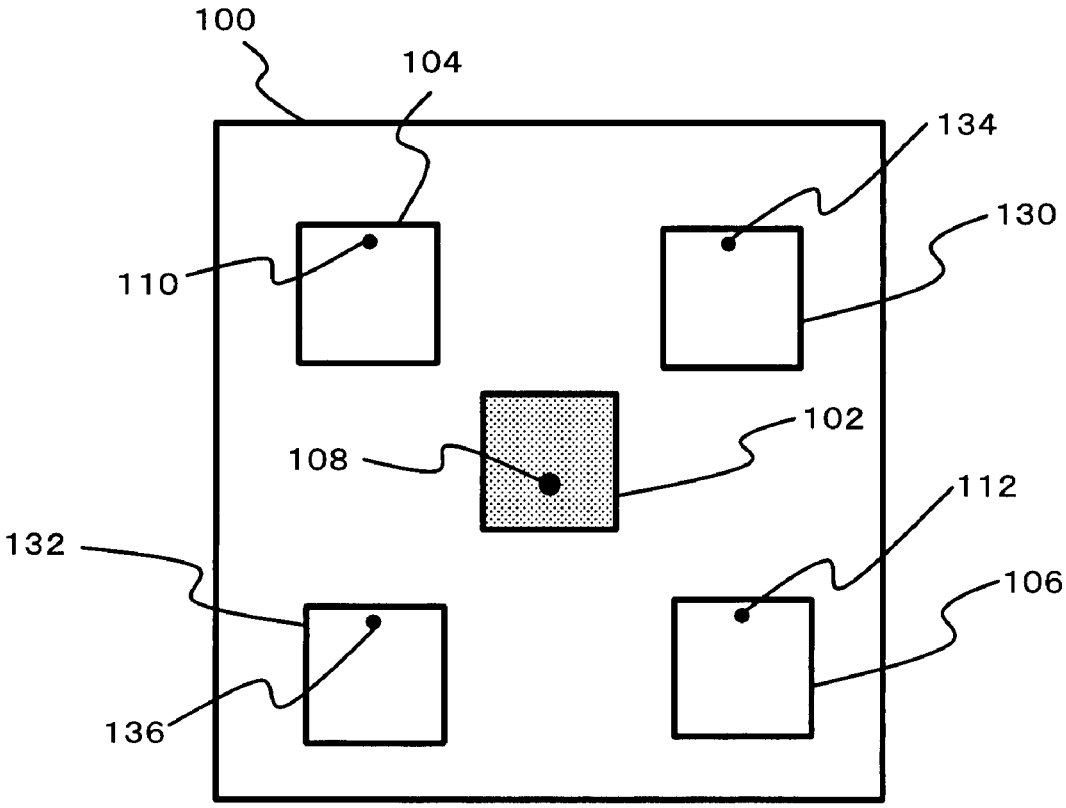
FIG. 47 is a plan view of a microstrip antenna according to a sixteenth embodiment of the present invention.

FIG. 47 is a plan view of a microstrip antenna according to a sixteenth embodiment of the present invention.

With this microstrip antenna shown in FIG. 47, to compare it with the one shown in FIG. 13, the arrangement of parasitic elements 104, 106, 130, and 132 is different. That is, by contrast to the arrangement shown in FIG. 13 in which parasitic elements 104, 106, 130, and 132 were disposed in directions with respect to feed element 102 which were parallel to and at right angles to it's the excitating direction, with the arrangement shown in FIG. 47, parasitic elements 104, 106, 130, and 132 are disposed in directions with respect to feed element 102 which are slanting with respect to the excitating direction, for example being angled at 45 degree with respect thereto. With the electrode arrangement shown in FIG. 47, the radio beam is more tightly constricted as it proceeds along the excitating direction. In this connection, with the electrode arrangement shown in FIG. 13, the radio beam widens out as it proceeds along the radiating direction. Accordingly, the electrode arrangement shown in FIG. 47 is comparatively more suitable for application to detection of a human body or a physical body accurately in a narrow range. While, the electrode arrangement shown in FIG. 13 is more suitable for application to detection of a human body or a physical body in a wide range.

Figure 48:
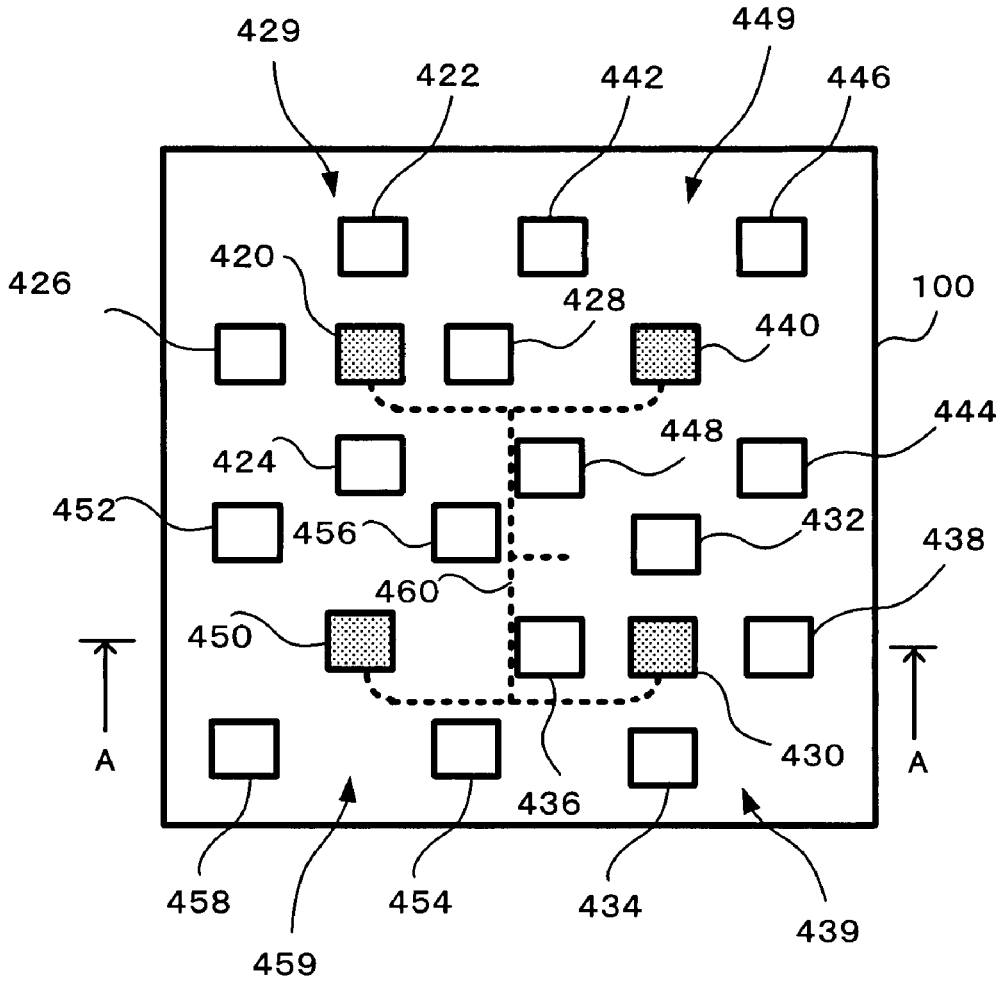
FIG. 48 is a plan view of a microstrip antenna according to a seventeenth embodiment of the present invention.
Figure 49:
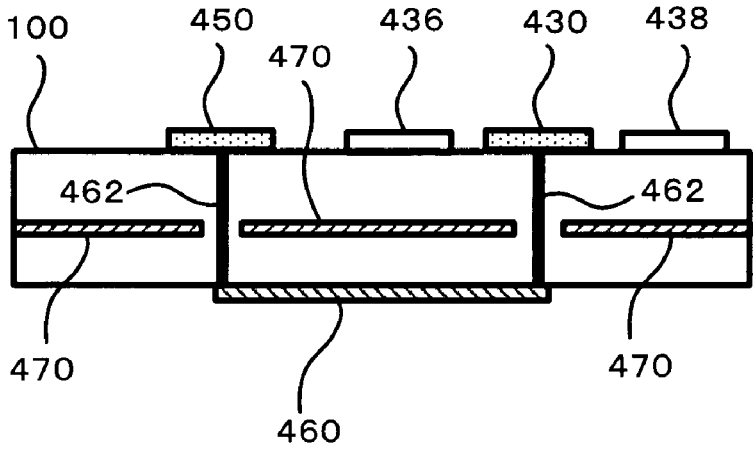
FIG. 49 is a sectional view of FIG. 48 along line A-A.
Figure 50:
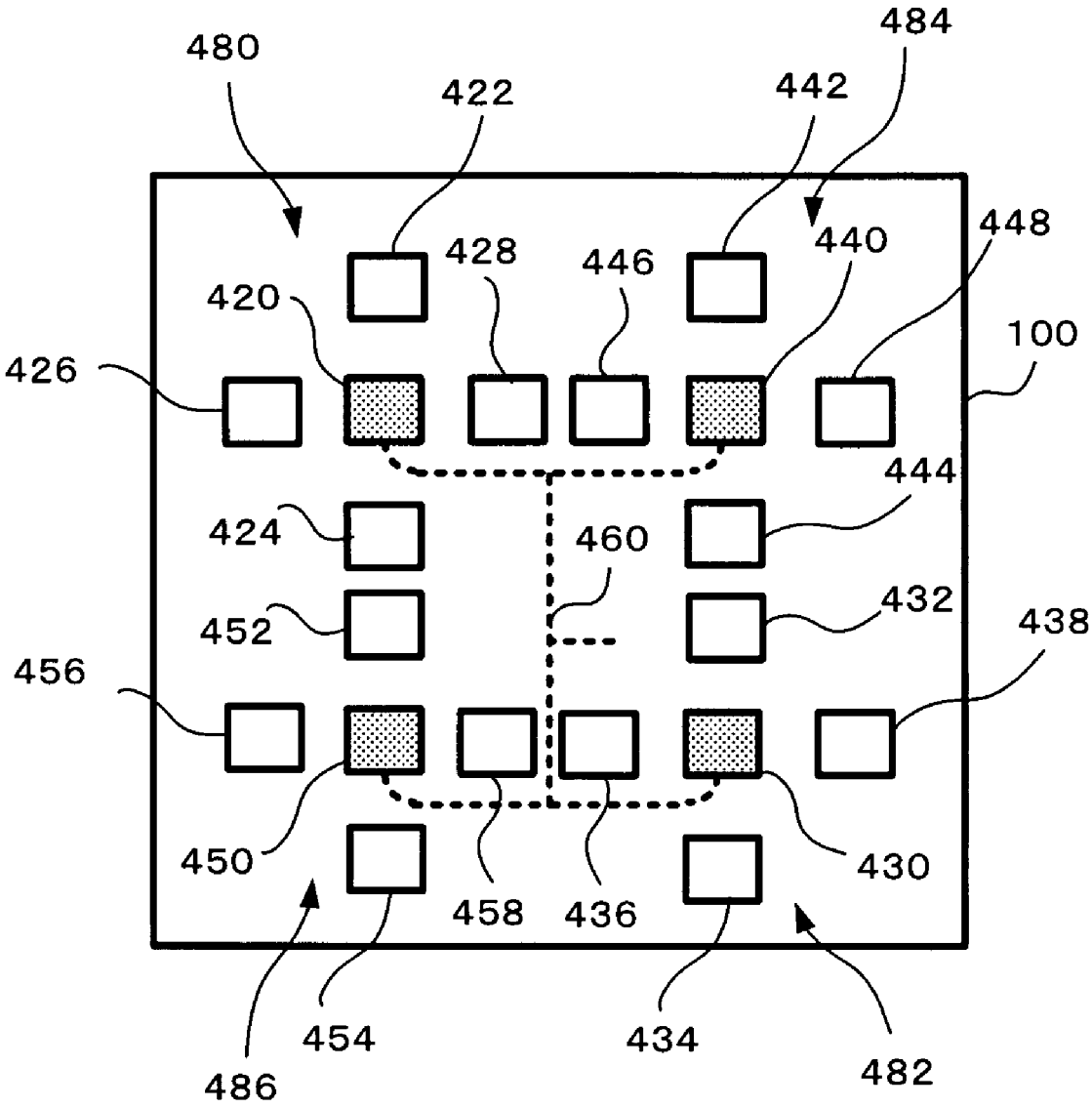
FIG. 50 is a plan view of a microstrip antenna according to an eighteenth embodiment of the present invention.

FIG. 48 is a plan view of a microstrip antenna according to a seventeenth embodiment of the present invention, and FIG. 49 is a sectional view of FIG. 48 along line A-A. For correlation with the embodiment of FIG. 49, FIG. 50 shows a plan view of a microstrip antenna according to an eighteenth embodiment of the present invention.

With the microstrip antenna shown in FIG. 48, two sub-antennas 429 and 439 which have the electrode arrangement shown in FIG. 13 and two sub-antennas 449 and 459 which have the electrode arrangement shown in FIG. 47 are arranged in the form of a 2×2 matrix. In other words, in first sub-antenna 429, parasitic elements 422, 424, 426, and 428 are arranged with respect to feed element 420 in a positional relationship like the one shown in FIG. 13. In the same manner, in second sub-antenna 439 as well, parasitic elements 432, 434, 436, and 438 are arranged with respect to feed element 430 in a positional relationship like the one shown in FIG. 13. On the other hand, in third sub-antenna 449, parasitic elements 442, 444, 446, and 448 are arranged with respect to feed element 440 in a positional relationship like the one shown in FIG. 47. Moreover, in the same manner, in fourth sub-antenna 459 as well, parasitic elements 452, 454, 456, and 458 are arranged with respect to feed element 450 in a positional relationship like the one shown in FIG. 47. And two sub-antennas 429 and 439 which have the electrode arrangement shown in FIG. 13, and two sub-antennas 449 and 459 which have the electrode arrangement shown in FIG. 47, are arranged in complementary positions in a 2×2 matrix. In other words, two sub-antennas 429 and 439 which have the electrode arrangement shown in FIG. 13 are disposed at positions at the upper left and the lower right in FIG. 48. While two sub-antennas 449 and 459 which have the electrode arrangement shown in FIG. 47 are disposed at positions at the upper right and the lower left in FIG. 48. All of the feed elements and the parasitic elements of all of sub-antennas 429, 439, 449, and 459 are arranged on the front surface of substrate 100. By contrast, feed line 460 for supplying high-frequency electrical power to feed electrodes 420, 430, 440, and 450 is provided upon the rear surface of substrate 100, as shown in FIG. 49, and is connected to feed electrodes 420, 430, 440, and 450 via through holes 462, 462, . . . . Reference numeral 470 in FIG. 49 denotes a ground electrode which is at ground electrical potential, and each of the above described parasitic elements is connected thereto via a through hole and a switch (not shown in the drawings).

In this manner it is possible to constrict the main beam of the radio waves effectively and tightly, with a simple construction in which a plurality of sub-antennas having its own feed element are provided upon the same substrate. The shape of the main beam of the radio wave is influenced by the distance between the feed elements. If the gaps between the feed elements become too wide, unnecessary side lobes are generated though the main beam is tightly constricted. In order to suppress such side lobes, it is desirable for the gaps between the feed elements to be approximately $\lambda/2$ to $2\lambda/3$. Here $\lambda$ is the wavelength of the radio waves in the air. If a plurality of sub-antennas having this order of gap between the feed elements are disposed upon the same substrate, and if, as with the microstrip antenna shown by way of example in FIG. 50, all of sub-antennas 480, 482, 484, and 486 have the same arrangement of electrodes, interference may be created between those parasitic elements because the gaps between the adjacent parasitic elements of the sub-antennas may become too small. For example, with the microstrip antenna shown in FIG. 50, interference may take place between parasitic elements 424 and 452, between parasitic elements 444 and 432, between parasitic elements 428 and 446, and between parasitic elements 458 and 436. On the other hand, with the microstrip antenna shown in FIG. 48, since sub-antennas 429, 439, 449, and 459 having different electrode arrangements are arranged in a complementary, the gaps between the parasitic elements of the adjacent sub-antennas are reasonably large, accordingly the interference between the parasitic elements is small, even though the gaps between the feed elements are as small as described above.

Figure 51:
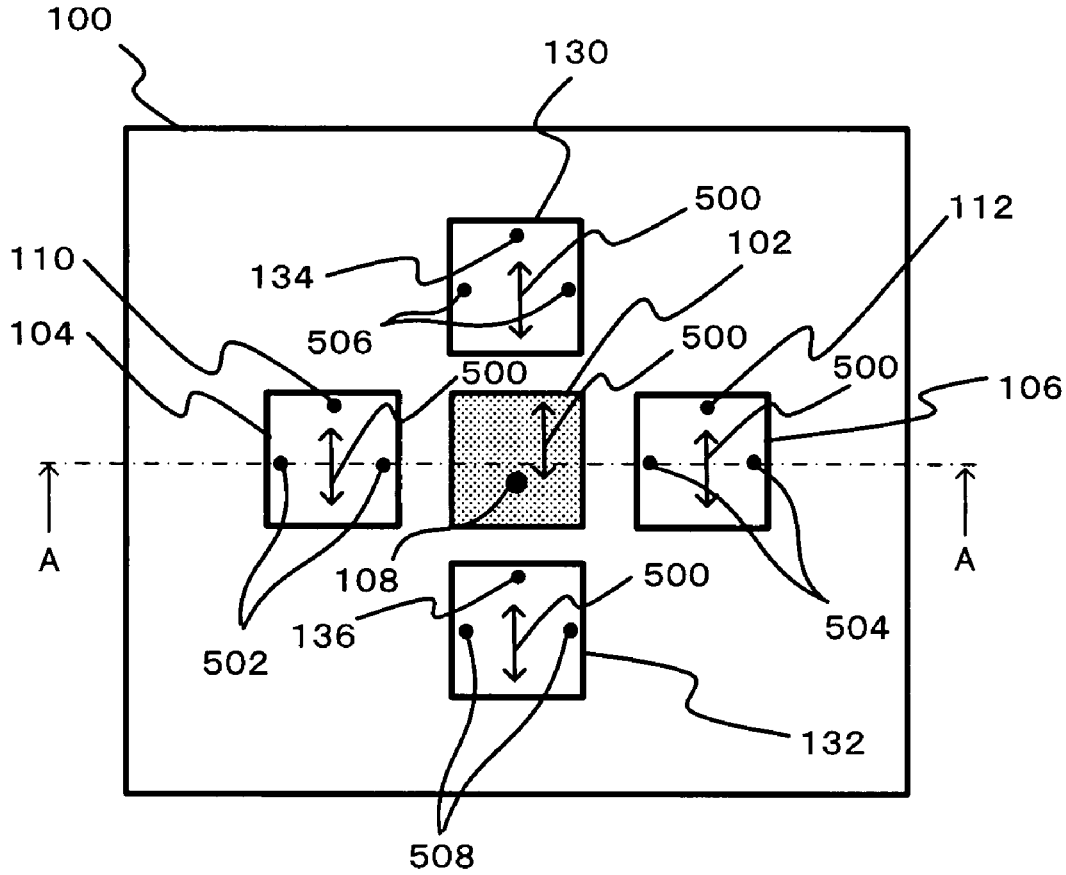
FIG. 51 is a plan view of a microstrip antenna according to a nineteenth embodiment of the present invention.

FIG. 51 is a plan view of a microstrip antenna according to a nineteenth embodiment of the present invention. And FIG. 52 is a sectional view of FIG. 51 along line A-A.

Figure 52:
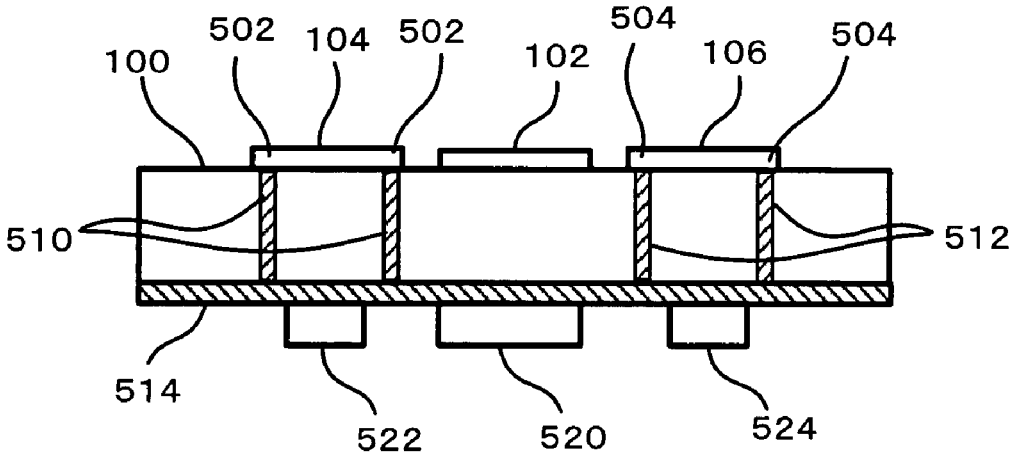
FIG. 52 is a sectional view of FIG. 51 along line A-A.

Along with the microstrip antenna shown in FIGS. 51 and 52 having the same structure as the microstrip antenna shown in FIG. 15. Furthermore, to each of parasitic elements 104, 106, 130, and 132, there are added one or more (as shown in the figures, two) points 502, 504, 506, and 508 which are always grounded. As shown in FIG. 52, each of constant grounded points 502, 504, 506, and 508 is always connected via through hole 510 and 512 to ground electrode 514 which is supplied with ground level (although only through holes 510 and 512 of ground points 502 and 504 are shown in FIG. 52, the same is the case for the other ground points 506 and 508). Constant grounded points 502, 504, 506, and 508 are arranged at positions in the vicinity of the central portions of the outer edges (for example, the outer edges on the left side and the right side in FIG. 51) of parasitic elements 104, 106, 130, and 132 which are orthogonal to excitating direction 500 of parasitic elements 104, 106, 130, and 132 (this is normally the same as the excitating direction of feed element 102, and is, for example, the vertical direction in FIG. 51) when parasitic elements 104, 106, 130, and 132 are float (i.e. are not connected to ground electrode 514). It should be understood that, in FIG. 52, reference numeral 520 denotes an oscillator which supplies high-frequency electrical power to feed line 108 of feed element 102. While reference numerals 522 and 524 denote switches for connecting and disconnecting between ground points 110 and 112 of parasitic elements 104 and 106 for controlling the radiating direction of the radio waves and ground electrode 514.

By appending constant grounded points 502, 504, 506, and 508 as described above, the following benefits are obtained. That is, if the gaps between feed element 102 and parasitic elements 104, 106, 130, and 132 are quite narrow, the electromagnetic coupling force between the feed element and the parasitic elements (in other words the force by which the feed element excites the parasitic elements) is quite large. And due to this, it may happen that parasitic elements 104, 106, 130, and 132 are still in an excited state, even if ground points 110, 112, 134, and 136 of parasitic elements 104, 106, 130, and 132 for controlling the radiating direction of the radio waves are connected to ground level, just by the excitating direction of parasitic elements 104, 106, 130, and 132 being changed to a direction orthogonal to original excitating direction 500. In this case, the problem arises that the radiating direction of the radio waves is not inclined, since the amplitude of the high-frequency electrical currents (voltages) in parasitic elements 104, 106, 130, and 132 does not decrease. By contrast, constant grounded points 502, 504, 506, and 508, which are provided in the positions described above upon parasitic elements 104, 106, 130, and 132, exert their operation to suppress excitation in the direction which is orthogonal to the above described original excitating direction 500. This is based upon the same theory that, when ground points 110, 112, 134, and 136 for controlling the radiating direction of the radio waves are connected to ground level, they exert their operation to suppress excitation in the original direction of excitation 500. Accordingly, with the microstrip antenna shown in FIGS. 51 and 52, the amplitudes of the electrical currents (voltages) in parasitic elements 104, 106, 130, and 132 are decreased, and the radiating direction of the radio waves becomes inclined as ground points 110, 112, 134, and 136 for controlling the radiating direction of the radio waves are connected to ground level, even if the gaps between feed element 102 and parasitic elements 104, 106, 130, and 132 are quite narrow.

Figure 53:
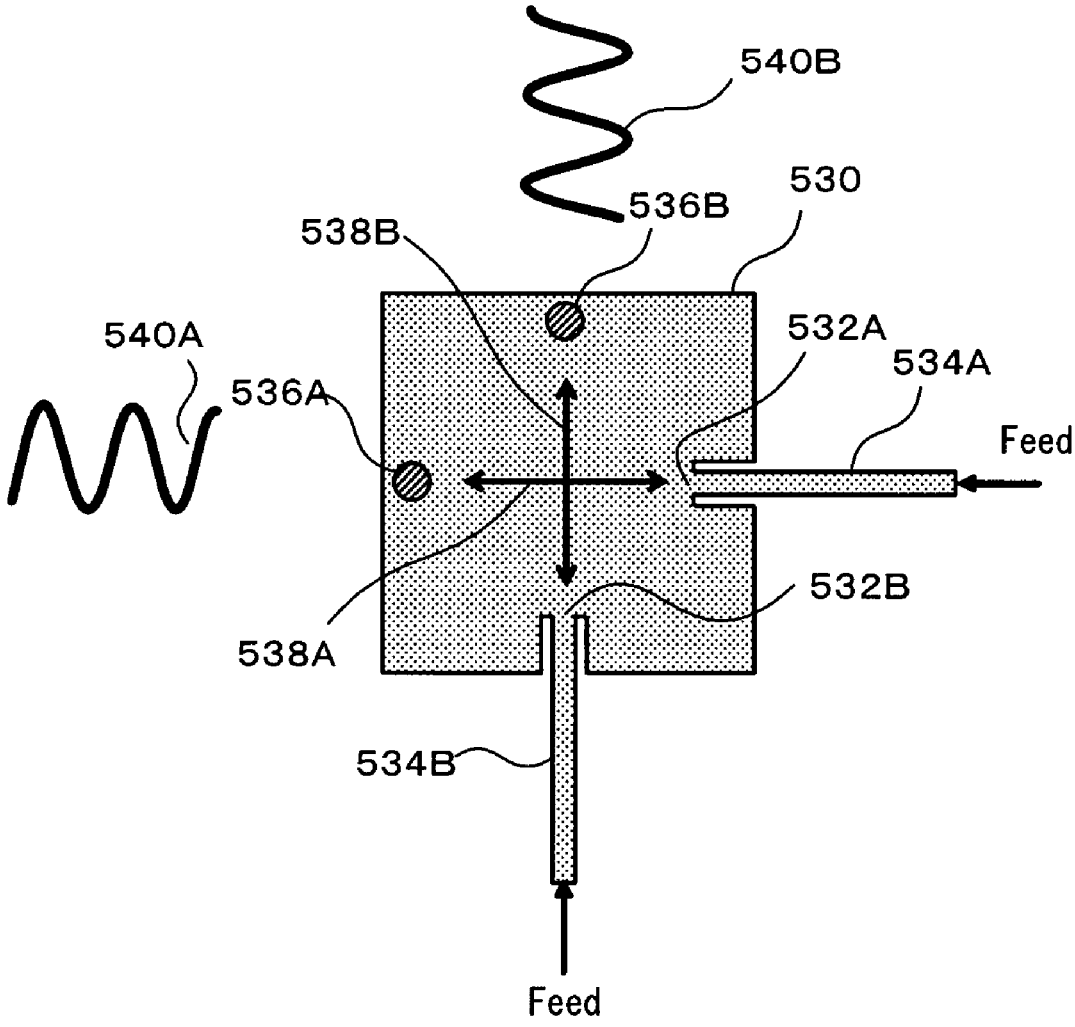
FIG. 53 is a plan view showing a variant embodiment of a feed element which can be employed in the microstrip antenna according to the present invention.

FIG. 53 shows a variant embodiment of a feed element which can be employed in the microstrip antenna according to the present invention.

As shown in FIG. 53, two feed points 532A and 532B are provided respectively in the vicinity of the central portions of two mutually orthogonal outer edges of feed element 530 (a square or rectangular thin metallic layer formed upon the substrate (the background in the figure)), for example on its lower side and its right side edges in the figure. And feed lines 534A and 534B are connected to these feed points 532A and 532B respectively. Here, feed lines 534A and 534B are microstrip lines which are formed on the surface of the substrate on the same side as feed element 530 in the example shown in the figure. Instead of this, it would also be acceptable to utilize microstrip lines which are formed upon the surface of the opposite side of the substrate, and which are connected to feed points 532A and 532B via through holes. Feed lines 534A and 534B apply to feed points 532A and 532B with high-frequency electricity having the same frequencies, or mutually different frequencies. The length of feed element 530 in the horizontal direction is chosen to be a length which is suitable for excitation at the frequency of the high-frequency which is applied to the right side feed point 532A, in other words, is chosen to be about ½ of the wavelength λgA of the radio waves at that frequency upon the substrate. In the same manner, the length of feed element 530 in the vertical direction is chosen to be a length which is suitable for excitation at the frequency of the high-frequency which is applied to the lower side feed point 532B, in other words, is chosen to be about ½ of the wavelength λgB of the radio waves at that frequency upon the substrate. Accordingly, the feeding to feed point 532A on the right side excites feed element 530 in horizontal direction 538A in the figure, while by contrast the feeding to feed point 532B on the lower side excites feed element 530 in vertical direction 538B in the figure.

Furthermore, two ground points 536A and 536B are provided respectively in the vicinity of the central portions of two outer edges (extreme edges) of feed element 530 which are positioned on the opposite sides in the excitating directions from the outer edges in the vicinity of feed points 532A and 532B, for example on its upper side and its left side edges in the figure, and through holes not shown in the figure are connected to ground points 536A and 536B by being pierced through the substrate. In the same way as in the various embodiments described above, ground points 536A and 536B can be connected at any desired time, by the ON/OFF actuation of switches not shown in the figures connected to these through holes respectively, to ground electrodes at ground electrical potential (not shown in the drawings) (for example, provided upon the opposite side of the substrate). When only one of the two ground points 536A and 536B is connected to the ground electrode by the actuation of these switches, the excitation by the feed point which is upon the opposite side to this one ground point is made to be substantially ineffective, and only the excitation of the one on the other side becomes effective. For example, if ground point 536B on the upper side in the figure is connected to the ground electrode, the excitation in the vertical direction due to feed point 532B on the lower side is made to be substantially ineffective, and only the excitation in horizontal direction 538A due to feed point 532A on the right side becomes effective. Due to this, radio waves 22A which come to be emitted from the antenna have a oscillatory waveform whose electromagnetic field intensity is in the horizontal direction, which is the same as the excitating direction 538A. On the other hand, if ground point 536A on the left side in the figure is connected to the ground electrode, the excitation in the horizontal direction due to feed point 532A on the lower side is made to be substantially ineffective, and only the excitation in vertical direction 538B due to feed point 532B on the lower side becomes effective. Due to this, radio waves 22B which come to be emitted from the antenna have a oscillatory waveform whose electromagnetic field intensity is in the vertical direction, which is the same as the excitating direction 538B. Furthermore, if the frequencies of the high-frequencies which are supplied to feed points 532A and 532B are different, it is possible to change over the frequency of the radio waves which are emitted by selectively connecting ground points 536A and 536B to the ground electrode by actuation of the switches.

By, in this manner, providing to feed element 530 a plurality of feed points 532A and 532B which excite it in different directions, and ground points 536A and 536B which make these feed points ineffective, and by making any one of feed points 532A and 532B selectively effective by actuation of ground points 536A and 536B, it is possible selectively to emit radio waves whose direction of oscillatory waveform is different. This technique is effective for a vertically polarized type antenna.

Figure 54:
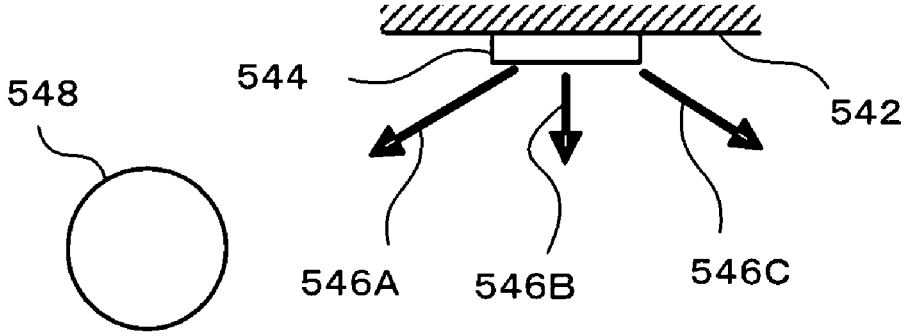
FIG. 54 is a side view showing one preferred application to a microstrip antenna having the feed element shown in FIG. 53.

FIG. 54 shows one preferred application to a microstrip antenna according to the present invention having the feed element shown in FIG. 53.

The application shown in FIG. 54 is body sensor 544 for detecting movement of body 548 such as a human body or the like by utilizing the Doppler effect of radio waves. Body sensor 544 is fitted to, for example, the ceiling surface or wall surface 542 of a room or the like, and internally houses a microstrip antenna according to the present invention (not shown in the drawings) and a Doppler signal processing circuit (not shown in the drawings either) which is connected to this microstrip antenna. The microstrip antenna is used as a transmission antenna for generating radio waves. It would be acceptable to use this microstrip antenna, which is the transmission antenna, as a reception antenna; or it would also be acceptable to provide a reception antenna which is separate from the transmission antenna. This microstrip antenna may have a structure like that of any one of the embodiments described above, and is capable of emitting radio waves in different directions 34A, 34B, and 34C. Furthermore, the feed element of this microstrip antenna has a structure as shown in FIG. 53, and is so adapted that, by it's the excitating direction being varied, the direction of the oscillatory waveform of the radio waves emitted from this microstrip antenna can be changed.

Figure 55:
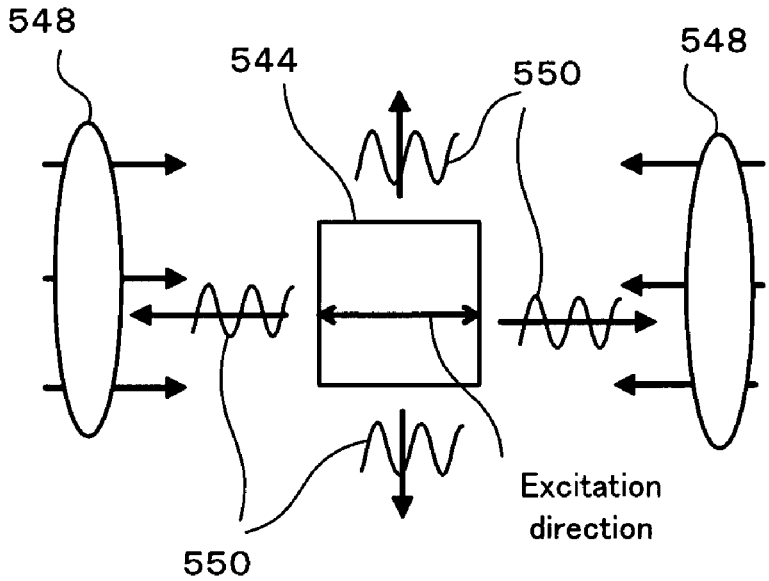
FIG. 55 is a plan view showing the detection characteristic of body sensor 22 shown in FIG. 54 when its excitating direction is the horizontal direction.
Figure 56:
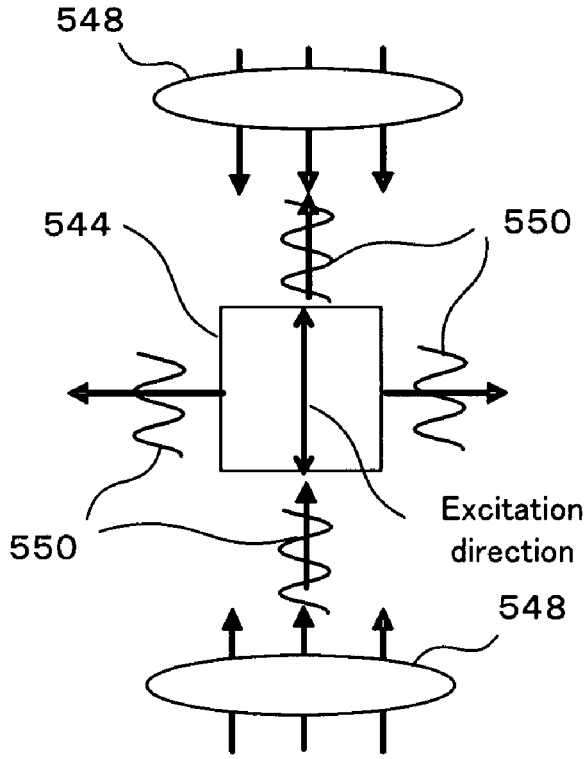
FIG. 56 is a plan view showing the detection characteristic of body sensor 22 shown in FIG. 54 when its excitating direction is the vertical direction.

FIGS. 55 and 56 show changes of detection characteristic which are created by changing of the excitating direction of the microstrip antenna of body sensor 544.

As shown in FIG. 55, when the excitating direction of the microstrip antenna of body sensor 544 is the horizontal direction in the figure, whatever the radiating direction of the radio waves 550 is, the direction of the oscillatory waveform of radio waves 550 is the horizontal direction. In this case, the detection sensitivity of body sensor 544 is the most satisfactory with respect to shifting of body 548 in the horizontal direction, which is the same as the direction of the oscillatory waveform of radio waves 550. On the other hand, as shown in FIG. 56, when the excitating direction of the microstrip antenna is the vertical direction in the figure, the direction of the oscillatory waveform of the electromagnetic field of radio waves 550 is the vertical direction, irrespective of the radiating direction. In this case, the detection sensitivity of body sensor 544 is the most satisfactory with respect to shifting of body 548 in the vertical direction. By changing over the excitating direction in this manner, it is possible to change the component of the direction of shifting of the body in which the detection sensitivity is the most satisfactory. Due to this, by utilizing these different excitating directions in combination, such as for example by changing over between them alternately at high speed, the moving direction of body 548 is estimated from comparing the levels of the Doppler signals which are detected in different excitating directions. Or by logically combining the results of decisions as to whether or not the body has been detected in the different excitating directions, it is possible to detect sensitively, in whatever direction body 548 may shift.

Figure 57:
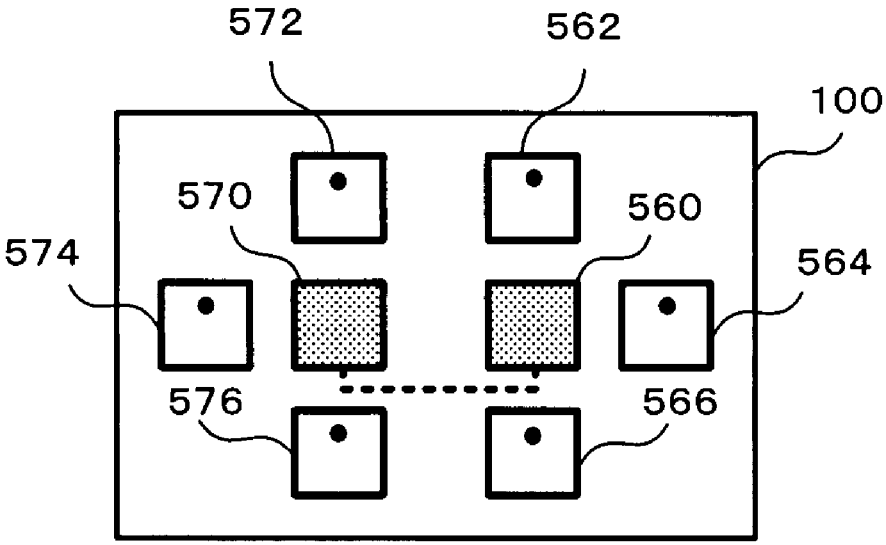
FIG. 57 is a plan view of a microstrip antenna according to a twentieth embodiment of the present invention.

FIG. 57 is a plan view of a microstrip antenna according to a twentieth embodiment of the present invention. And FIGS. 58 and 59 are plan views of variant embodiments of this twentieth embodiment shown in FIG. 57.

With the microstrip antenna shown in FIG. 57, a plurality of (for example, two) feed elements 560 and 570 are disposed adjacent to each other (i.e. with no parasitic elements being placed between them) upon substrate 100, and a plurality of parasitic elements 562, 564, 566, 572, 574, 576 are disposed so as to surround feed elements 560 and 570 in a two dimensional manner (for example, from the two vertical and horizontal directions in the figure). This microstrip antenna has a construction which resembles an antenna array in which a plurality of antennas, each consisting of a single feed element and a plurality of parasitic elements two-dimensionally surrounding it as shown in FIG. 13, are arranged. And it is capable of throttling down the radio beam narrower and extending the arrival distance of the radio beam longer than the antenna shown in FIG. 13. (When applied to a body sensor which uses a radio beam, it is capable of throttling down the body detection range narrower and extending the detection distance further). In order to change the direction of the radio beam, it is possible to control the state of one or a plurality of elements at biasing positions among parasitic elements 562, 564, 566, 572, 574, and 576 to being grounded or floated. In particular, it is possible to change the direction of the radio beam effectively to the right and left by controlling the respective states of groups of the parasitic elements which are disposed symmetrically, for example the group of parasitic elements 562, 564, and 566 on the right side and the group of parasitic elements 572, 574, and 576 on the left side.

Figure 58:
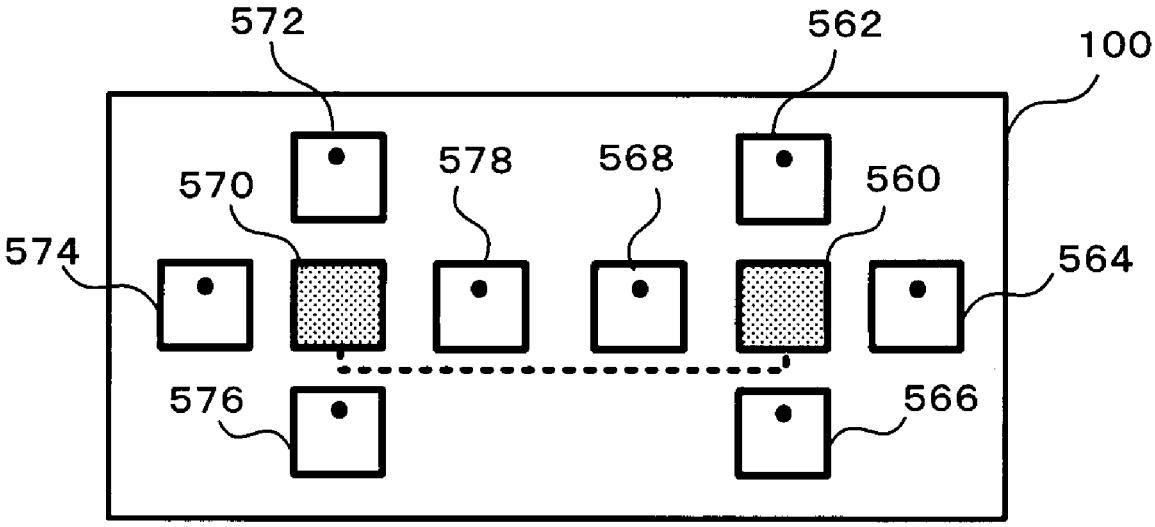
FIG. 58 is a plan view of a variant embodiment of the twentieth embodiment.

The variant embodiment shown in FIG. 58 is an antenna array in which two antennas of the precise construction shown in FIG. 13 are simply arranged. In this variant embodiment, parasitic elements 568 and 578 are present between feed elements 560 and 570, and therefore the distance between feed elements 560 and 570 is inevitably longer. The fact that the distance between feed elements 560 and 570 is long sometimes causes the generation of unnecessary side lobes. By contrast, with the antenna shown in FIG. 57, since feed elements 560 and 570 are provided so as to adjoin one another, accordingly it is simple to prevent the generation of side lobes, since the distance between the two of them may be made as short as suitable.

Figure 59:
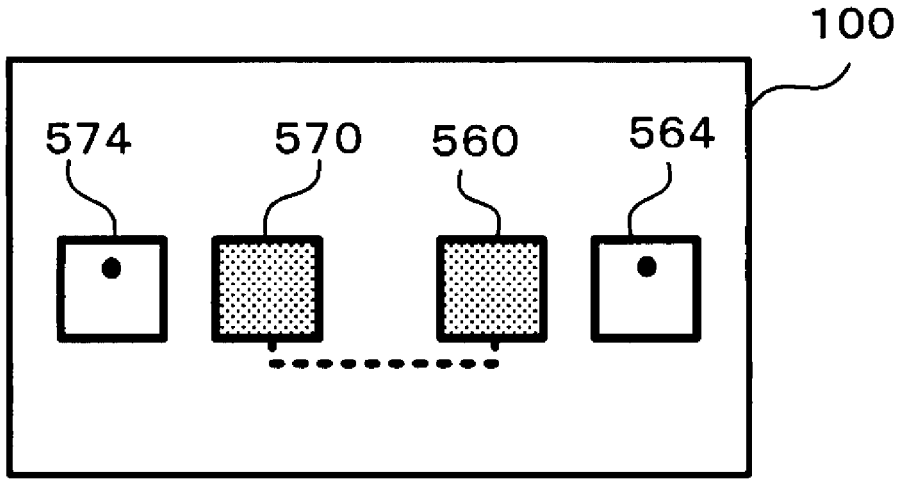
FIG. 59 is a plan view of another variant embodiment of the twentieth embodiment.

In the variant embodiment shown in FIG. 59, parasitic elements 564 and 574 sandwich feed elements 560 and 570, not two dimensionally, but rather one dimensionally from both sides (for example in the horizontal direction). In this variant embodiment, since the power of the radio waves emitted from parasitic elements 564 and 574 is quite small as compared to the radio wave power from feed elements 560 and 570, accordingly sometimes the amount of change of the direction of the radio beams which is obtained by controlling the states of parasitic elements 564 and 574 is too small. By contrast, with the antenna shown in FIG. 57, it is easy to obtain a larger width of change of direction of the radio beam, than in the case of the variant embodiment shown in FIG. 59.

Figure 60:
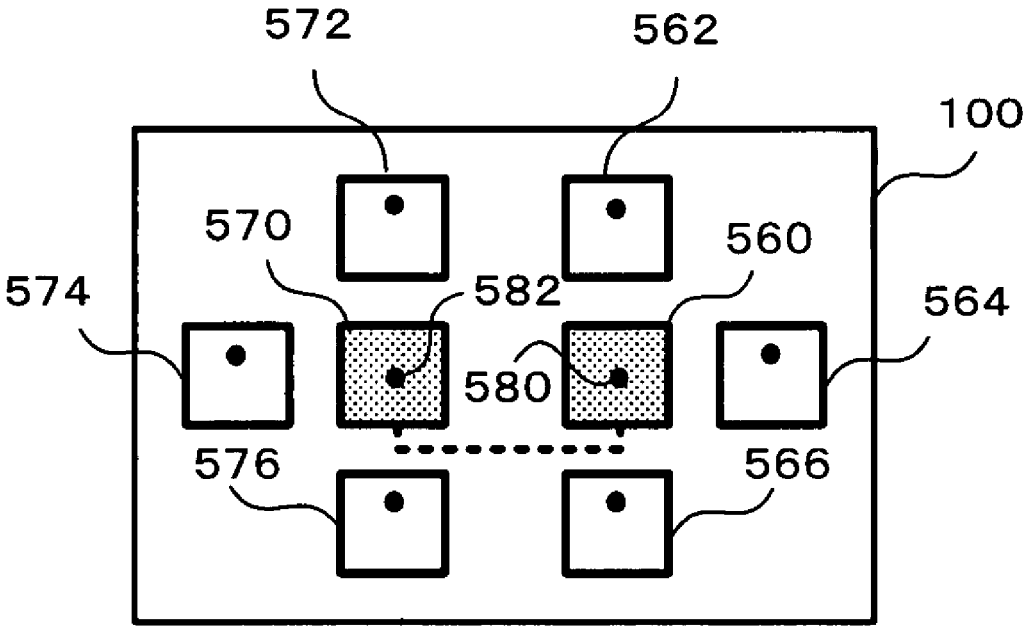
FIG. 60 is a plan view of yet another variant embodiment of the twentieth embodiment.

FIG. 60 shows yet another variant embodiment of the microstrip antenna shown in FIG. 57.

In the antenna shown in FIG. 60, in addition to the structure shown in FIG. 57, ground points 580 and 582 are provided at predetermined spots upon feed elements 560 and 570 (for example at the centers of these elements). In the same manner as the ground points of parasitic elements 562, 564, 566, 572, 574, and 576, ground points 580 and 582 of feed elements 560 and 570 are adapted to be connected to a ground electrode via through holes and switches (not shown in the figure), and to be disconnected from that ground electrode. When one of feed elements 560 and 570 is grounded via its ground point, a high-frequency electrical current phase difference is created between feed elements 560 and 570. And moreover, under the influence thereof, a high-frequency electrical current phase difference is also created between parasitic elements 562, 564, 566, 572, 574, and 576. As a result, the direction of the radio beam is changed. In many cases, the radio beam is inclined in the direction opposite to the side of the feed electrode which has been grounded. For example, when feed electrode 580 on the right side is grounded, the radio beam is inclined to the left side. When, in addition to controlling the grounded states of feed elements 560 and 570 in this manner, control is performed of the grounded states of parasitic elements 562, 564, 566, 572, 574, and 576 as has already been explained. Then the direction of the radio beam can be varied more greatly or more finely. If, for example, it is desired to incline the radio wave through a large angle to the left side, it is possible to ground parasitic elements 572, 574, and 576 on the left side with also grounding feed electrode 580 on the right side. Or, if it is desired to incline the radio beam to the left side by an angle which is smaller than the example above, it is possible to ground parasitic elements 562, 564, and 566 on the right side with also grounding feed electrode 580 on the right side.

Figure 61:
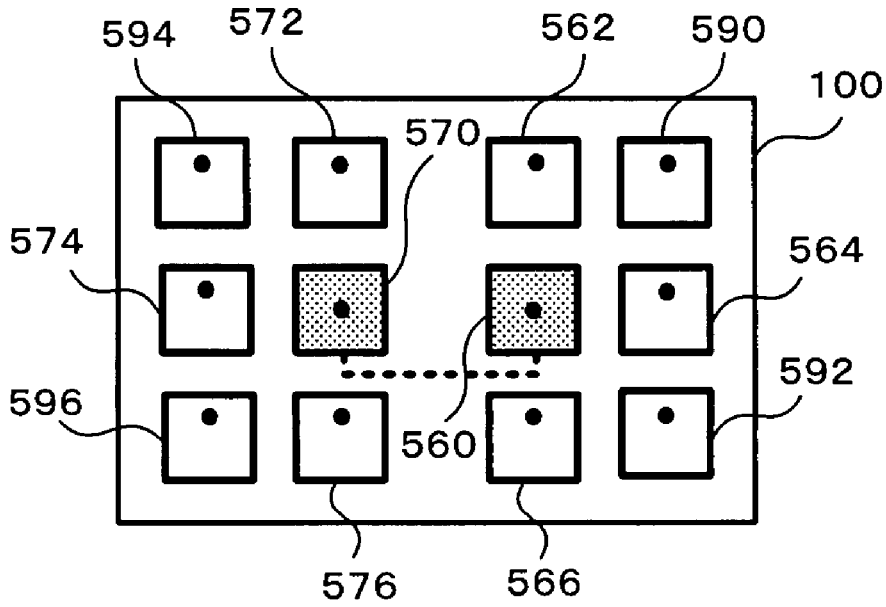
FIG. 61 is a plan view of still yet another variant embodiment of the twentieth embodiment.

FIG. 61 shows still yet another variant embodiment of the microstrip antenna shown in FIG. 57.

With the antenna shown in FIG. 61, more parasitic elements 562, 564, 566, 572, 574, 576, 590, 592, 594, 596 surround feed elements 560 and 570, than in the case of the antenna shown in FIG. 60. Due to this, it is possible to anticipate the beneficial effect that the radio beam is more finely constricted so that the arrival distance of the radio beam is extended, and the beneficial effect that it is possible to control the direction of the radio beam more finely.

Now, during the manufacture of all of the microstrip antennas according to the present invention described above, when performing the impedance matching of the feed portion of the antenna by adjusting the position of the feed point or the like, it is desirable to perform this task in a state in which all of the parasitic elements which have ground points are grounded. If this is done, it is possible to make the matching shift caused when changing over the states of the parasitic elements between ground and float smaller, as compared with the case in which this task is performed with all of the parasitic elements kept to be floated.

Figure 62:
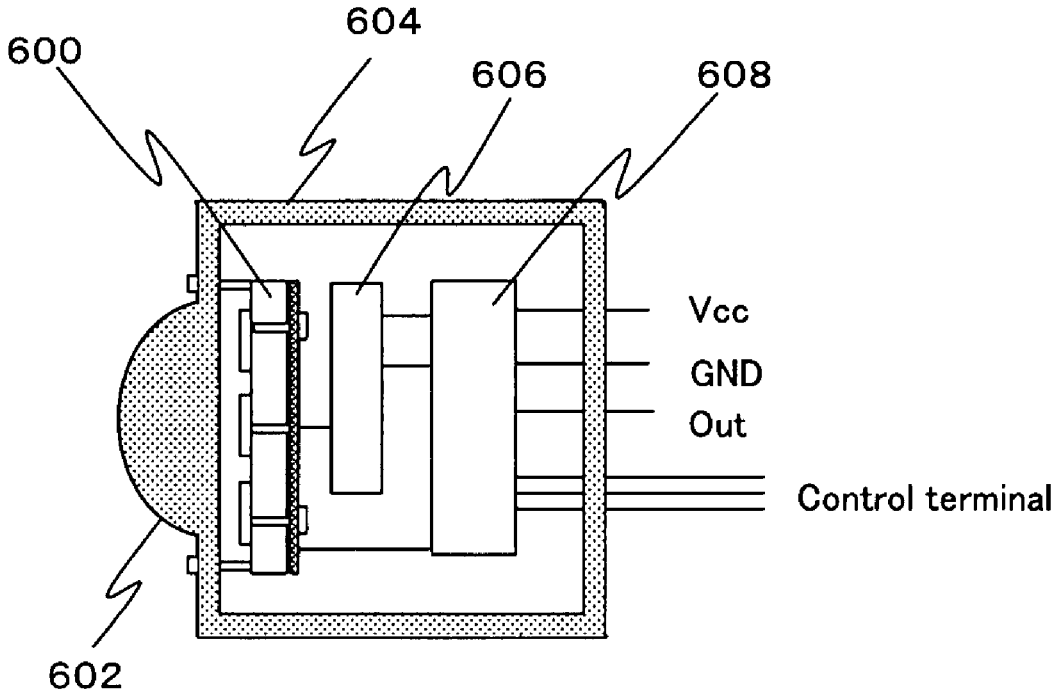
FIG. 62 is a sectional view of a microstrip antenna according to a twenty-first embodiment of the present invention.

FIG. 62 shows a sectional view of a microstrip antenna according to a twenty-first embodiment of the present invention.

With the antenna shown in FIG. 62, convex type dielectric lens 602, for example, is provided at the front of main body 600 of an antenna which has, for example, a construction as shown in FIG. 13 (i.e. in the direction thereof at which the radio beam is emitted after the feed element and the parasitic elements are set). In this embodiment, dielectric lens 602 is formed integrally with casing 604 which is made from a dielectric material. Antenna main body 600, analog circuit unit 606 which includes an oscillator and a wave detection circuit and the like, and digital circuit unit 608 which includes a switch control circuit and a detection circuit (in other words, if this antenna is applied to a body detection device, a circuit which receives the result of this detection and decides upon the presence or absence of a body) and the like are contained within casing 604. As the material for dielectric lens 602, it is desirable for it to be formed from a material whose relative permittivity is comparatively small, for example polyethylene or nylon, or polypropylene or a fluorine type resin material. If non-combustibility or chemical resistance is desired, for example, the use of nylon or polypropylene or the like is desirable, and furthermore, if heat resistance or water resistance is also desired, it is desirable to use, for example, PPS (polyphenylene sulfide) resin. Moreover, if it were desired to make dielectric lens 602 compact or thinner in form, it would also be acceptable to arrange to use a ceramic material whose permittivity is high, such as alumina or zirconia or the like, as the material for the lens main body; and, in order to suppress reflection within the lens, to cover the surface of the lens with a material described above whose relative permittivity is comparatively small.

With this antenna, due to the operation of dielectric lens 602, the radio beam is finely constricted and the gain is increased. If this antenna is applied to a body detection device, it is possible to choose the focal point distance of dielectric lens 602 according to the distance range over which it is desired to perform detection. For example, if this body detection device is installed on a ceiling within a room, and it is desired to detect a body or a human body within the room, it is possible for the focal point distance of dielectric lens 602 to be set to be close to 2.5 m to 3 m, which is the maximum length of the distance detection range since the range for distance detection is approximately within 2.5 m to 3 m.

Now, it would also be possible to employ a method of arranging a plurality of antennas in an array for the purpose to increase the gain, instead of or as well as the above described method of using a dielectric lens. According to this method, the other benefit is also obtained that it is possible to change over the radiating angle of the radio waves in a large number of stages. If the area upon the substrate is limited, it would also be acceptable to use a dielectric lens as well.

Figure 63:
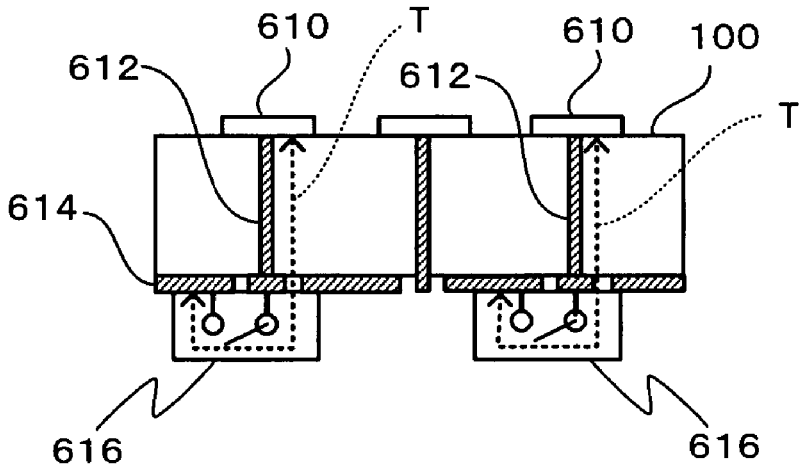
FIG. 63 is a sectional view of a microstrip antenna according to a twenty-second embodiment of the present invention.

FIG. 63 shows a sectional view of a microstrip antenna according to a twenty-second embodiment of the present invention.

The antenna shown in FIG. 63 has a planar construction shown in FIG. 13, for example, and semiconductor switches or MEMS switches are used as switches 616 for grounding parasitic elements 610. Lines for relieving high-frequency upon parasitic elements 610 to ground electrode 614 include through holes 612 and current path inside of switches 616. The impedance of these lines for high-frequency changes according to length T of that line when switch 616 is on. Due to this, even if switch 616 is in the ON state, high-frequency current of a magnitude which corresponds to the length of the line still flows in parasitic element 610.

Figure 64:
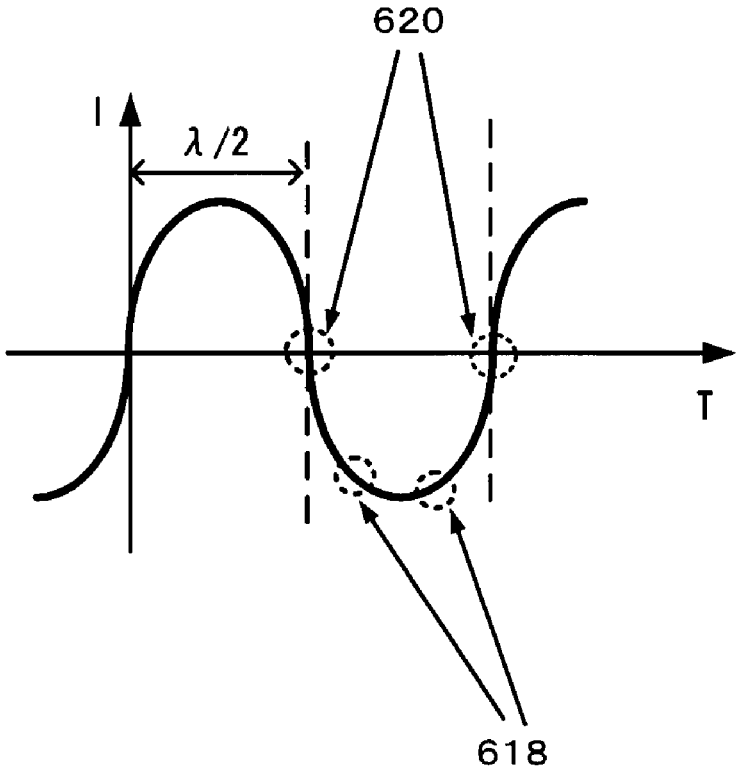
FIG. 64 is a figure showing, for this twenty-second embodiment, the relationship between the length T of a line from parasitic element 610 to ground electrode 614, and the amount of the current which flows in parasitic element 610 when switch 616 is in the ON state.

FIG. 64 is a figure showing the relationship between length T of the lines described above, and the amount of current I which flows in a one of parasitic elements 610 when its switch 616 is in the ON state.

In order to change the direction of the radio beam effectively by turning switches 6160N and OFF, it is ideal for the electrical flow amounts which flow in parasitic elements 610 to be zero when switches 616 are in the ON state. As will be understood from FIG. 64, in order to make the electrical flow amount which flows in parasitic elements 610 to be zero, line length T should be made to be a half integral multiple of the wavelength λg of the high-frequency upon the substrate, as shown by the reference numeral 620. In other words, if line length T is m times λg/2 (where m is a whole number equal to or greater than 1), impedance matching is obtained, and the reflection of high-frequencies to parasitic elements 610 is minimized. On the other hand, when line length T is a length which is different from n times λg/2, the high-frequency is reflected and flows into parasitic element 610 as shown by reference numeral 618. Accordingly, if semiconductor switches or MEMS switches are used as switches 616, it is desirable for length T of each of the lines from parasitic elements 610 to ground element 614 to be made to be λg/2×n (where n is a whole number equal to or greater than 1). In this connection, if mechanical switches are employed as these switches, and parasitic elements 610 and ground electrode 614 are connected using quite a broad conductor area, the problem of phase shift described above is small, as compared with the case in which semiconductor switches or MEMS switches are employed.

Figure 65:
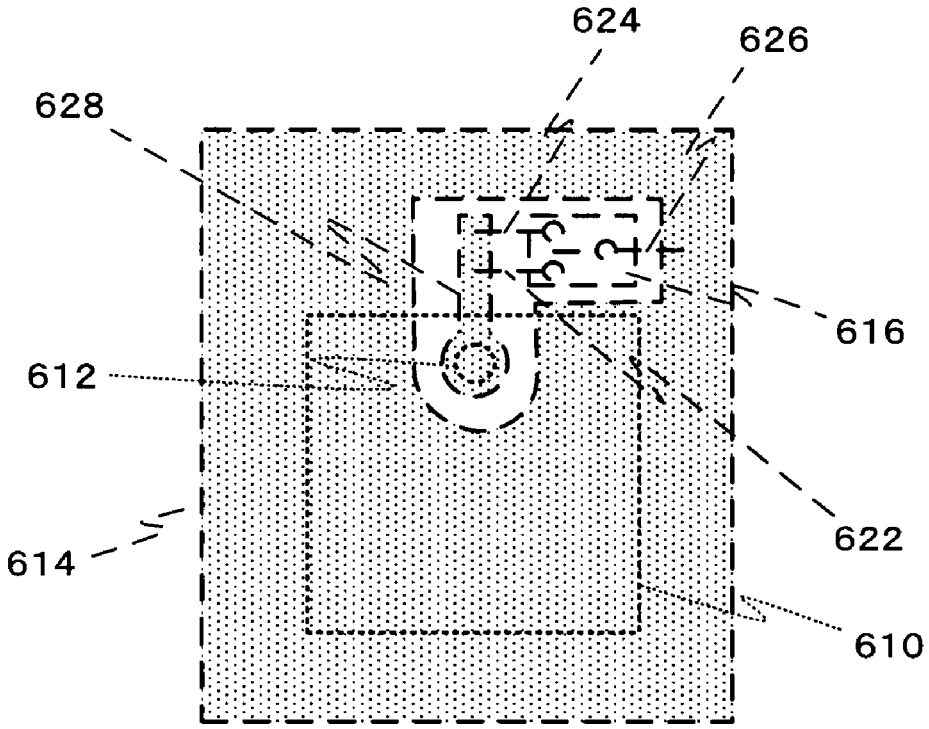
FIG. 65 is a plan view of the rear surface of a variant embodiment of the twenty-second embodiment.

FIG. 65 shows a plan view of the rear surface (the surface on the opposite side to the surface where parasitic element 610 is present, in other words the surface on the side where electrode switch 616 is disposed) of a variant embodiment of the twenty-second embodiment shown in FIG. 63 (only the portion which corresponds to a single one of parasitic elements 610 is extracted).

With the antenna shown in FIG. 65, SPDT type (Single Pole Double Throw: double throw type) MEMS switches or semiconductor switches are employed as switches 616 for switching whether parasitic elements 610 are connected to ground electrode 614. The one end of a long and narrow relay line 628 is connected to the end portion on the rear surface side of through hole 612 from parasitic elements 610, and two selection terminals 622 and 624 of switch 616 are respectively connected at two spots upon this relay line 628 of different line lengths from parasitic elements 610. While ground electrode 614 is connected to one common terminal 626 of switch 616. And the positions upon relay line 628 of two selection terminals 622 and 624 are chosen so that, when one selection terminal 624 is ON, line length T from parasitic element 610 through through hole 612 and switch 616 to ground electrode 614 is a predetermined integer multiple of λg/2 (for example twice, i.e. λg). While, when the other selection terminal 622 is ON, the above described line length T is not a predetermined integer multiple of λg/2 (for example is shorter than λg and longer than 3λg/4).

Figure 66:
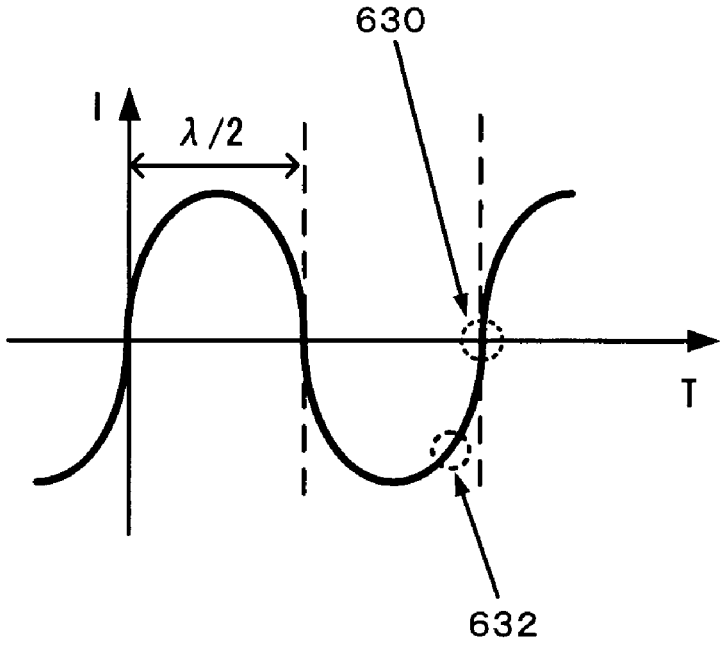
FIG. 66 shows, for the antenna shown in FIG. 65, the change of the electrical current which flows in the parasitic element when the line length T changes.
Figure 67:
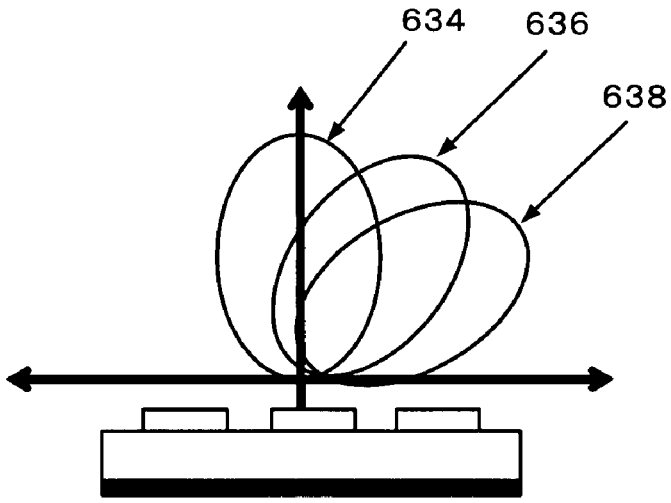
FIG. 67 shows, for the antenna shown in FIG. 65, the change in the radiating direction of the radio beam which is obtained by actuation of switch 616.

FIG. 66 shows the change of the electrical current which flows in parasitic element when line length T changes for the antenna shown in FIG. 65. And FIG. 67 shows the change in the radiating direction of the radio beam which is obtained by actuation of switch 616 for the antenna shown in FIG. 65.

In FIG. 66, reference numeral 630 denotes line length T when one selection terminal 624 of switch 616 is ON, with this being an integer multiple of λg/2 (for example λg), and the electrical current which flows in parasitic element 610 at this time is zero. And reference numeral 632 denotes line length T when the other selection terminal 622 is ON, with this not being an integer multiple of λg/2 (for example being shorter than λg and longer than 3λg/4), and the electrical current which flows in parasitic element 610 at this time is not zero, but is smaller than when switch 616 is OFF. Accordingly, as shown in FIG. 67, since it is possible to change the amount of electrical current which is flowing in the parasitic element in three stages by performing two selections so as to select whether switch 616 is OFF, or whether either one of selection terminals 622 or 624 should be turned ON, therefore it is possible to change the angle of the radio beam which is emitted from this antenna by three stages 634, 636, and 638. By utilizing this theory, it is also possible to arrange to change the angle of the radio beam more finely, with arranging to change over line length T to a larger number of different lengths.

Figure 68:
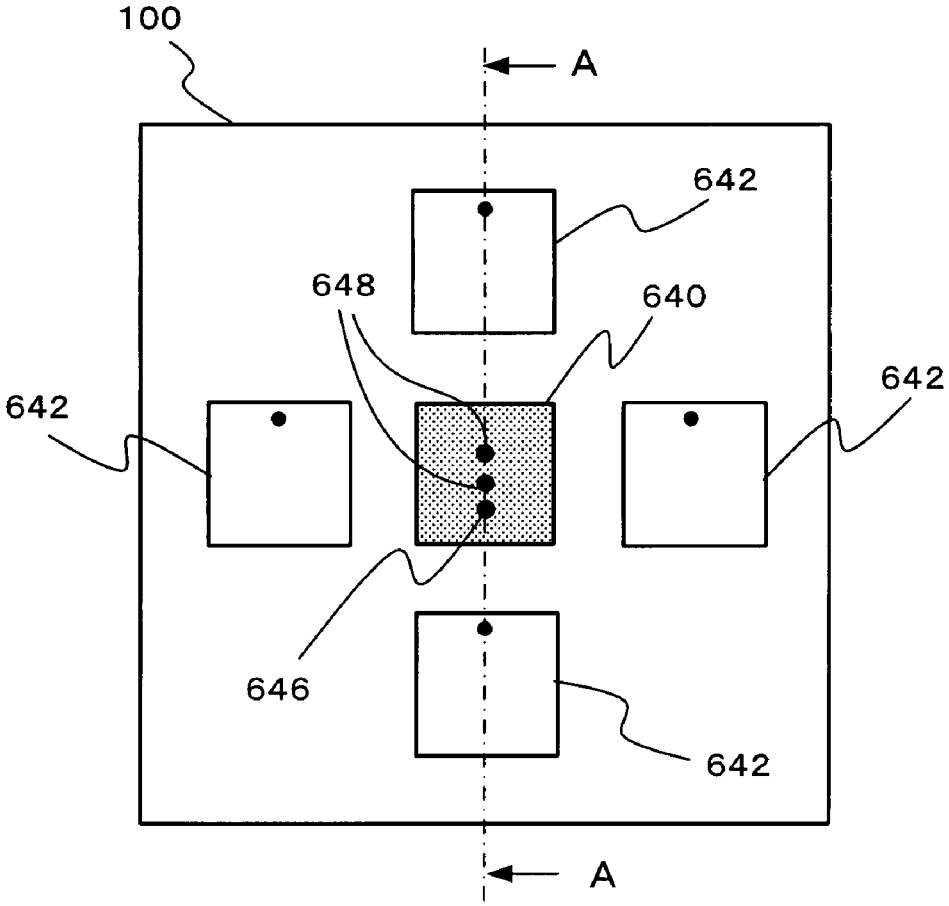
FIG. 68 is a plan view of a microstrip antenna according to a twenty-third embodiment of the present invention.

FIG. 68 shows a plan view of a microstrip antenna according to a twenty-third embodiment of the present invention. And FIG. 69 shows a sectional view of FIG. 68 taken along line A-A.

Figure 69:
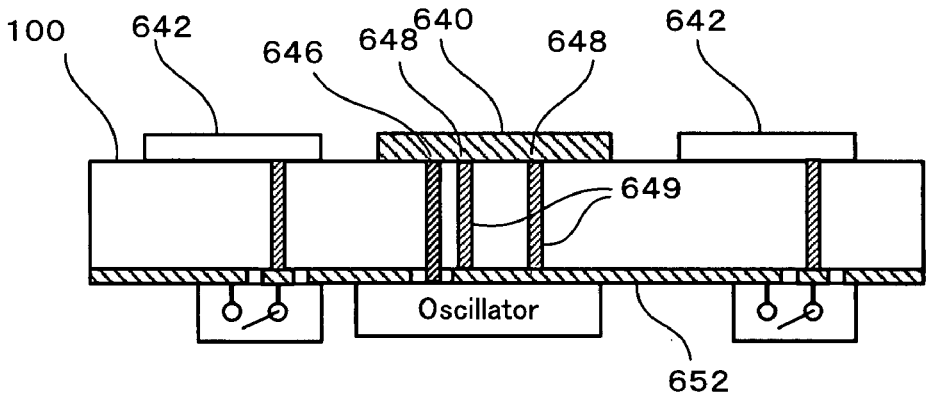
FIG. 69 shows a sectional view of FIG. 68 taken along line A-A.

The antenna shown in FIGS. 68 and 69 has the same construction as the antenna shown in FIG. 13, and in addition thereto, two predetermined ground points 648, 648 (one point would also be acceptable) of feed element 640, which are different from feed point 646, are connected constantly via through holes 649, and 649 to ground electrode 652 respectively. The positions of these ground points 648, 648 are chosen to be special positions, such that there is no power reduction of the radio waves of the fundamental frequency (the fundamental waves) emitted from the antenna, and moreover such that it is possible to reduce unnecessary spuriosities emitted from the antenna (in particular, secondary or tertiary harmonic components) in a state in which the radiation angle of this fundamental wave is maintained.

Figure 70:
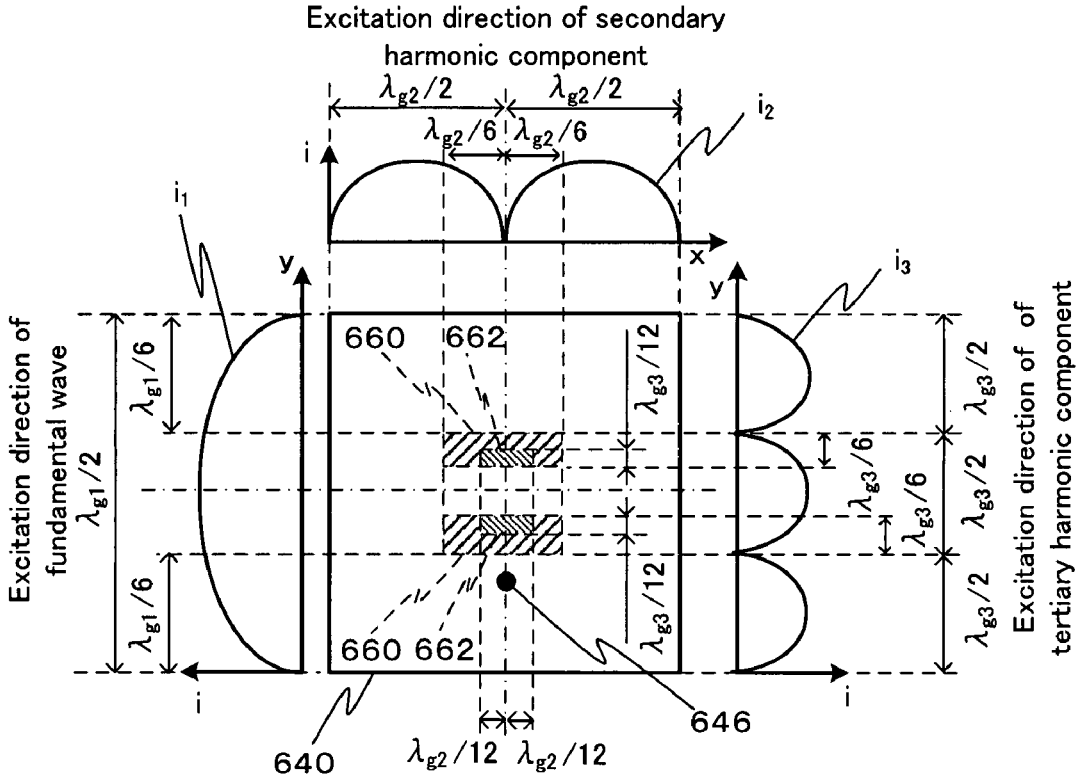
FIG. 70 is a plan view of feed element 640, showing an example of desirable regions in which ground points 648 for spuriousity reduction should be disposed.

FIG. 70 shows an example of regions in which ground points 648 for reducing spuriosities such as those described above should be disposed. In this example feed element 640 is square, and this is an example for the case in which the dimension of its side is about half of the wavelength $\lambda_{g1}$ of the fundamental wave. Since, the way in which the fundamental wave and the harmonic components are distributed becomes different when the shape or the dimensions of feed element 640 are different, accordingly the desirable regions also become different from the example of FIG. 70.

In FIG. 70, regions 660, 660 shown by the hatching are regions in which, by disposing ground points 648 within these regions, it is possible to reduce the radiation power of both the secondary and the tertiary harmonic components while maintaining the radiation power of the fundamental wave high. Here, the fundamental theory is that, the smaller is the electrical current amplitude value of that wave at the ground point upon the feed element, the more effectively is the radiation power upon said feed element of that wave reduced, for any of the fundamental wave and the n-th harmonic. It should be understood that, since the distributions of the current and the voltage of the wave upon the feed element are approximately 90 degree different in phase, accordingly the above described basic theory can also be altered to assert that, the larger is the voltage amplitude value of that wave at the ground point, the more effectively is the radiation power upon the feed element of that wave reduced. Accordingly, if the ground point is provided at a position upon the feed element at which the electrical current amplitude value of the n-th harmonic (where n is a whole number equal to of greater than 2) is minimum (i.e. at a position in which its voltage amplitude value is maximum) or in the vicinity thereof, the radiation power of the n-th harmonic is effectively reduced. If at the same time this ground point is present at a position at which the electrical current value of the fundamental wave is maximum (i.e. at a position where its voltage amplitude value is minimum) or in the vicinity thereof, the possibility of losing the radiation power of the fundamental wave is minimized.

In the example shown in FIG. 70, the excitating direction of the fundamental wave is the y direction (the vertical direction in the figure), while the electrical current distribution is as shown by the graph on the left side in the figure. The excitating direction of the secondary harmonic component is the x direction (the horizontal direction in the figure), while the electrical current distribution is as shown by the upper graph in the figure. And the excitating direction of the third harmonic is the y direction (the vertical direction in the figure), while the electrical current distribution is as shown by the graph on the right side in the figure. Moreover, reference symbols $\lambda_{g1}$, $\lambda_{g2}$, and $\lambda_{g3}$ respectively denote the wavelengths upon the substrate of the fundamental wave, the second harmonic component, and the third harmonic component.

Regions 660, 660 shown by the hatching are, in the excitating direction of the fundamental wave, distance ranges from the extreme edge (the upper or lower extreme edge) of equal to or greater than $\lambda_{g1}/6$ and equal to or less than $\lambda_{g1}/2-\lambda_{g1}/6$. Herein, since the electrical current amplitude value $i_1$ of the fundamental wave is maximum or in the vicinity thereof, accordingly, if the ground points are provided within these regions, it is possible to keep the radiation power of the fundamental wave high. On the other hand, in the excitating direction of the second harmonic component, regions 660, 660 are distance ranges from the extreme edge (the left or right extreme edge) of equal to or greater than $\lambda_{g2}/2$ and equal to or less than $\lambda_{g2}/2+\lambda_{g2}/6$, while, in the excitating direction of the third harmonic, they are distance ranges from the extreme edge (the upper or lower extreme edge) of equal to or greater than $\lambda_{g3}/2-\lambda_{g3}/6$ and equal to or less than $\lambda_{g3}/2+\lambda_{g3}/6$. Herein, since the electrical current amplitude values $i_2$ and $i_3$ of the second and third harmonics are minimum or in the vicinity thereof, accordingly it is possible to reduce the radiation powers of both the second and third harmonics.

Furthermore, in FIG. 70, regions 662, 662 shown by the finer hatching are regions which are even more desirable. In other words, these regions 662, 662 are distance ranges in the excitating direction of the second harmonic from the extreme edge (the left or right extreme edge) of equal to or greater than $\lambda_{g2}/2$ and equal to or less than $\lambda_{g2}/2+\lambda_{g2}/12$. While, in the excitating direction of the third harmonic, they are distance ranges from the extreme edge (the upper or lower extreme edge) of equal to or greater than $\lambda_{g3}/2-\lambda_{g3}/12$ and equal to or less than $\lambda_{g3}/2+\lambda_{g3}/12$. In these regions 662, 662, the electrical current amplitude value $i_1$ of the fundamental wave is almost maximum, and moreover the electrical current amplitude values $i_2$ and $i_3$ of the second and third harmonics are minimum or in the vicinity thereof. Due to this, it is possible effectively to reduce the radiation powers of both the second and third harmonics by yet a further level.

Figure 71:
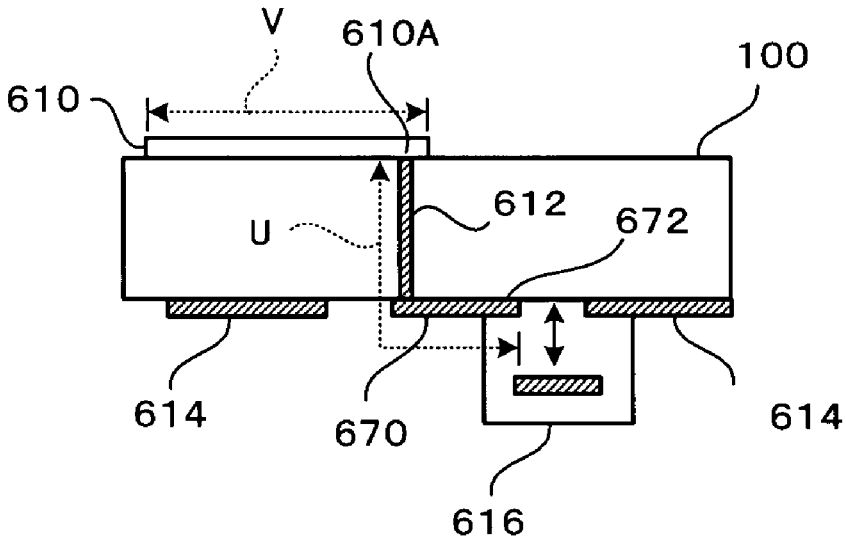
FIG. 71 is a sectional view of a microstrip antenna according to a twenty-fourth embodiment of the present invention (only the portion which corresponds to single parasitic element 610 is extracted)

FIG. 71 shows a sectional view of a microstrip antenna according to a twenty-fourth embodiment of the present invention (only the portion which corresponds to single parasitic element 610 is extracted).

The antenna shown in FIG. 71 is the same as the antenna according to the twenty-second embodiment shown in FIG. 63 in its fundamental construction. However, with the antenna shown in FIG. 63, length T of the line from parasitic element 610 to ground electrode 614 when switch 616 is in its ON state is $\lambda g/2\times n$ (where n is a whole number equal to or greater than 1). By contrast, with the antenna shown in FIG. 71, the length of the portion of the above described transmission line which is connected to parasitic element 610 when switch 616 is in the OFF state, in other words transmission line length U from the ground point of parasitic element 610 until arriving at the final end of the line within the switch upon the rear surface of substrate 100 (in more concrete terms, the total of the length of through hole 612, the length of relay line 670 from through hole 612 upon the rear surface of substrate 100 to switch 616, and the length of transmission line 673 internal to switch 616) is λg/2×n (where n is a whole number equal to or greater than 1) (for example, U=λg/2). Furthermore, length V of parasitic element 610 is also λg/2×n (where n is a whole number equal to or greater than 1) (for example, U=λg/2). In the case that as switch 616, a switch like a semiconductor switch or a mechanical switch (for example a MEMS) is employed which has a transmission line in its interior, and which is small enough to be possible to ignore losses at the contact points when it is ON, the greatest cause of influence upon the direction control of the radio waves which are emitted from the antenna is the high-frequency characteristic related to parasitic element 610, for example the impedance or the phase or the like, when the switch 616 is OFF, rather than when the switch is ON. If transmission line length U when switch 616 is OFF is set to an integer multiple of the half wavelength λg/2 of the high-frequency signal, impedance Z of ground point 610A on parasitic element 610 becomes close to infinite. In other words, it is possible to suppress the phase of parasitic element 610 changing greatly due to connection of the transmission line.

Figure 72A:
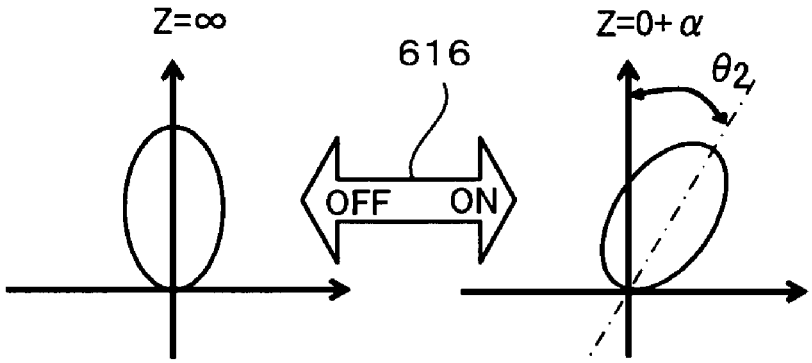
FIG. 72A and FIG. 72B are figures showing, for the antennas shown in FIG. 71 and FIG. 63 respectively, change of the impedance Z at ground point 610A of ground feed element 610 due to the ON/OFF state of switch 616 being switched, and the direction of the radio waves which are emitted from the antenna.
Figure 72B:
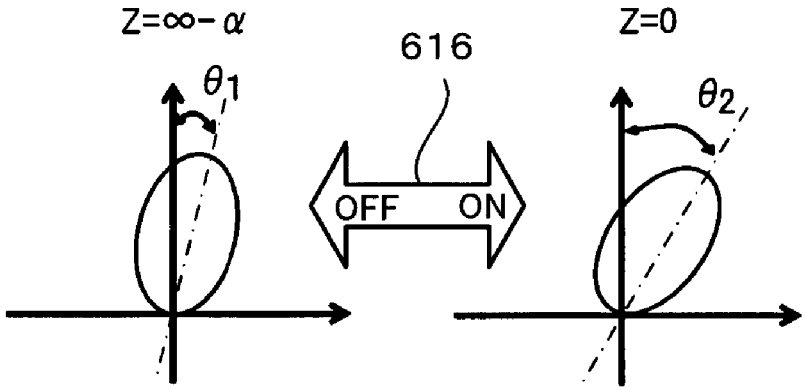

FIG. 72A and FIG. 72B show change of impedance Z at ground point 610A of ground feed element 610 due to the ON/OFF state of switch 616 being changed over, and the direction of the radio waves which are emitted from the antenna, for the antennas shown in FIG. 71 and FIG. 63 respectively.

On the left sides in FIG. 72A and FIG. 72B, the state when switch 616 is OFF is shown. As shown in FIG. 72A, when transmission line length U is an integer multiple of the half wavelength λg/2 of the high-frequency signal, the impedance of ground point 610A becomes almost infinite, and the direction of the radio waves is perpendicular to the substrate for the antenna of FIG. 71. By contrast, as shown in FIG. 72B, with the antenna shown in FIG. 63, when transmission line length U is not an integer multiple of the half wavelength λg/2 of the high-frequency signal, the impedance of ground point 610A is lower, and the direction of the radio waves inclines by some angle θ1. And, on the right sides in FIG. 72A and FIG. 72B, the state when switch 616 is ON is shown. When switch 616 is ON, the radio waves from both of the antennas are inclined by a larger angle θ2, but this angle of inclination θ2 is somewhat different between the two antennas. Accordingly, the changing width of the radio wave direction which is obtained by switching the ON and OFF state of switch 616 is greater for the antenna of FIG. 71, in which transmission line length U is an integer multiple of the half wavelength λg/2 of the high-frequency signal.

For optimization of transmission line length U, it is sufficient to change the length of relay line 670 which is connected to parasitic element 610 via through hole 612. Since the resonant frequency of the antenna is determined by the mutual interference between the feed element and the parasitic elements, accordingly it was contemplated to optimize the length of transmission line U by preparing two types of antenna, an antenna in which through hole 612, intermediate line 670 and switch 616 were connected to parasitic element 610, and an antenna in which through hole 612, intermediate line 670 and switch 616 were not connected to parasitic element 610. And by adjusting the length of intermediate line 670 of the former antenna so that the resonant frequency of the former antenna becomes the same as the resonant frequency of the latter antenna.

Figure 73:
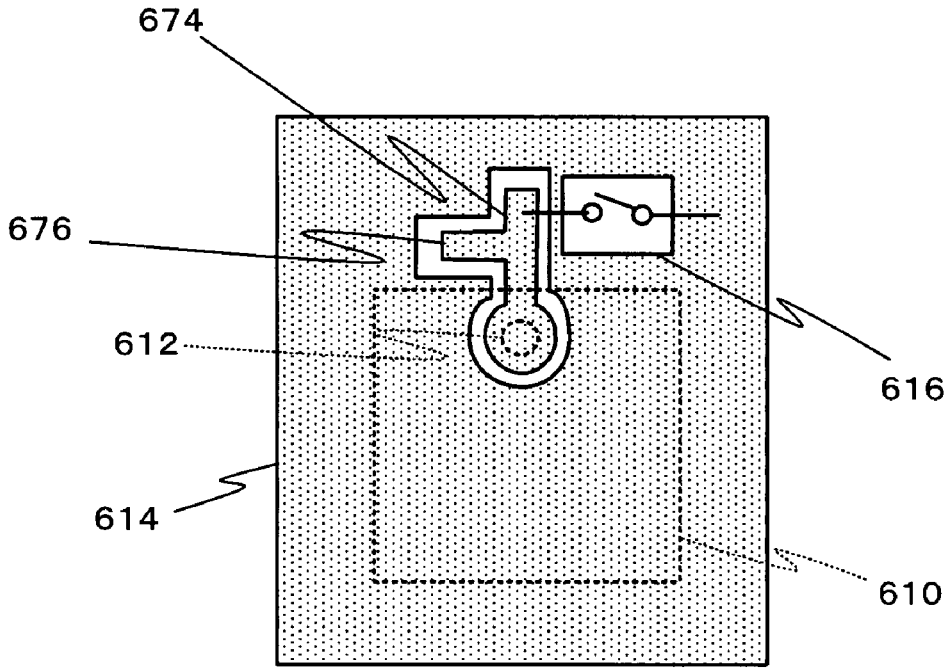
FIG. 73 shows a method, which can be applied to the microstrip antenna according to the present invention, for adjusting the impedance related to parasitic element 610, and shows a plan view of the rear surface of the antenna (only the portion which corresponds to single parasitic element 610 is extracted).

FIG. 73 shows a method, which can be applied to the microstrip antenna according to the present invention, for adjusting the impedance related to parasitic element 610, and shows a plan view of the rear surface of the antenna (only the portion which corresponds to single parasitic element 610 is extracted).

As shown in FIG. 73, stub 676 is provided in relay line 674 between through hole 612 and switch 616. If the impedance related to parasitic element 610 is not adequate, by inserting a notch into this stub 677, it is possible to adjust the impedance to the optimum value. Conversely, it is possible to change the radiation angle of the radio beam easily, by inserting a notch into stub 677 and thus changing the impedance related to parasitic element 610 from the optimum value. Or, as another method, it is possible to adjust the impedance to the optimum value by forming a film or layer of dielectric upon relay line 674, and by adjusting the permittivity, the thickness, or the area of this dielectric layer. Or it would also be possible to adjust the impedance to the optimum value by inserting a notch into relay line 674 itself, and by changing its length or its thickness.

Figure 74:
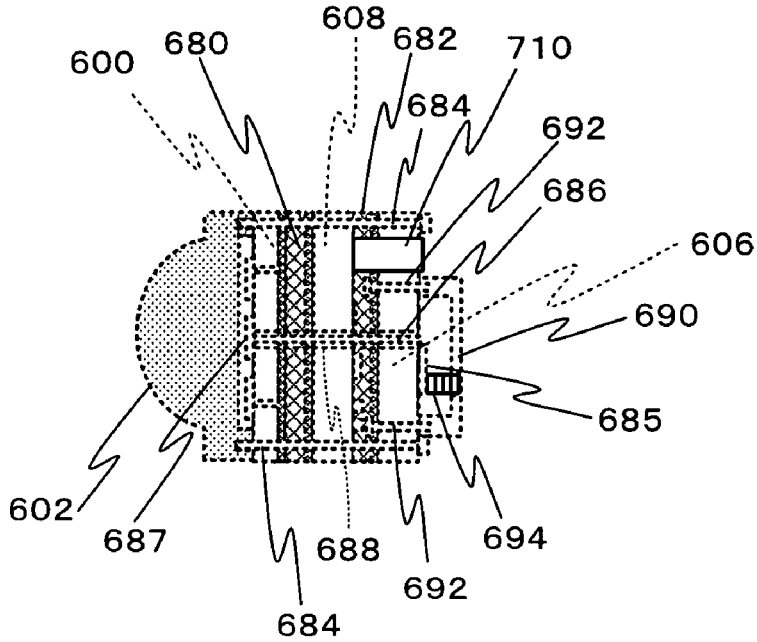
FIG. 74 is a sectional view of a microstrip antenna according to the twenty-fourth embodiment of the present invention.

FIG. 74 shows a sectional view of a microstrip antenna according to the twenty-fourth embodiment of the present invention. And FIG. 75 is an exploded view of this microstrip antenna.

Figure 75:
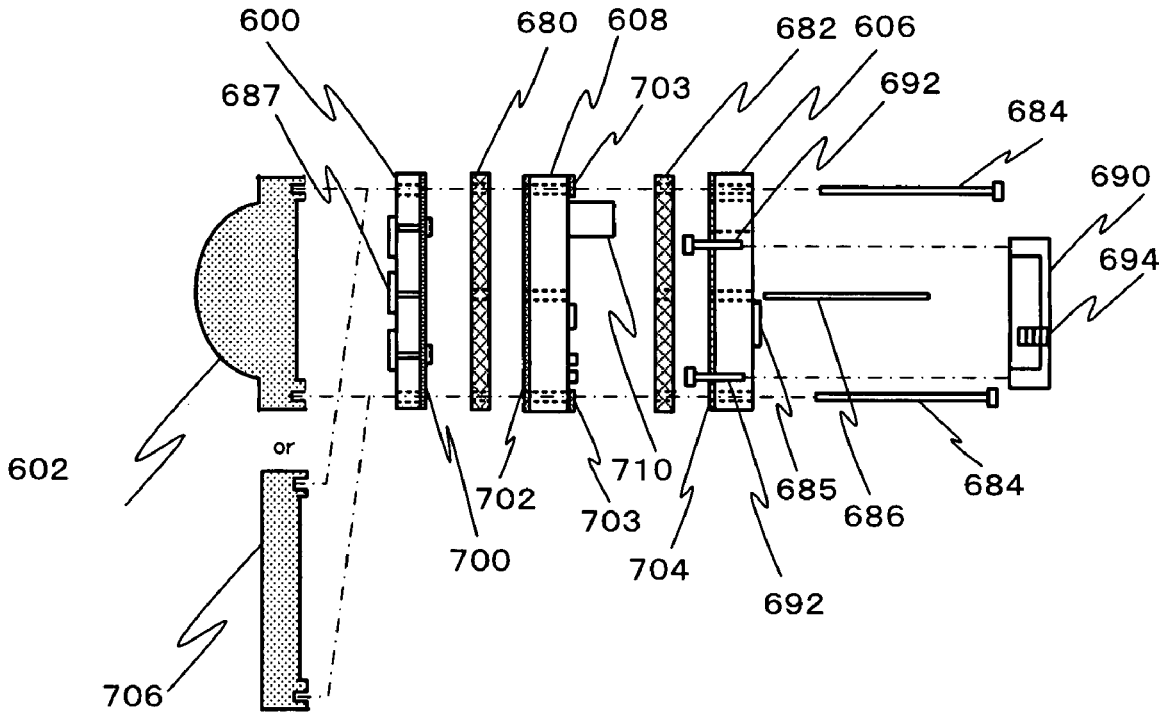
FIG. 75 is an exploded view of this twenty-fourth embodiment.

The microstrip antenna shown in FIGS. 74 and 75 comprises dielectric lens 602 which is disposed upon the front of antenna main body 600, and analog circuit unit 606 and digital circuit unit 608 which are disposed upon the rear surface side of antenna main body 600, in the same manner as the microstrip antenna shown in FIG. 62. However, this microstrip antenna has the following unique structure. That is, as shown in FIGS. 74 and 75, dielectric lens 602, antenna main body 600, spacer 680, digital circuit unit 608, spacer 682, and analog circuit unit 606 are laminated together in this order (the order of analog circuit unit 606 and digital circuit unit 608 is reversed from that of FIG. 62), and these are fixed together into one body by a number of screws 684. Ground electrode 700 which covers almost the entire area of the rear surface of antenna main body 600, and ground electrode 704 which covers almost the entire area of the front surface of analog circuit unit 606, are facing each other. Each of antenna main body 600, spacer 680, analog circuit unit 606, spacer 682, and digital circuit unit 608 has an almost flat plate shape, and accordingly, as a whole, this antenna has almost the shape of a rectangular parallelepiped. Dielectric lens 602 is disposed at the extreme front portion of this antenna, and analog circuit unit 606 is disposed at the extreme rear portion thereof. The portions of screws 684 which protrude more forwards than antenna main body 600 are embedded in the interior of the base portion of dielectric lens 602 and surrounded by the dielectric, and are not exposed above the front surface of antenna main body 600. Instead of dielectric lens 602, it would also be acceptable for thin dielectric cover 706 of almost the shape of a flat plate to be used for protecting this antenna. Dielectric lens 602 or dielectric cover 706 may be selected according to the application for this antenna (for example whether the detection distance is near or far).

High-frequency oscillator 685 is provided in the vicinity of the central portion of the rear surface of analog circuit unit 606, and feed line 686 is extended in a line from this high-frequency oscillator 685 to feed element 687 which is disposed in the vicinity of the central portion of the surface of antenna main body 600. This feed line 686 is pierced through the interiors of analog circuit unit 606, spacer 682, digital circuit unit 608, spacer 680, and antenna main body 600, and is connected to the feed element upon antenna main body 600.

From the aspect of reducing the transmission loss, it would also be acceptable to arrange to use a coaxial cable for feed line 686. In this case, the core wire of the coaxial cable is used as feed line 686, and the coaxial metallic tube which surrounds the core wire of the coaxial cable is connected to both ground electrode 700 which covers almost the entire area of the rear surface of antenna main body 600 and ground electrode 704 which covers almost the entire area of the front surface of analog circuit unit 606. Box shaped shield cover 690 is fixed by a number of screws 692 upon the rear surface of analog circuit unit 606. Shield cover 690 covers the perimeter of high-frequency oscillator 685 upon the rear surface of analog circuit unit 606. A frequency adjustment screw is provided in shield cover 690. By rotating frequency adjustment screw 694, the circuit constant of the high-frequency oscillator 685 may be changed (for example, the empty space distance between the high-frequency oscillator 685 and shield cover 690 may be changed, so that the capacitance of the resonant circuit is varied), and thereby the oscillation frequency of the high-frequency oscillator 685 may be adjusted.

Figure 76:
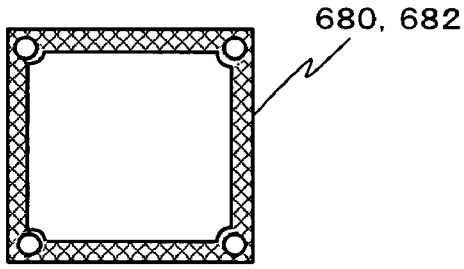
FIG. 76 is a plan view of spacers 688, 682 in the twenty-fourth embodiment.
Figure 77:
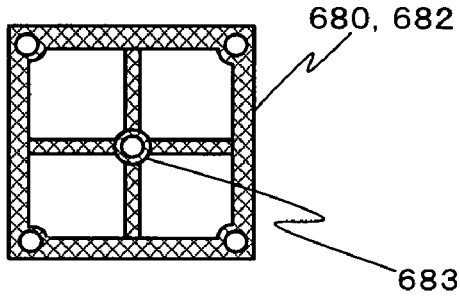
FIG. 77 is a plan view of a variant embodiment of spacers 688, 682 shown in FIG. 76.

Both of spacers 680 and 682 are made from an electrically conductive material such as metal, or their outer surfaces may be covered with electrically conductive material layers. As shown in FIG. 75, one of spacers 680 is contacted against ground electrode 700 which covers almost the entire area of the rear surface of antenna main body 600 and ground electrode 702 which covers almost the entire area of the front surface of digital circuit unit 608, and is maintained at ground level. The other spacer 682 is contacted against ground electrode 703 which is formed upon the perimeter of the rear surface of digital circuit unit 608 and ground electrode 704 which covers almost the entire area of the front surface of analog circuit unit 606, and is maintained at ground level. Both of spacers 680 and 682 have annular shapes as shown in FIG. 76, and surround feed line 686. Or, as shown in FIG. 77, both of spacers 680 and 682 may have, at their central portions, shield tube 683 which is kept at ground level, with feed line 686 passing through within this shield tube 683, with shield tube 683 and feed line 686 being arranged coaxially.

Figure 78:
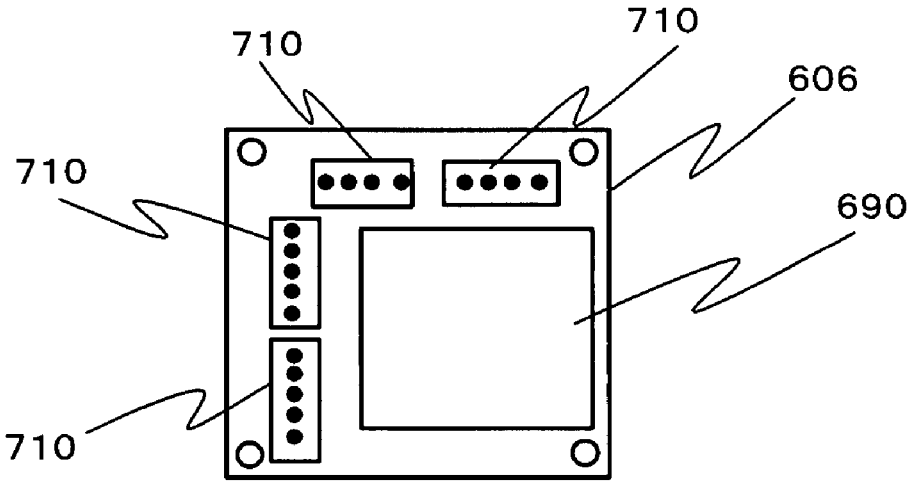
FIG. 78 is a rear view of analog circuit unit 606 of the twenty-fourth embodiment.

A micro computer or the like, which performs control of antenna main body 600 and control of the sensor circuits and the like, is mounted to digital circuit unit 608. Furthermore, several external ports 710 are provided upon the rear surface of digital circuit unit 608. For these external ports 710, there may be provided a signal input and output port for external input and output of various types of signal such as sensor signals and power supply voltage and monitor signals and the like, a data write port for performing writing of a program or data to a flash ROM which is housed internally to the micro computer described above, a data setting port for making various types of setting for the above described micro computer related to control operation (such as, for example, the sequence and the period at which the switches of the parasitic elements should be turned ON and OFF, and so on), and the like. External ports 710 project rearwards from the rear surface of digital circuit unit 608, and pierce through the interiors of spacer 682 and analog circuit unit 606. Accordingly, as shown by way of example in FIG. 78, the opening portions at the upper ends of external ports 710 are exposed upon the rear surface of analog circuit unit 606, and make it possible to access digital circuit unit 608. Among external ports 710, in particular, it would be acceptable to block up the data write port with synthetic resin or the like, after data has been written in some step of manufacture, in order to make it impossible for the user to rewrite the data conveniently.

In the antenna shown in FIGS. 74 and 75, the external ports which project above digital circuit unit 608 are compact, since all of the components being integrally laminated and bonded together and they are contained within spacer 682 and analog circuit unit 606. And, since feed line 686 may be a short line which is equivalent to the thickness of this antenna which is of this compact laminated construction, accordingly it is possible to make the electrical power loss in the feed line 686 small. Furthermore, it is possible to change the oscillation frequency by using frequency adjustment screw 694. Moreover, the ground levels of antenna main body 600 and analog circuit unit 606 are made to be the same, so that it is possible to ensure a satisfactory antenna performance by spacers 680 and 682 which are made from an electrically conductive material being tightly held to ground electrodes 700, 702, 703, and 704 between antenna main body 600, digital circuit unit 608, and analog circuit unit 606. Furthermore, if spacers 680 and 682 having a structure as shown in FIG. 77 are employed, the electrical power loss becomes small, since it is possible to maintain the perimeter of feed line 686 between antenna main body 600 and high-frequency oscillator 685 at ground level. Moreover, by laminating together antenna main body 600, digital circuit unit 608, and analog circuit unit 606, and integrally coupling them together, it is possible to suppress radiation to the exterior of radio waves which are emitted from the rear surface (the ground surface) of antenna main body 600, and of unnecessary higher harmonic which are emitted from high-frequency oscillator 685. Accordingly, it is possible to emit the radio waves from the front surface of antenna main body 600 in the desired direction with good efficiency. Furthermore, since screws 684 are embedded in the interior of dielectric lens 602, and are not exposed upon the front surface of antenna main body 600 which is covered over with the dielectric, accordingly, even if screws 684 are made from material or are plated with metal, so that they are electrically conductive, still it is possible to suppress interference between the radio waves which are emitted from the front surface of antenna main body 600 and screws 684, so that it is possible to emit the radio waves with good efficiency through dielectric lens 602 in the forwards direction.

Figure 79:
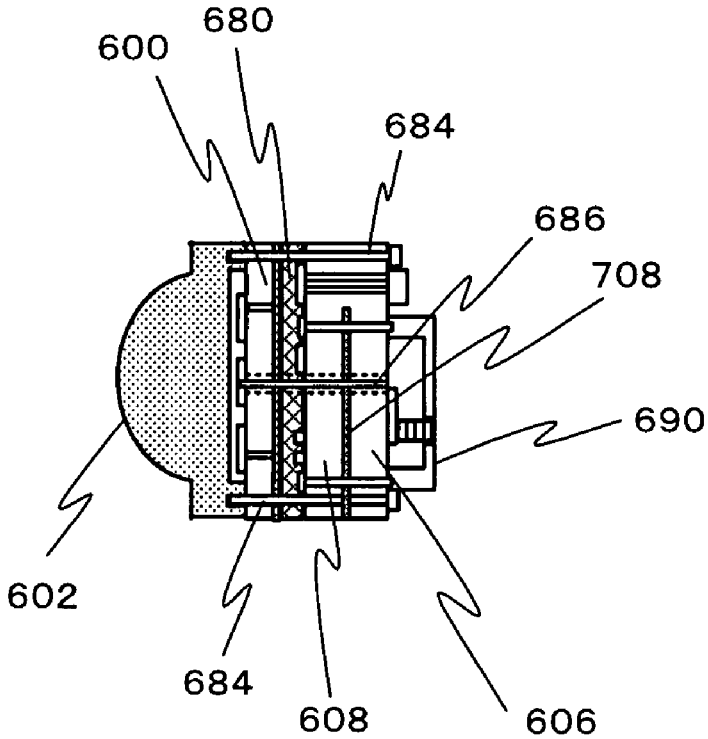
FIG. 79 is a cross sectional view of a variant embodiment of the twenty-fourth embodiment.

FIG. 79 is a cross sectional view of a variant embodiment of the microstrip antenna shown in FIG. 74 and FIG. 75.

With the antenna shown in FIG. 79, the aspect of difference from the antenna shown in FIGS. 74 and 75 is that a unit body made in three layers is used, in which digital circuit unit 608, ground electrode 704, and analog circuit unit 606 are laminated together into one unit. Digital circuit unit 608 and analog circuit unit 606 both have the same ground electrode 704 in common, sandwiched between the two of them. Thus, spacer 682 which is shown in FIGS. 74 and 75 is not present. The antenna shown in FIG. 79 is more compact.

In this embodiment, screws 684 are inserted and fixed from the side of analog circuit unit 606. However, if a construction is employed in which no dielectric lens 602 or dielectric cover 706 is used (for example, a construction in which a resin cover layer for protection is formed directly upon the surface of the antenna element), it is also possible to fix all the components together by inserting screws 684 from the side of antenna main body 600. Moreover, it would also be possible to fix together all of the components by inserting metallic rods instead of screws into through holes for passing the screws provided at the four corners of spacers 680 and 682, and by connecting these metallic rods and the ground electrodes of antenna main body 600, digital circuit unit 608, and analog circuit unit 606 together by fixing with solder.

Figure 80A:
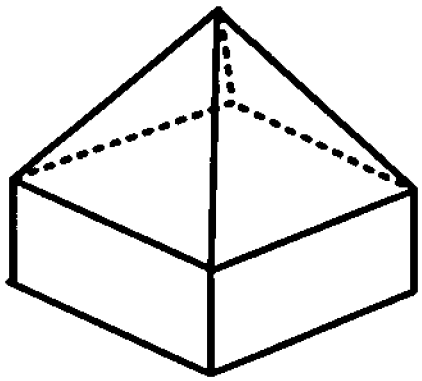
FIG. 80A through FIG. 80C are perspective views of variations of a dielectric lens, which can be applied to the microstrip antenna of the present invention.
Figure 80B:
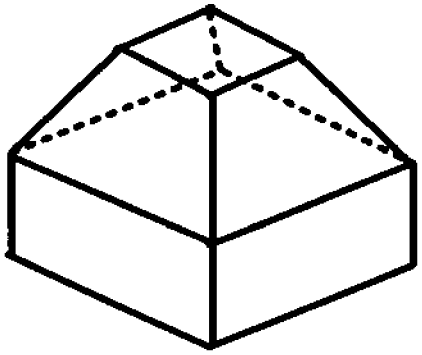
Figure 80C:
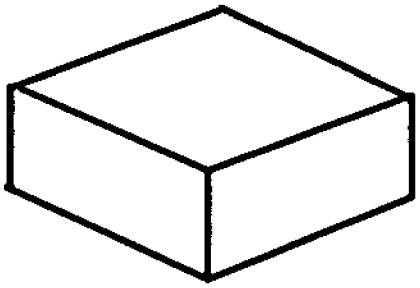

FIG. 80A through FIG. 80C show variations of the dielectric lens, which can be applied to the antennas shown in FIGS. 74 and 75 and in FIG. 79, and to other microstrip antennas according to the present invention.

It is not necessary for the dielectric lens to be a spherical lens; it can also be of various shapes which project in the normal direction to the antenna surface—for example, it can also be a lens shaped as a triangular pyramid as shown in FIG. 80A, or a lens shaped as a trapezoidal pyramid as shown in FIG. 80B. Or, if a flat dielectric plate or layer is used as a lens as shown in FIG. 80C, it is possible to enhance the antenna gain. Moreover, by coating the outer surface of the dielectric lens with a layer of photocatalyst material, it is possible to prevent fouling due to moisture or wind or the like from adhering to the lens, so that it is possible to emit the radio waves with good efficiency over the long term.

Figure 81A:
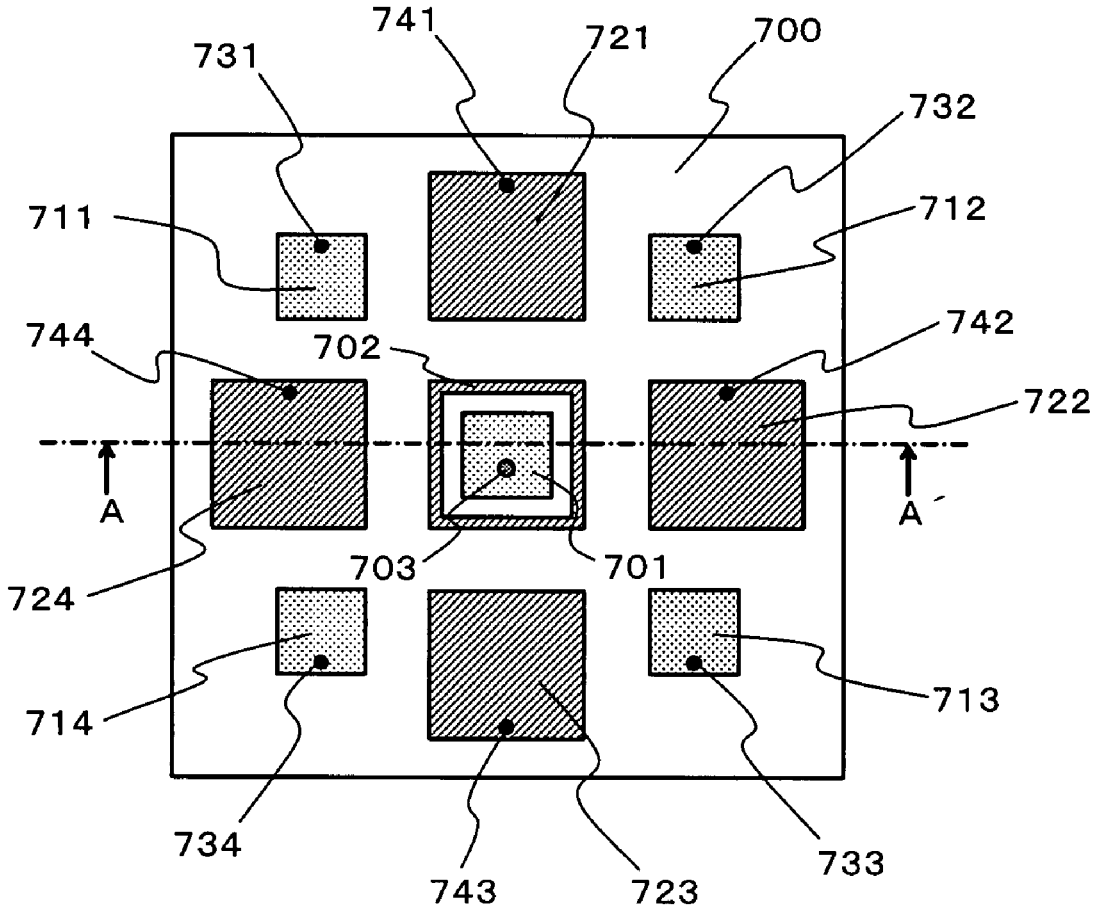
FIG. 81A and FIG. 81B are a plan view and a sectional view of a microstrip antenna according to a twenty-fifth embodiment of the present invention.
Figure 81B:
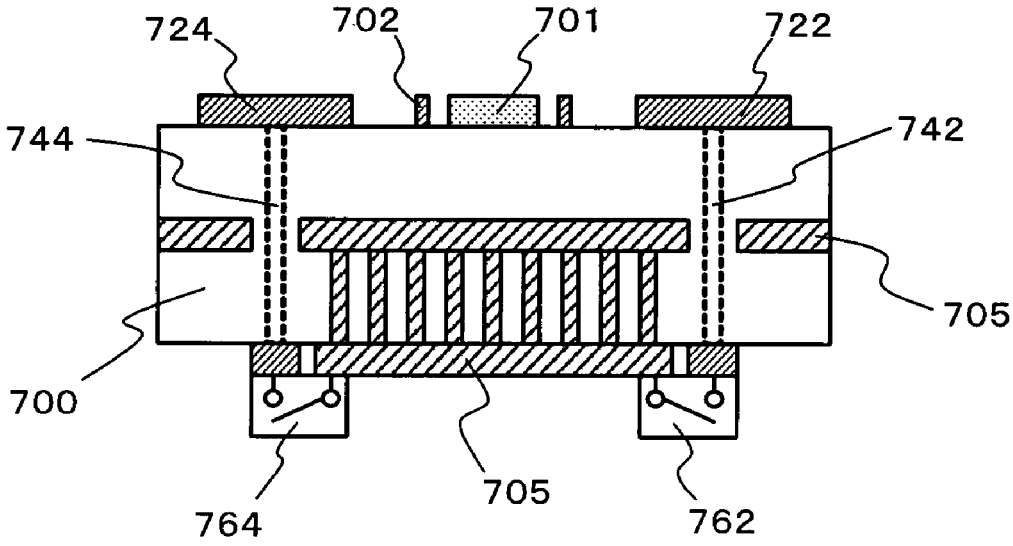

FIG. 81A and FIG. 81B respectively show a plan view and a sectional view of a microstrip antenna according to a twenty-fifth embodiment of the present invention.

As shown in FIGS. 81A and 81B, ground electrode 705 which supplies ground level is formed in the interior of substrate 700, and feed element 701 is provided in the approximate center upon the front surface of substrate 700. And rectangular looped element 702 is arranged so as to surround the periphery of feed element 701 while being separated from feed element 701 by only a slight distance. As described hereinafter, looped element 702 has a function which resembles a second feed element which is larger than feed element 701. And first parasitic elements 711, 712, 713, and 714 are arranged at positions which are spaced by just a predetermined interelement spacing in the diagonal directions outward from the corner portions of looped element 702 (or of feed element 701). Furthermore, second parasitic elements 721, 722, 723, and 724 are arranged at positions which are spaced by just a predetermined interelement spacing in the normal directions outward from the edges of looped element 702 (or of the feed element 701). The switches (all of these switches are omitted from the figure) for switching between being grounded and float is connected to first parasitic elements 711, 712, 713, and 714 respectively via control leads (through holes) 731, 732, 733, and 734 respectively. And these switches are disposed upon the rear surface of substrate 700. And, switches 762 and 764 (two other switches are omitted from the figure) for switching between being grounded float is connected to the second parasitic elements 721, 722, 723, and 724 respectively via control leads (through holes) 741, 742, 743, and 744 respectively. And these switches 762 and 764 are also disposed upon the rear surface of substrate 700.

This microstrip antenna is a double frequency antenna which has a first resonant frequency bandwidth and a second resonant frequency bandwidth. The first resonant frequency bandwidth is determined by the length of one side of feed element 701. When a high-frequency signal of the first resonant frequency bandwidth is applied to feed element 701 from feed line 703, feed element 701 is excited in the vertical direction in the figure. The second resonant frequency bandwidth is determined by the size of the contour of looped element 702 which surrounds feed element 701 (in particular by the length and the line width of its outer sides). And, when a high-frequency signal of the second resonant frequency bandwidth is applied to feed element 701 from feed line 703, an electrical current is excited in looped element 702, and the looped element 702 is excited in the vertical direction in the figure. Although, in this manner, both the excitating directions are the same, it is possible to obtain resonances at two types of frequencies whose half wavelengths ($\lambda g/2$) are different.

Each of first parasitic elements 711, 712, 713, and 714 is an electrode of a rectangular shape with the length of one of its sides being approximately the half wavelength $\lambda g/2$ of the first resonant frequency bandwidth, and can resonate at the first resonant frequency bandwidth. And each of second parasitic elements 721, 722, 723, and 724 is an electrode of a rectangular shape with the length of one of its sides being approximately the half wavelength $\lambda g/2$ of the second resonant frequency bandwidth, and can resonate at the second resonant frequency bandwidth.

When a high-frequency signal of the first resonant frequency bandwidth is applied to feed element 701 from feed line 703, all of switches 762 and 764 which are connected to second parasitic elements 721, 722, 723, and 724 are turned ON (connected). And thus second parasitic elements 721, 722, 723, and 724 are all grounded. At this time, a radio beam of the first resonant frequency bandwidth is emitted from this microstrip antenna. And it is possible to vary the radiating direction of this radio beam at the first resonant frequency bandwidth, by switching each one of the switches which are connected to first parasitic elements 711, 712, 713, and 714 between ON (connected) and OFF (disconnected).

In the same manner, when a high-frequency signal of the second resonant frequency bandwidth is applied to feed element 701 from feed line 703, all of the switches which are connected to first parasitic elements 711, 712, 713, and 714 are turned ON (connected). And thus first parasitic elements 711, 712, 713, and 714 are all grounded. At this time, a radio beam of the second resonant frequency bandwidth is emitted from this microstrip antenna. And it is possible to vary the radiating direction of this radio beam at the second resonant frequency bandwidth, by switching each one of switches 762 and 764 which are connected to second parasitic elements 721, 722, 723, and 724 between ON (connected) and OFF (disconnected).

This microstrip antenna is made simply with a compact and moreover thin structure, and is also capable of transmitting and receiving high-frequency radio beams of two types of frequencies. At the present, in Japan, as frequency bands for a mobile body detection sensor, the 10 GHz band is approved for use indoors, and the 24 GHz band is approved for use outdoors. Thus, with this microstrip antenna, if the shapes and sizes of the elements are determined so that the first resonant frequency bandwidth is 24 GHz and the second resonant frequency bandwidth is 10 GHz, it is possible to utilize this same microstrip antenna in any location, irrespective of whether it is indoors or outdoors.

Figure 82:
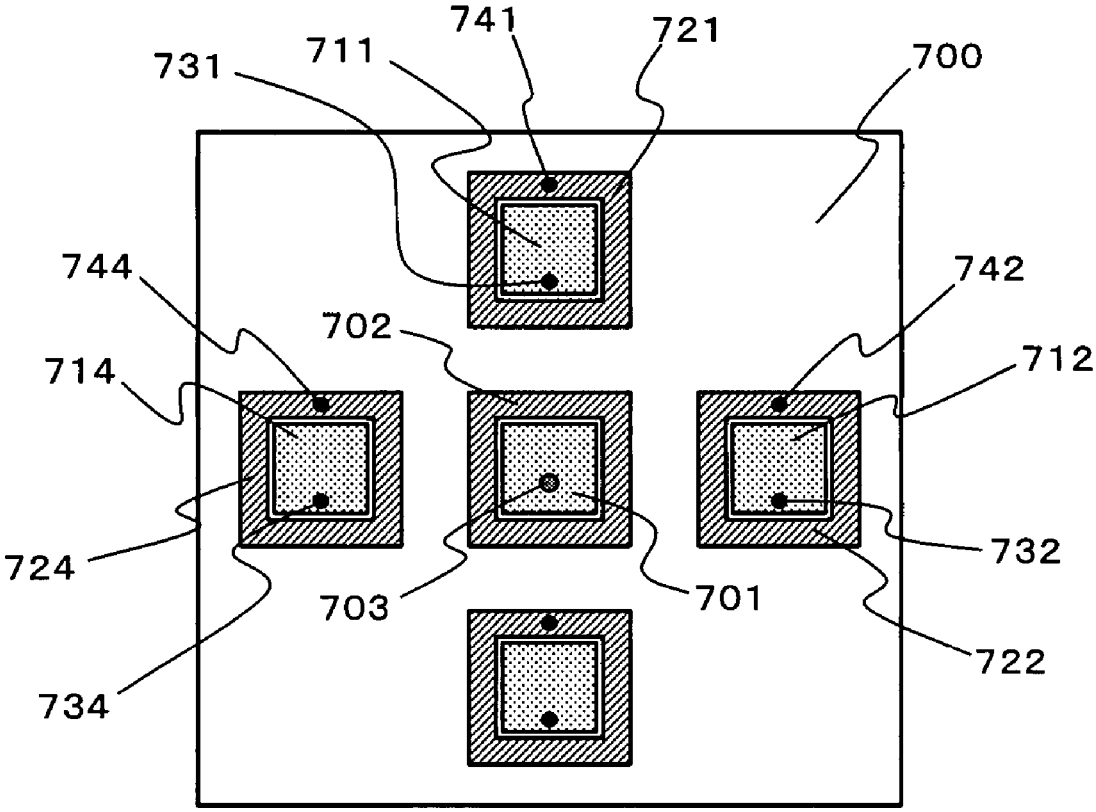
FIG. 82 is a plan view of a variant embodiment of the twenty-fifth embodiment.

FIG. 82 shows a plan view of a variant embodiment of the microstrip antenna shown in FIG. 81A.

As shown in FIG. 82, first parasitic elements 711, 712, 713, and 714 of the same shape and the same size as feed element 701 are arranged in positions separated from loop shaped element 702 (or feed element 701) by just a predetermined interelement spacing. Rectangular looped second parasitic elements 721, 722, 723, and 724 of the same shape and the same size as looped element 702 which surrounds feed element 701 are arranged so as to surround the periphery of each of first parasitic elements 711, 712, 713, and 714. Switches (not shown in the figure) are connected to these second parasitic elements 721, 722, 723, and 724 via respective control leads (through holes) 741, 742, 743, and 744, and those switches are disposed upon the rear surface of substrate 700. By switching these switches, it is possible to switch each of looped second parasitic elements 721, 722, 723, and 724 between being float and being grounded.

When a high-frequency signal of the first resonant frequency bandwidth is applied to feed element 701 from feed line 703, all of the switches which are connected to second parasitic elements 721, 722, 723, and 724 are turned ON. Thus second parasitic elements 721, 722, 723, and 724 are all grounded. At this time, a radio beam of the first resonant frequency bandwidth is emitted from this microstrip antenna. And it is possible to vary the radiating direction of this radio beam at the first resonant frequency bandwidth, by switching each one of the switches which are connected to first parasitic elements 711, 712, 713, and 714 between ON and OFF.

In the same manner, when a high-frequency signal of the second resonant frequency bandwidth is applied to feed element 701 from feed line 703, all of the switches which are connected to first parasitic elements 711, 712, 713, and 714 are turned ON. Thus first parasitic elements 711, 712, 713, and 714 are all grounded. At this time, a radio beam of the second resonant frequency bandwidth is emitted from this microstrip antenna. And it is possible to vary the radiating direction of this radio beam at the second resonant frequency bandwidth, by switching each one of the switches 762 and 764 which are connected to second parasitic elements 721, 722, 723, and 724 between ON and OFF.

Although the present invention has been explained in terms of embodiments thereof, these embodiments are only provided by way of example for explanation of the present invention; the range of the present invention is not to be considered as being limited only to these embodiments. Provided that the gist of the present invention is not departed from, it can also be implemented in various other ways.

The invention claimed is:

1. A microstrip antenna comprising:

a substrate;

a feed element formed as a thin layer and disposed upon a front surface of said substrate;

a parasitic element formed as a thin layer and disposed upon said front surface of said substrate and separated by a predetermined interelement spacing from said feed element;

a ground electrode disposed to oppose said feed element and said parasitic element via said substrate; and a grounding means connected between said parasitic element and said ground electrode and switching said parasitic element between a grounding state and a floating state, wherein said grounding means includes a switching line, which is opened and closed, for releasing high-frequency signals from said parasitic element to ground level, wherein said grounding means has a line length T extending from a ground point provided on said parasitic element through a through hole in the substrate to said ground electrode, and wherein said line length T is set so that an amount of a high-frequency electrical flow that flows in said parasitic element becomes zero in said grounding state.

2. The microstrip antenna as described in claim 1, wherein said grounding means comprises a ground electrode, and a switch for switching said parasitic element between coupled and uncoupled to said ground electrode.

3. The microstrip antenna as described in claim 2, wherein said switch comprises two electrical contact points which are respectively coupled to said parasitic element and said ground electrode, and said two electrical contact points are separated by a first gap when it is switched ON, and are separated by a second gap which is larger than said first gap when it is switched OFF.

4. The microstrip antenna as described in claim 2, wherein said switch comprises two electrical contact points which are respectively coupled to said parasitic element and said ground electrode, a mutual distance is variable, and an insulation layer which is provided between said two electrical contact points.

5. The microstrip antenna as described in claim 1, wherein:

said parasitic element is disposed so as to be separated from said feed element by said predetermined interelement spacing in an excitating direction; and said interelement spacing is $\lambda/4$ to $\lambda/30$, $\lambda$ being the wavelength of radio waves in the air at a resonant frequency of said feed element.

6. The microstrip antenna as described in claim 1, wherein:

said parasitic element is disposed so as to be separated from said feed element by said predetermined interelement spacing in a direction perpendicular to the excitating direction; and said interelement spacing is $\lambda/4$ to $\lambda/9$, $\lambda$ being the wavelength of radio waves in the air at the resonant frequency of said feed element.

7. The microstrip antenna as described in claim 1, further comprising:

a plurality of said parasitic elements which are arranged on one side of said feed element in alignment linearly with said feed element; and a plurality of said grounding means respectively corresponding to said plurality of parasitic elements;

wherein each of said interelement spacing of said plurality of parasitic elements is different.

8. The microstrip antenna as described in claim 1, further comprising:

a plurality of said parasitic elements which are arranged on different sides of said feed element respectively; and a plurality of said grounding means respectively corresponding to said plurality of parasitic elements.

9. The microstrip antenna as described in claim 1, further comprising:

a plurality of said parasitic elements which are arranged on both sides of said feed element in alignment linearly with said feed element; and a plurality of said grounding means respectively corresponding to said plurality of parasitic elements;

wherein a size or said interelement space of each said parasitic elements is different so as to balance the influence of said parasitic elements which are disposed upon one side of said feed element and said parasitic elements which are disposed upon the other side thereof upon an electronic beam.

10. The microstrip antenna as described in claim 1, further comprising a dielectric layer which covers the front surface of said substrate, including surfaces of said feed element and of said parasitic element.

11. The microstrip antenna as described in claim 1, further comprising a dielectric mask which covers opposing end surfaces of said feed element and another said feed element which are adjacent each other, or opposing end surfaces of said feed element and said parasitic element which are adjacent each other, or opposing end surfaces of a said parasitic element and another said parasitic element which are adjacent each other.

12. The microstrip antenna as described in claim 1, further comprising:

a plurality of sub-antennas upon the front surface of said substrate, each comprises a set of said feed element and said parasitic element; and a slit disposed on a portion of said substrate corresponding to a boundary of said plurality of sub-antennas.

13. The microstrip antenna as described in claim 1, further comprising:

a plurality of sub-antennas upon the front surface of said substrate, each comprises a set of said feed element and said parasitic element; and a shield member disposed on a portion of said substrate corresponding to a boundary of said plurality of sub-antennas, wherein the shield member is always maintained at a constant electrical potential.

14. The microstrip antenna as described in claim 1, wherein said parasitic element is adapted to be able to be grounded at a plurality of spots.

15. The microstrip antenna as described in claim 1, wherein said parasitic element is disposed to be directed diagonally to the excitating direction of said feed element with respect to said feed element.

16. The microstrip antenna as described in claim 1, further comprising: a plurality of first type of sub-antennas and a plurality of second type of sub-antennas, each of which comprises a set of said feed element and said parasitic element disposed on the front surface of said substrate, wherein said first type of sub-antennas differ from said second type of sub-antennas with regard to the position relationship between said parasitic element and said feed element; and said first and said second type of sub-antenna are disposed in complementary positions.

17. The microstrip antenna as described in claim 16, wherein:

said parasitic element is disposed to be directed diagonally to the excitating direction of said feed element in said first type of sub-antenna with respect to said feed element; and said parasitic element is disposed parallel or perpendicular to the excitating direction of said feed element in the second type of sub-antenna with respect to said feed element.

18. The microstrip antenna as described in claim 1, wherein said parasitic element comprises a constant grounding point which is always grounded at a position in the vicinity of the center of one or more exterior edge of said parasitic element orthogonal to its excitating direction when said parasitic element is float.

19. The microstrip antenna as described in claim 1, wherein said feed element comprises:

a plurality of feed points for exciting said feed element in different directions; and a plurality of grounding points which are selectively grounded so as to enable any one of said excitations excited by said plurality of said feed points selectively and substantially disable others.

20. The microstrip antenna as described in claim 1, wherein, a plurality of feed elements are disposed on said substrate adjacent to each other with no parasitic element being placed between them, and a plurality of parasitic elements are disposed so as to surround said plurality of feed elements two-dimensionally.

21. The microstrip antenna as described in claim 1, wherein, a plurality of feed elements are disposed on said substrate adjacent to each other with no parasitic elements being placed between them, and further comprising a second grounding means switching at least one predetermined point of said plurality of feed elements between grounding and float.

22. The microstrip antenna as described in claim 1, further comprising a dielectric lens which is disposed upon the front of said feed element and said parasitic element.

23. A microstrip antenna as described in claim 1, wherein said line length is m times a half wavelength of said high-frequency, m being a whole number equal to or greater than 1.

24. The microstrip antenna as described in claim 1, wherein said line length of said grounding means is changeable between a value that is m times half wavelength of said high-frequency signals in said grounding state and a value that is different from m times said half wavelength of said high-frequency signals in said floating state.

25. The microstrip antenna as described in claim 1, further comprising a second grounding means for grounding a predetermined point upon said feed element at a place upon said feed element so as to minimize a current amplitude value of n-th harmonic, n being a whole number equal to or greater than 2 or in the vicinity thereof, and at a place so as to maximize the current amplitude value of the fundamental wave or in the vicinity thereof.

26. The microstrip antenna as described in claim 1, wherein:

said grounding means comprises a line which can be opened or closed for releasing high-frequency signals from said parasitic element to ground level, and a length of a part of said line part which couples to said parasitic element when said line is in an open state is m times a half wavelength of said high-frequency signals, m being a whole number equal to or greater than 1.

27. The microstrip antenna as described in claim 1, wherein:

said grounding means comprises a line which can be opened or closed for releasing high-frequency signals from said parasitic element to ground level, and said line comprises a means for adjusting impedance.

28. The microstrip antenna as described in claim 1, further comprising:

a substantially flat first circuit unit having a control circuit which controls said grounding means; and a substantially flat second circuit unit having a high-frequency oscillation circuit which generates high-frequency power for applying to said feed element;

wherein said first and said second circuit unit are integrally coupled together with laminated upon a rear surface of said substrate.

29. The microstrip antenna as described in claim 28, further comprising a substantially flat spacer interposed between said substrate and said first circuit unit, and/or between said first circuit unit and said second circuit unit, which is kept at ground potential;

wherein said substrate, said first and second circuit units, and said spacer are integrally coupled together with laminated.

30. The microstrip antenna as described in claim 29, further comprising a feed line which is coupled to said high-frequency oscillation circuit upon said second circuit unit and to said feed element upon said substrate, wherein said feed line passes through the interior of said spacer and is surrounded by said spacer.

31. The microstrip antenna as described in claim 28, wherein said first and second circuit units share the same ground electrode which is interposed between said first and second circuit units.

32. A microstrip antenna, comprising: a substrate;

a feed element disposed upon a front surface of said substrate, and resonates at a first resonant frequency bandwidth;

a looped element disposed so as to surround said feed element, and resonates at a second resonant frequency bandwidth;

a first parasitic element disposed upon the front surface of said substrate and separated by a predetermined interelement spacing from said looped element or said feed element, and resonates at the first resonant frequency bandwidth;

a second parasitic element disposed upon the front surface of said substrate and separated by a predetermined interelement spacing from said looped element or said feed element, and resonates at the second resonant frequency bandwidth; and a grounding means switching said first parasitic element and said second parasitic element between grounding state and float state, wherein said grounding means includes a switching line, which is opened and closed, for releasing high-frequency signals from said parasitic element to ground level, wherein grounding means has a line length T extending from a ground point provided on said parasitic element through a through hole in the substrate to said ground electrode, and wherein said line length is set so that an amount of a high-frequency electrical flow that flows in said parasitic element becomes zero in said grounding state.

33. A high-frequency sensor utilizing a microstrip antenna, said microstrip antenna comprising:

a substrate;

a feed element formed as a thin layer and disposed upon a front surface of said substrate;

a parasitic element formed as a thin layer and disposed upon said front surface of said substrate and separated by a predetermined interelement spacing from said feed element;

a ground electrode disposed to oppose said feed element and said parasitic element via said substrate; and a grounding means connected between said parasitic element and said ground electrode and switching said parasitic element between a grounding state and a floating state, wherein said grounding means includes a switching line, which is opened and closed, for releasing high-frequency signals from said parasitic element to ground level, wherein said grounding means has a line length T extending from a ground point provided on said parasitic element through a through hole in the substrate to said ground electrode, and wherein said line length T is set so that an amount of a high-frequency electrical flow that flows in said parasitic element becomes zero in said grounding state.

* * * * *